US008453655B2

(12) United States Patent
Sugiura et al.

(10) Patent No.: US 8,453,655 B2
(45) Date of Patent: Jun. 4, 2013

(54) SURFACE TREATMENT APPARATUS

(75) Inventors: Yutaka Sugiura, Hirakata (JP); Ryosuke Hamada, Hirakata (JP); Tetsuro Uemura, Hirakata (JP); Hideki Nakada, Hirakata (JP)

(73) Assignee: C. Uyemura & Co., Ltd., Osaka-shi (JP)

( * ) Notice: Subject to any disclaimer, the term of this patent is extended or adjusted under 35 U.S.C. 154(b) by 1012 days.

(21) Appl. No.: 12/519,939

(22) PCT Filed: Dec. 27, 2006

(86) PCT No.: PCT/JP2006/326048

§ 371 (c)(1),
(2), (4) Date: Jun. 18, 2009

(87) PCT Pub. No.: WO2008/081504

PCT Pub. Date: Jul. 10, 2008

(65) Prior Publication Data

US 2009/0308415 A1 Dec. 17, 2009

(51) Int. Cl.
*B08B 3/02* (2006.01)

(52) U.S. Cl.
USPC ..... 134/94.1; 134/103.2; 134/104.1; 134/137; 134/157; 134/158; 134/198; 134/84; 134/86; 134/88; 134/89

(58) Field of Classification Search
USPC ..... 134/94.1, 61, 158, 99.1, 153; 156/345.32; 49/47

See application file for complete search history.

(56) References Cited

U.S. PATENT DOCUMENTS

| | | | | |
|---|---|---|---|---|
| 3,916,937 | A * | 11/1975 | Nystrom | 137/255 |
| 5,872,892 | A * | 2/1999 | Brown et al. | 700/245 |
| 5,879,520 | A * | 3/1999 | Griego | 204/212 |
| 6,770,149 | B2 * | 8/2004 | Satou et al. | 134/10 |

FOREIGN PATENT DOCUMENTS

| | | |
|---|---|---|
| JP | 01-135565 | 5/1989 |
| JP | 5-251327 A | 9/1993 |
| JP | 8-239799 A | 9/1996 |
| JP | 11-505295 A | 5/1999 |
| JP | 11-342359 A | 12/1999 |
| JP | 2006-274412 | 10/2006 |
| WO | WO 96/37638 A1 | 11/1996 |

OTHER PUBLICATIONS

International Search Report dated Apr. 3, 2007 with English translation (five (5) pages).
Japanese Office Action dated Oct. 23, 2012 with English translation (4 pages).

* cited by examiner

*Primary Examiner* — Michael Kornakov
*Assistant Examiner* — Marc Lorenzi
(74) *Attorney, Agent, or Firm* — Crowell & Moring LLP

(57) ABSTRACT

Inside a single apparatus main body (100), a surface treatment apparatus includes: a treatment cell (11); a vertical rotation shaft (12); an attachment/detachment device; a receiving tank (15); a cover body (16); a plurality of tanks (21); a plurality of surface treatment liquid supply devices (22); a cleaning water supply device; a drain device (3); and a first cleaning device. Upon operation of the surface treatment liquid supply device while the treatment cell (11) containing small objects is rotated by the vertical rotation shaft (12), a surface treatment is carried out on the small objects, upon operation of the cleaning water supply device, the small objects inside the treatment cell (11) are cleaned, and upon operation of the first cleaning device, the inner face of the cover body and the outer face of the treatment cell are cleaned, thus providing circulation use of surface treatment liquids in the tanks.

7 Claims, 44 Drawing Sheets

SURFACE TREATMENT APPARATUS

TECHNICAL FIELD

The present invention relates to surface treatment apparatuses for surface-treating small objects. Examples of small objects include small components such as a powdery work, a chip capacitor, a diode, a connector, a reed switch, a nail, a bolt, a nut, and a washer, each having a size of 0.5 to 5000 μm.

BACKGROUND ART

As surface treatment apparatuses for surface-treating small objects, apparatuses disclosed in Patent Documents 1 and 2, for example, are known. In each of these apparatuses, while a treatment cell containing small objects is rotated, a surface treatment liquid is injected into the treatment cell, thereby surface-treating the small objects.

[Patent Document 1] Japanese Unexamined Patent Application Publication No. 11-505295

[Patent Document 2] U.S. Pat. No. 5,879,520

DISCLOSURE OF THE INVENTION

Problems to be Solved by the Invention

Actually, in the above-mentioned conventional apparatuses, surface treatment liquids are scattered and/or leaked, thereby causing a problem that the inside and/or outside of each of the apparatuses are/is soiled.

Further, when small objects are surface-treated, normally, a first surface treatment is carried out, and a second surface treatment is then carried out by using a desired metal. In other words, two types of surface treatments are carried out. Furthermore, normally, surface treatment liquids, which have been used for two types of surface treatments, are each collected and reused. Accordingly, when two types of surface treatments are performed in a single surface treatment apparatus, respective surface treatment liquids are desired to be strictly separately collected so as not to be mixed with each other. Whereas, in the conventional single surface treatment apparatus, such collection has not necessarily been sufficiently performed.

An object of the present invention is to provide a surface treatment apparatus capable of preventing the inside and/or outside of the apparatus from being soiled, and another object of the present invention is to provide a surface treatment apparatus capable of achieving, as a main effect, strict separate collection and reuse of two types of surface treatment liquids in the single apparatus.

Solution to the Problems

A surface treatment apparatus according to a first aspect of the present invention serves as a surface treatment apparatus for carrying out a surface treatment on small objects while rotating a treatment cell containing the small objects, the surface treatment apparatus including: a treatment cell having liquid flow-out means for allowing a liquid to flow out from inside to outside, and capable of containing the small objects; a receiving tank surrounding the treatment cell from below; a cover body provided so as to cover the receiving tank from above, the cover body having an opening at its center; surface treatment liquid supply means for supplying a surface treatment liquid to the inside of the treatment cell; and cleaning water supply means for supplying cleaning water to the inside of the treatment cell, wherein when the surface treatment liquid supply means is operated while the treatment cell is rotated, the surface treatment liquid is supplied to the inside of the treatment cell, and the surface treatment liquid is allowed to flow out from the treatment cell through the liquid flow-out means, thereby carrying out a surface treatment on the small objects, wherein when the cleaning water supply means is operated while the treatment cell is rotated, the cleaning water is supplied to the inside of the treatment cell, and the cleaning water is allowed to flow out from the treatment cell through the liquid flow-out means, thereby cleaning the small objects, wherein the apparatus further includes first cleaning means for ejecting the cleaning water onto an inner face of the cover body and/or an outer face of the treatment cell, and wherein when the first cleaning means is operated while the treatment cell is rotated, the inner face of the cover body and/or the outer face of the treatment cell are/is cleaned.

A surface treatment apparatus according to a second aspect of the present invention serves as a surface treatment apparatus for carrying out a surface treatment on small objects while rotating a treatment cell containing the small objects, the surface treatment apparatus including: a treatment cell having liquid flow-out means for allowing a liquid to flow out from inside to outside, and capable of containing the small objects; a receiving tank surrounding the treatment cell from below; a cover body provided so as to cover the receiving tank from above, the cover body having an opening at its center; surface treatment liquid supply means for supplying a surface treatment liquid to the inside of the treatment cell; and cleaning water supply means for supplying cleaning water to the inside of the treatment cell, wherein when the surface treatment liquid supply means is operated while the treatment cell is rotated, the surface treatment liquid is supplied to the inside of the treatment cell, and the surface treatment liquid is allowed to flow out from the treatment cell through the liquid flow-out means, thereby carrying out a surface treatment on the small objects, wherein when the cleaning water supply means is operated while the treatment cell is rotated, the cleaning water is supplied to the inside of the treatment cell, and the cleaning water is allowed to flow out from the treatment cell through the liquid flow-out means, thereby cleaning the small objects, wherein the apparatus further includes opening/closing means for opening/closing the cover body relative to the receiving tank, and wherein the opening/closing means raises/lowers the cover body to a predetermined height from a position at which the cover body covers the receiving tank, with the cover body kept in a horizontal state, and further moves the cover body from the predetermined height so that the cover body gets away from the receiving tank.

A surface treatment apparatus according to a third aspect of the present invention serves as a surface treatment apparatus for carrying out a surface treatment on small objects while rotating a treatment cell containing the small objects, the surface treatment apparatus including: a treatment cell having liquid flow-out means for allowing a liquid to flow out from inside to outside, and capable of containing the small objects; a receiving tank surrounding the treatment cell from below; a cover body provided so as to cover the receiving tank from above, the cover body having an opening at its center; a tank for containing a surface treatment liquid; surface treatment liquid supply means for supplying the surface treatment liquid, contained in the tank, to the inside of the treatment cell; cleaning water supply means for supplying cleaning water to the inside of the treatment cell; and drain means for returning the surface treatment liquid, received by the receiving tank, to the tank containing the surface treatment liquid, and for flowing the cleaning water, received by the receiving tank, to a discharge portion, wherein when the surface treatment liquid supply means is operated while the treatment cell is rotated, the surface treatment liquid is supplied to the inside of the treatment cell, and the surface treatment liquid is allowed to flow out from the treatment cell through the liquid flow-out means, thereby carrying out a surface treatment on the small objects, wherein when the cleaning water supply means is operated while the treatment cell is rotated, the cleaning water is supplied to the inside of the treatment cell, and the cleaning water is allowed to flow out from the treatment cell through the liquid flow-out means, thereby cleaning the small objects, wherein the drain means includes: a discharge member communicated with a discharge port of the receiving tank; a connecting pipe provided so as to be connected to an end portion of the discharge member or to each of inlets of the tank and the discharge portion in a manner movable up and down; a raising and lowering portion for moving up and down the connecting pipe; and moving means for moving the end portion of the discharge member, and wherein the end portion of the discharge member is moved so as to be located above a selected one of the inlets of the tank and the discharge portion, and the connecting pipe is raised or lowered, thereby connecting the discharge member with the inlet via the connecting pipe.

A surface treatment apparatus according to a fourth aspect of the present invention serves as a surface treatment apparatus for carrying out two types of surface treatments on small objects while rotating a treatment cell containing the small objects, the surface treatment apparatus including: a treatment cell having liquid flow-out means for allowing a liquid to flow out from inside to outside, and capable of containing the small objects; a receiving tank surrounding the treatment cell from below; a cover body provided so as to cover the receiving tank from above, the cover body having an opening at its center; two tanks for individually containing two types of surface treatment liquids; two surface treatment liquid supply means for individually supplying the surface treatment liquids, contained in the two tanks, to the inside of the treatment cell; cleaning water supply means for supplying cleaning water to the inside of the treatment cell; and drain means for returning the surface treatment liquid, received by the receiving tank, to the tank containing the surface treatment liquid, and for flowing the cleaning water, received by the receiving tank, to a discharge portion, wherein when the surface treatment liquid supply means is operated while the treatment cell is rotated, the surface treatment liquid is supplied to the inside of the treatment cell, and the surface treatment liquid is allowed to flow out from the treatment cell through the liquid flow-out means, thereby carrying out a surface treatment on the small objects, wherein when the cleaning water supply means is operated while the treatment cell is rotated, the cleaning water is supplied to the inside of the treatment cell, and the cleaning water is allowed to flow out from the treatment cell through the liquid flow-out means, thereby cleaning the small objects, wherein the apparatus further includes first cleaning means for ejecting the cleaning water onto an inner face of the cover body and/or an outer face of the treatment cell, wherein when the first cleaning means is operated while the treatment cell is rotated, the inner face of the cover body and/or the outer face of the treatment cell are/is cleaned, wherein the apparatus further includes opening/closing means for opening/closing the cover body relative to the receiving tank, wherein the opening/closing means raises/lowers the cover body to a predetermined height from a position at which the cover body covers the receiving tank, with the cover body kept in a horizontal state, and further moves the cover body from the predetermined height so that the cover body gets away from the receiving tank, wherein the drain means includes: a discharge member communicated with a discharge port of the receiving tank; a connecting pipe provided so as to be connected to an end portion of the discharge member or to each of inlets of the two tanks and the discharge portion in a manner movable up and down; a raising and lowering portion for moving up and down the connecting pipe; and moving means for moving the end portion of the discharge member, and wherein the end portion of the discharge member is moved so as to be located above a selected one of the inlets of the two tanks and the discharge portion, and the connecting pipe is raised or lowered, thereby connecting the discharge member with the inlet via the connecting pipe.

In the present invention, the following specific structures are preferably further adopted as appropriate.

(a) The first cleaning means includes a first ejection portion and/or a second ejection portion for ejecting cleaning water, wherein the first ejection portion includes an ejection port formed in a water supply passage provided along an edge of the opening of the cover body, and ejects the cleaning water onto the inner face of the cover body, and wherein the second ejection portion includes an ejection port formed in a water supply passage provided along the inner face of the cover body, and ejects the cleaning water onto the outer face of the treatment cell.

(b) The opening/closing means includes: an arm extending from the cover body; a rotary body provided at the other end side of the arm, and supported so as to be rotatable around a horizontal axis orthogonal to the arm; a horizontal support shaft for rotatably supporting the arm; support means for supporting the arm so as to prevent a portion of the arm adjacent to the cover body from going down with the horizontal support shaft serving as a supporting point; raising and lowering means for raising and lowering the horizontal support shaft together with the arm; and an abutment body against which the rotary body of the arm, raised to a predetermined height, abuts from below, wherein upon raising of the horizontal support shaft, the cover body is raised while being kept in a horizontal state until the rotary body abuts against the abutment body, and after the rotary body has abutted against the abutment body, the cover body is raised while being inclined along with the rotation of the arm around the horizontal support shaft.

(c) The apparatus includes second cleaning means for ejecting cleaning water onto an inner face of the discharge member.

In the present invention, the following specific structures may be further adopted as appropriate.

(I) The apparatus further includes an anode electrode, the anode electrode is provided so as to be inserted from above into the treatment cell fixed to a vertical rotation shaft, the treatment cell further includes a conductive ring provided along the inner face thereof, and electric current can be passed through the conductive ring from the vertical rotation shaft.

(II) In the foregoing structure (I), the anode electrode includes: an anode terminal; and an anode case for containing an anode metal for surface treatment, which is detachably attached to the anode terminal via screw.

(III) In the foregoing structure (II), the anode electrode is attached to the cover body, and when the receiving tank is covered by the cover body, the anode electrode is inserted from above into the treatment cell.

(IV) The surface treatment liquid supply means includes: a supply pipe for supplying the surface treatment liquid in the tank to the inside of the treatment cell via a filter; and a return pipe for supplying the surface treatment liquid in the tank to the inside of this tank via the filter; thus, during an operation period, the surface treatment liquid is supplied through the supply pipe and the return pipe, and during a non-operation period, the surface treatment liquid is supplied only through the return pipe.

(V) A chamber inside an apparatus main body, to which the treatment cell is attached, has a bottom face, and this bottom face is inclined so as to be lowered toward a discharge port formed at the bottom face.

(VI) A resin body, against which a lower end of a peripheral wall of the cover body abuts when the receiving tank is covered by the cover body, is provided along an inner face of a peripheral wall of the receiving tank.

(VII) A flange inclined inwardly downward is provided at the inner face of the lower end of the peripheral wall of the cover body.

(VIII) The vertical rotation shaft is separated from the receiving tank by an inner peripheral wall of the receiving tank.

(IX) In the foregoing structure (VIII), a receiving plate, which is connected to an upper end of the vertical rotation shaft and on which the treatment cell is placed, has at its lower face a peripheral wall surrounding an upper end portion of the inner peripheral wall of the receiving tank.

Effects of the Invention

According to the first to fourth aspects of the present invention, the following effects can be achieved.

(1) The surface treatment liquid(s) can be supplied to the inside of the treatment cell by operating the surface treatment liquid supply means while rotating the treatment cell containing small objects by the vertical rotation shaft. Thus, a surface treatment can be carried out on the small objects.

(2) Since the surface treatment apparatus includes the cover body, the surface treatment liquid(s) can be prevented from scattering to outside during treatment.

Further, according to the first to fourth aspects of the present invention, the inner face of the cover body and/or the outer face of the treatment cell can be cleaned by operating the first cleaning means. In other words, the surface treatment liquid(s), scattered on the inner face of the cover body and/or the outer face of the treatment cell, can be washed off. Accordingly, the separate collection of the surface treatment liquids described above can be more effectively carried out.

Furthermore, according to the second and fourth aspects of the present invention, the cover body can be automatically opened/closed by operating the opening/closing means. In addition, the cover body can be lowered from slightly above the receiving tank while being kept in a horizontal state, thereby covering the receiving tank by the cover body; thus, the peripheral wall of the cover body can be relatively deeply inserted into the receiving tank, and accordingly, the receiving tank can be favorably covered by the cover body.

Moreover, according to the third and fourth aspects of the present invention, the following effects can be achieved.

(1) The surface treatment(s) can be performed by using the surface treatment liquid(s) in the tank(s) by operating the surface treatment liquid supply means, and the used surface treatment liquid(s) can be returned to the tank(s) by operating the drain means. Thus, the surface treatment liquid(s) can be reused.

(2) The inside of the treatment cell can be cleaned by operating the cleaning water supply means, and the cleaning water can be discharged from the discharge portion while the surface treatment liquid(s) can be contained in the tank(s) by operating the drain means.

(3) By operating the drain means, the cleaning water can be automatically discharged from the discharge portion and the surface treatment liquid(s) can be automatically collected in the tank(s).

(4) Since the connecting pipe is raised or lowered to connect the discharge member with the inlets of the tank and the discharge portion, a liquid passage is ensured without interruption; accordingly, the surface treatment liquid(s) and cleaning water can be prevented from being leaked to outside with certainty.

Besides, according to the fourth aspect of the present invention, the inside of the treatment cell can be cleaned by operating the cleaning water supply means, and two types of surface treatment liquids can be contained in the respective original tanks by operating the drain means. Accordingly, after one surface treatment liquid has been used and contained in one tank, cleaning is performed, and then another surface treatment liquid can be used and contained in another tank. Consequently, the respective surface treatment liquids can be collected strictly separately so as not to mix the surface treatment liquids with each other.

In the foregoing structure (a), the inner face of the cover body and the outer face of the treatment cell can be cleaned with certainty.

In the foregoing structure (b), the cover body can be opened/closed automatically. In addition, the cover body can be lifted to a position at which the cover body does not interfere with operation(s) for attaching/detaching the treatment cell.

In the foregoing structure (c), the inner face of the discharge member can be cleaned. Accordingly, for example, after one surface treatment liquid has been used and collected in one tank via the discharge member, the cleaning of the inner face of the discharge member is performed by the second cleaning means, and then another surface treatment liquid can be used and collected in another tank via the discharge member. Consequently, the respective surface treatment liquids can be collected strictly separately so as not to mix the surface treatment liquids with each other in the discharge member in particular.

In the foregoing structure (I), electric current is passed between the anode electrode and the conductive ring of the treatment cell, thereby making it possible to perform, as a surface treatment, an electrolytic treatment such as an electroplating treatment, for example.

In the foregoing structure (II), the maintenance of the anode electrode can be easily carried out.

In the foregoing structure (III), the attachment/detachment of the anode electrode can be performed simultaneously with the opening/closing of the cover body, and therefore, the operating efficiency can be improved. In addition, since the support means for supporting only the anode electrode can be eliminated, the structure of the apparatus can be simplified.

In the foregoing structure (IV), the surface treatment liquid in the tank can be returned to the inside of the tank through the filter during not only an operation period but also a non-operation period of the surface treatment liquid supply means, and therefore, the surface treatment liquid in the tank can be constantly cleaned. Accordingly, the clean surface treatment liquid can be reused.

In the foregoing structure (V), the surface treatment liquid and/or cleaning water, dripped down on the bottom face, will flow toward the discharge port in the chamber inside the apparatus main body, to which the treatment cell is attached. Accordingly, the cleaning of the bottom face can be carried out with ease.

In the foregoing structure (VI) or (VII), the surface treatment liquid and/or cleaning water can be prevented from being leaked to the outside of the receiving tank.

In the foregoing structure (VIII), the surface treatment liquid and/or cleaning water can be prevented from being leaked toward the vertical rotation shaft.

In the foregoing structure (IX), the leakage of the surface treatment liquid and/or cleaning water toward the vertical rotation shaft through a gap between the receiving plate and inner peripheral wall can be prevented, and the effects resulting from the foregoing structure (VIII) can be consequently achieved with more certainty.

DESCRIPTION OF THE REFERENCE CHARACTERS

Figure 1:
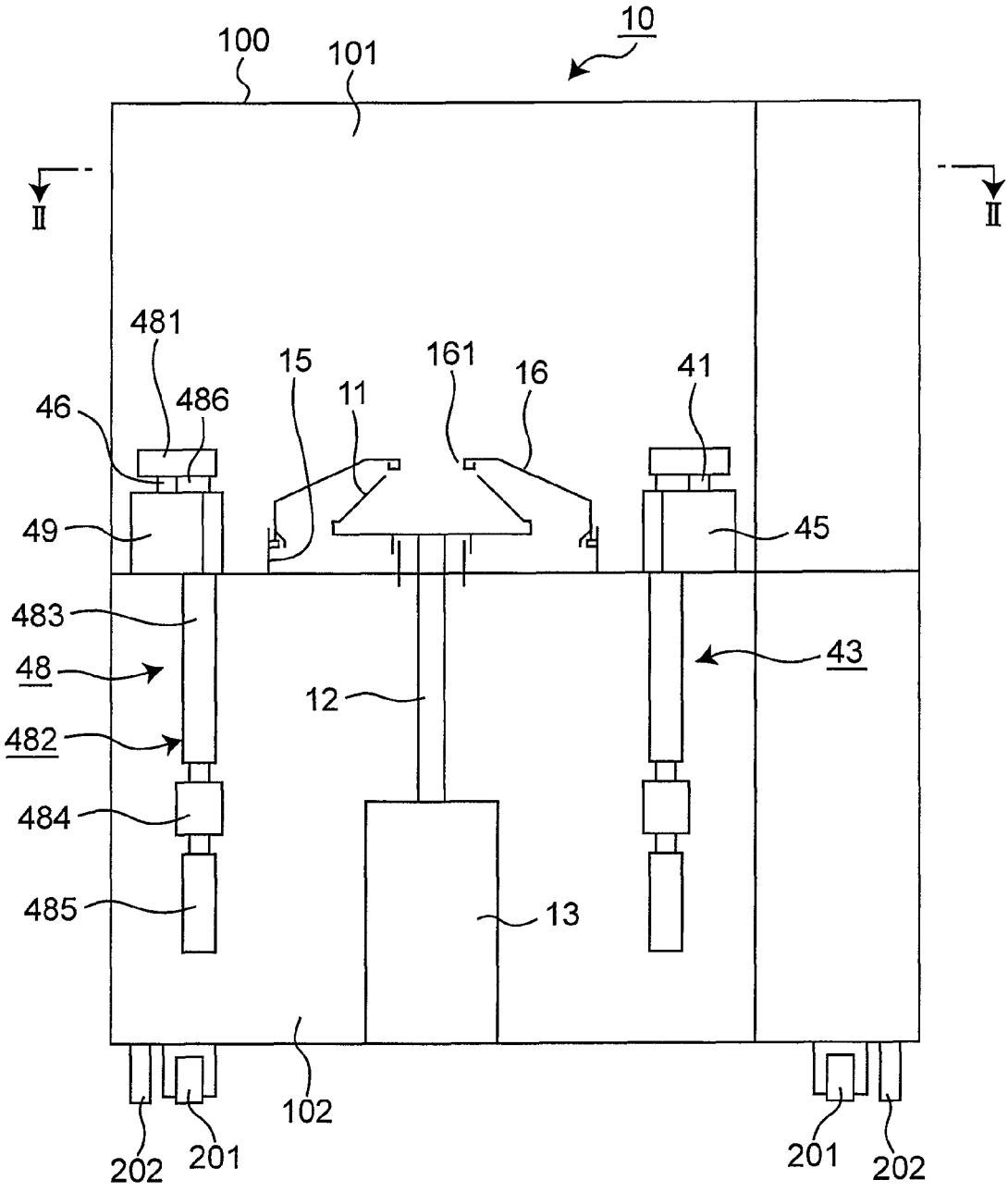
FIG. 1 is a front cross-sectional view of a surface treatment apparatus according to a first embodiment.

10 rotary surface treatment apparatus
11 treatment cell
112 electrode ring (conductive ring)
12 vertical rotation shaft
143 peripheral wall
15 receiving tank
154 resin body
155 inner peripheral wall
16 cover body
165 flange
21 first tank
22 first surface treatment liquid supply means
24 second tank
25 second surface treatment liquid supply means
27 third tank
211, 241, 271 inlet
221, 251 filter
222, 252 first supply pipe
223, 253 return pipe
224, 254 second supply pipe
3 drain means
33 connecting pipe
41 first anode electrode
411 first anode terminal
412 anode case
5 first cleaning means
51 slit (ejection port)
52 ejection port
53, 54 water supply passage
7 opening/closing means
71 arm
72 roller (rotary body)
73 horizontal support shaft
74 support body
75 raising and lowering means
76 abutment body
8 second cleaning means

BEST MODE FOR CARRYING OUT THE INVENTION

First Embodiment

Figure 2:
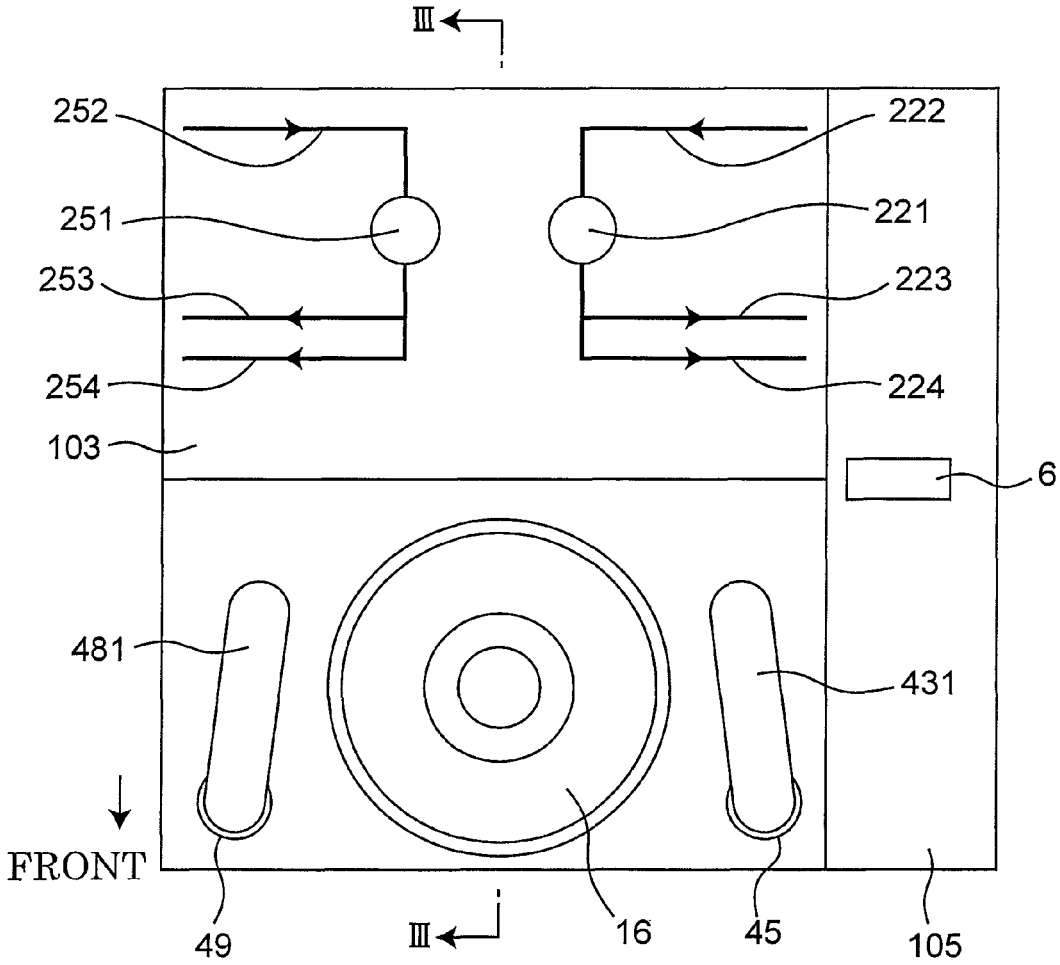
FIG. 2 is a cross-sectional view taken along the arrows II-II of FIG. 1.
Figure 3:
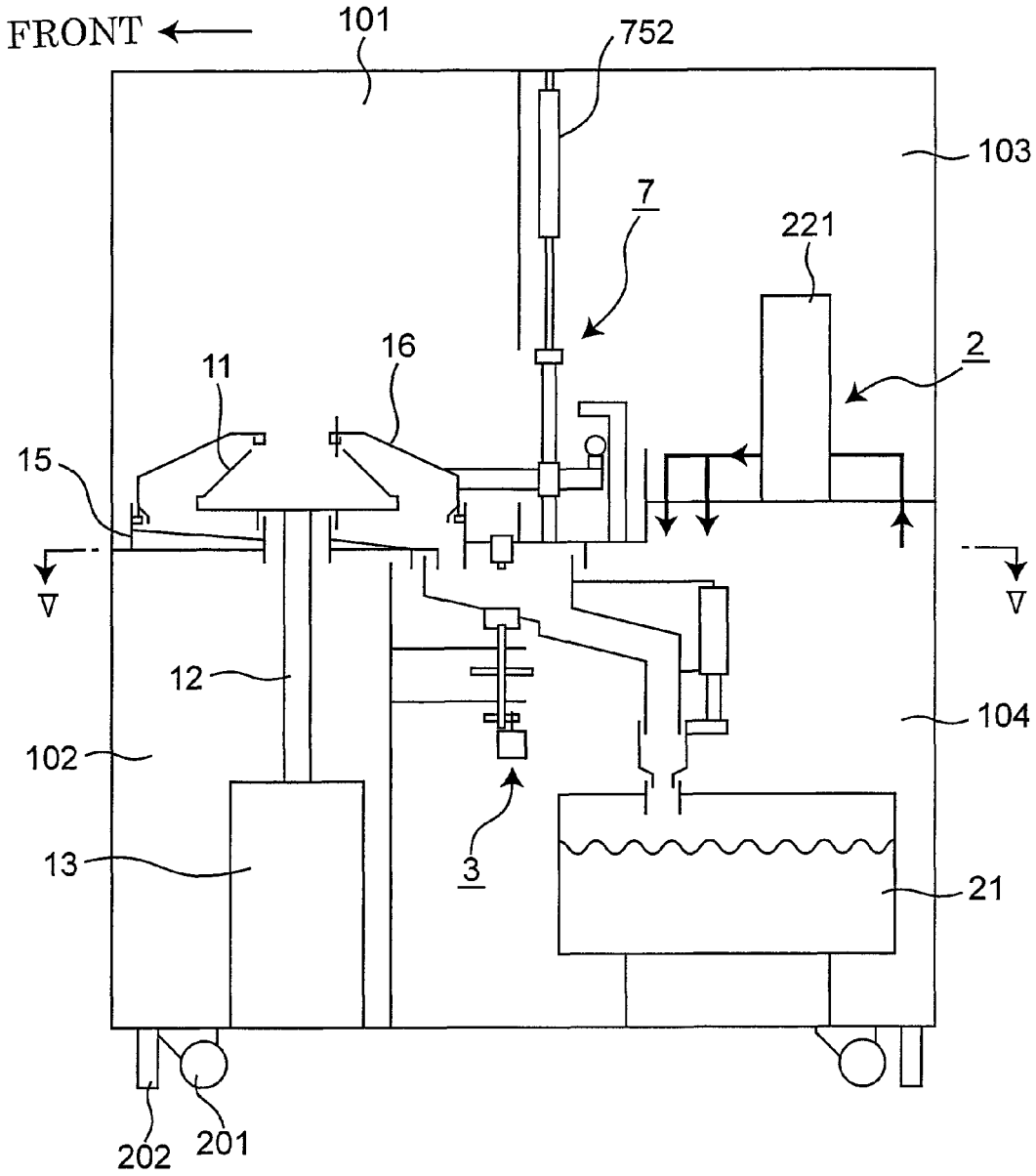
FIG. 3 is a cross-sectional view taken along the arrows III-III of FIG. 2.
Figure 4:
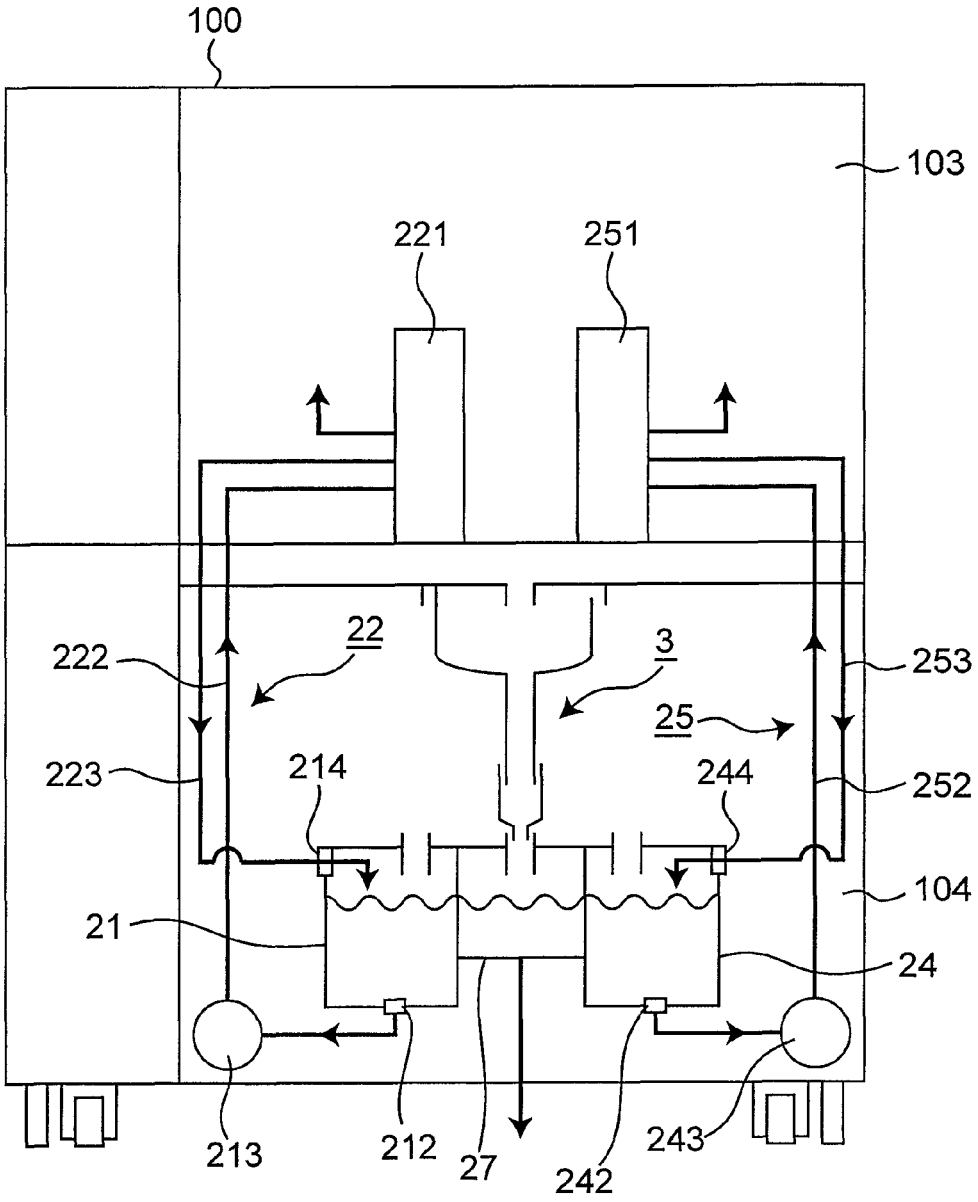
FIG. 4 is a rear perspective view of the apparatus shown in FIG. 1.
Figure 5:
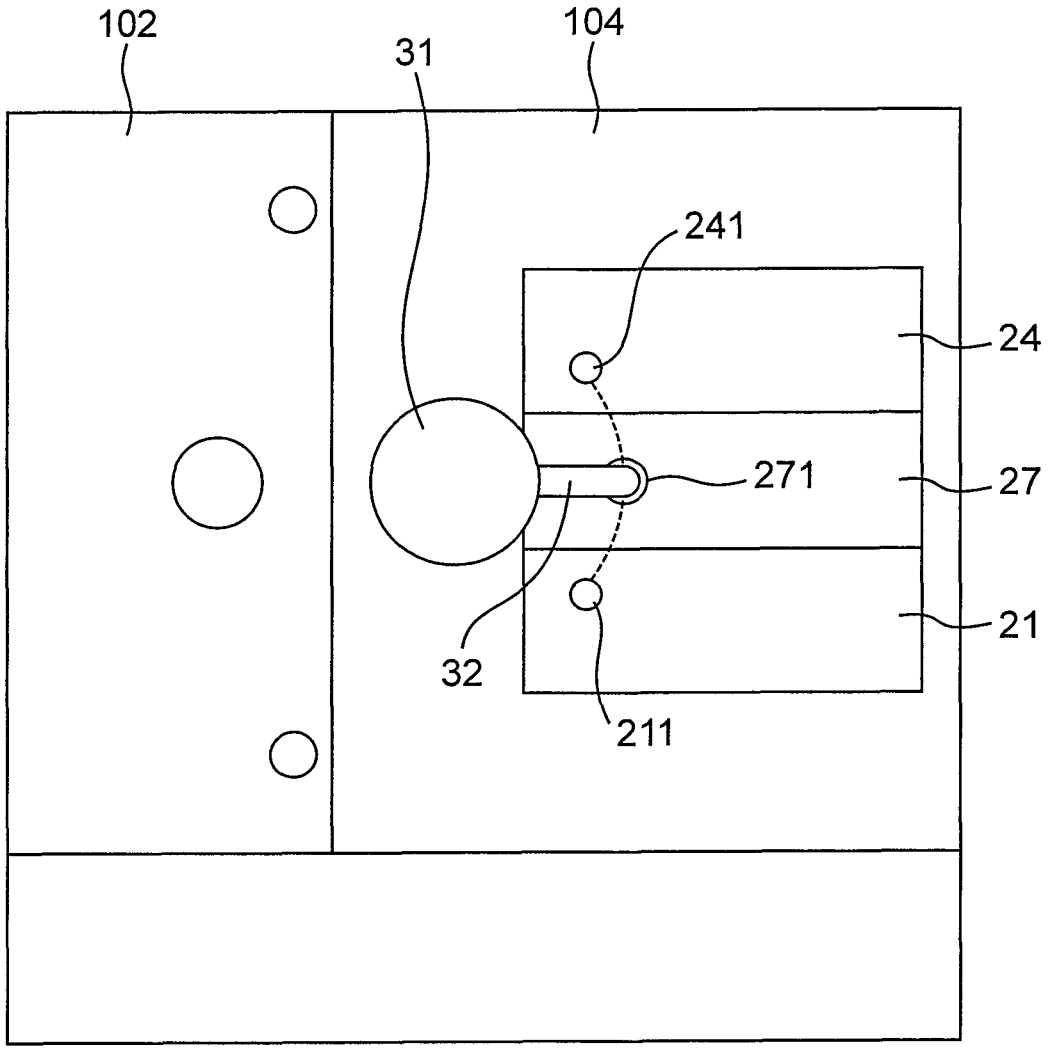
FIG. 5 is a cross-sectional view taken along the arrows V-V of FIG. 3.

The present embodiment relates to a so-called "two-liquid type" surface treatment apparatus for carrying out two types of surface treatments in the single apparatus. FIG. 1 is a front cross-sectional view of a surface treatment apparatus 10 according to the present embodiment, FIG. 2 is a cross-sectional view taken along the arrows II-II of FIG. 1, FIG. 3 is a cross-sectional view taken along the arrows III-III of FIG. 2, FIG. 4 is a rear perspective view of the apparatus 10 of FIG. 1, and FIG. 5 is a cross-sectional view taken along the arrows V-V of FIG. 3. The present embodiment is implemented by installing all components within a single apparatus main body 100. The apparatus main body 100 can be moved, via rollers 201 provided at its bottom face, on a floor surface, and can be fixed onto the floor surface by stoppers 202 provided at the bottom face.

As shown in FIG. 1, an upper chamber 101 at a front part of the apparatus main body 100 is provided with: a treatment cell 11; a receiving tank 15; a cover body 16; a first anode electrode 41 and a part of a first support means 43 for supporting this electrode; a first retraction section 45; a second anode electrode 46 and a part of a second support means 48 for supporting this electrode; and a second retraction section 49.

As shown in FIG. 1, a lower chamber 102 at the front part of the apparatus main body 100 is provided at its center with: a vertical rotation shaft 12; and a motor 13 for driving the vertical rotation shaft 12, and is further provided at its both sides with: a remaining part of the first support means 43; and a remaining part of the second support means 48.

As shown in FIG. 2 and FIG. 3, an upper chamber 103 at a rear part of the apparatus main body 100 is provided at its front with an opening/closing means 7 for the cover body 16, and is provided at its rear with two filters 221 and 251, which are laterally aligned.

As shown in FIG. 3, FIG. 4 and FIG. 5, a lower chamber 104 at the rear part of the apparatus main body 100 is provided at its front with a drain means 3, and is provided at its rear with a first tank 21, a second tank 24 and a third tank 27, which are laterally aligned.

As shown in FIG. 2 and FIG. 4, the upper chamber 103 and lower chamber 104 at the rear part of the apparatus main body 100 is provided with: a first surface treatment liquid supply means 22; a second surface treatment liquid supply means 25; and a cleaning water supply means (not shown).

Moreover, as shown in FIG. 2, a lateral chamber 105 of the apparatus main body 100 is provided with a control section 6.

Figure 6:
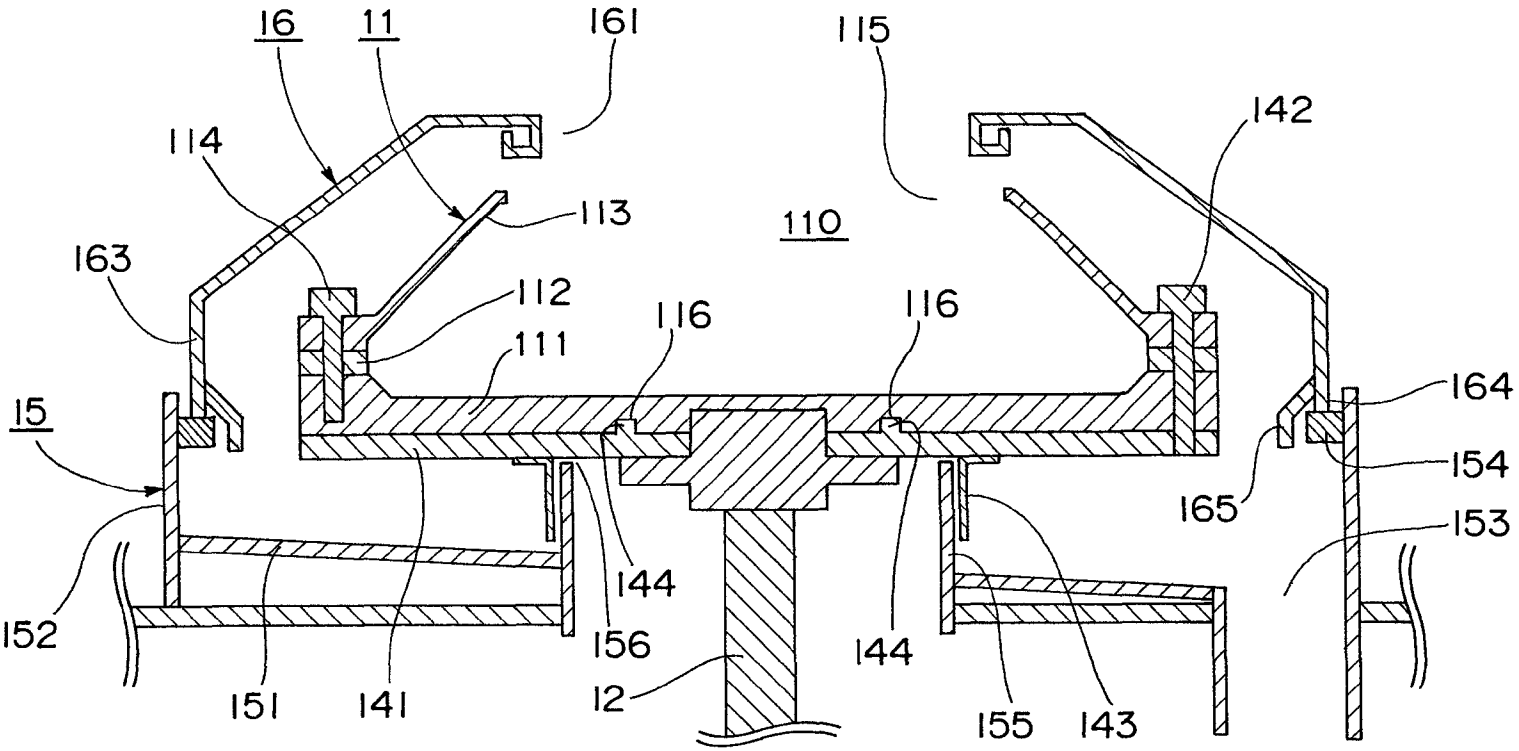
FIG. 6 is a partially enlarged view of FIG. 1.

FIG. 6 is a partially enlarged view of FIG. 1. As shown in FIG. 6, the treatment cell 11 is formed to include a non-conductive disc-like bottom plate 111, an electrode ring (conductive ring) 112 and a non-conductive hood 113, which are superposed and combined in by bolts 114. Further, the treatment cell 11 has, at its inside, a space 110 capable of containing small objects serving as objects to be surface-treated. The hood 113 has an opening 115 at its center. Furthermore, the treatment cell 11 has a liquid flow-out means (not shown) for allowing a liquid inside the treatment cell 11 to flow out little by little from the periphery thereof to the outside of the treatment cell 11.

As the liquid flow-out means, the following structure (a), (b) or the like can be adopted, for example.

(a) A porous ring having a large number of through holes communicated with inside and outside is provided between the bottom plate 111 and the electrode ring 112.

(b) A gap communicated with inside and outside is provided between the bottom plate 111 and the electrode ring 112.

Besides, as the above-mentioned structure (b), the following structures (b1), (b2) or the like can be adopted, for example.

(b1) A groove communicated with inside and outside is formed in the bottom plate 111.

(b2) Spacers are sandwiched between the bottom plate 111 and the electrode ring 112 circumferentially at appropriate intervals.

The treatment cell 11 is fixed to the vertical rotation shaft 12 via an attachment/detachment means. The attachment/detachment means has: a conductive disc-like receiving plate 141 fixed onto an upper end of the vertical rotation shaft 12; and bolts 142 for fixing the treatment cell 11 to the receiving plate 141. In other words, the treatment cell 11 is fixed to the vertical rotation shaft 12 by placing the cell on the receiving plate 141 and tightening with the bolts 142. Then, the passage of electric current through the electrode ring 112 of the treatment cell 11 is carried out from the vertical rotation shaft 12 via the receiving plate 141 and the bolts 142.

The receiving tank 15 is provided so as to cover, from below, the treatment cell 11 fixed to the vertical rotation shaft 12, and is formed by a bottom wall 151 and a peripheral wall 152. The bottom wall 151 is inclined so as to be lowered toward a single discharge port 153.

The cover body 16 is provided so as to cover, from above, the receiving tank 15, and is opened/closed by the opening/closing means 7 (FIG. 3). The opening/closing means 7 will be described later. The cover body 16 has an opening 161 at its center.

Moreover, an upper part of an inner face of the peripheral wall 152 of the receiving tank 15 is provided with a circumferentially continuously extending resin body 154. The resin body 154 is provided so that a lower end 164 of a peripheral wall 163 of the cover body 16 abuts against the resin body from above when the cover body 16 is closed. Further, an inner face of the lower end 164 of the peripheral wall 163 of the cover body 16 is provided with a flange 165 inclined inwardly downward. Furthermore, the vertical rotation shaft 12 is separated from the receiving tank 15 by an inner peripheral wall 155 of the receiving tank 15. In addition, the receiving plate 141 has, at its lower face, a peripheral wall 143 surrounding an upper end portion of the inner peripheral wall 155.

Figure 7:
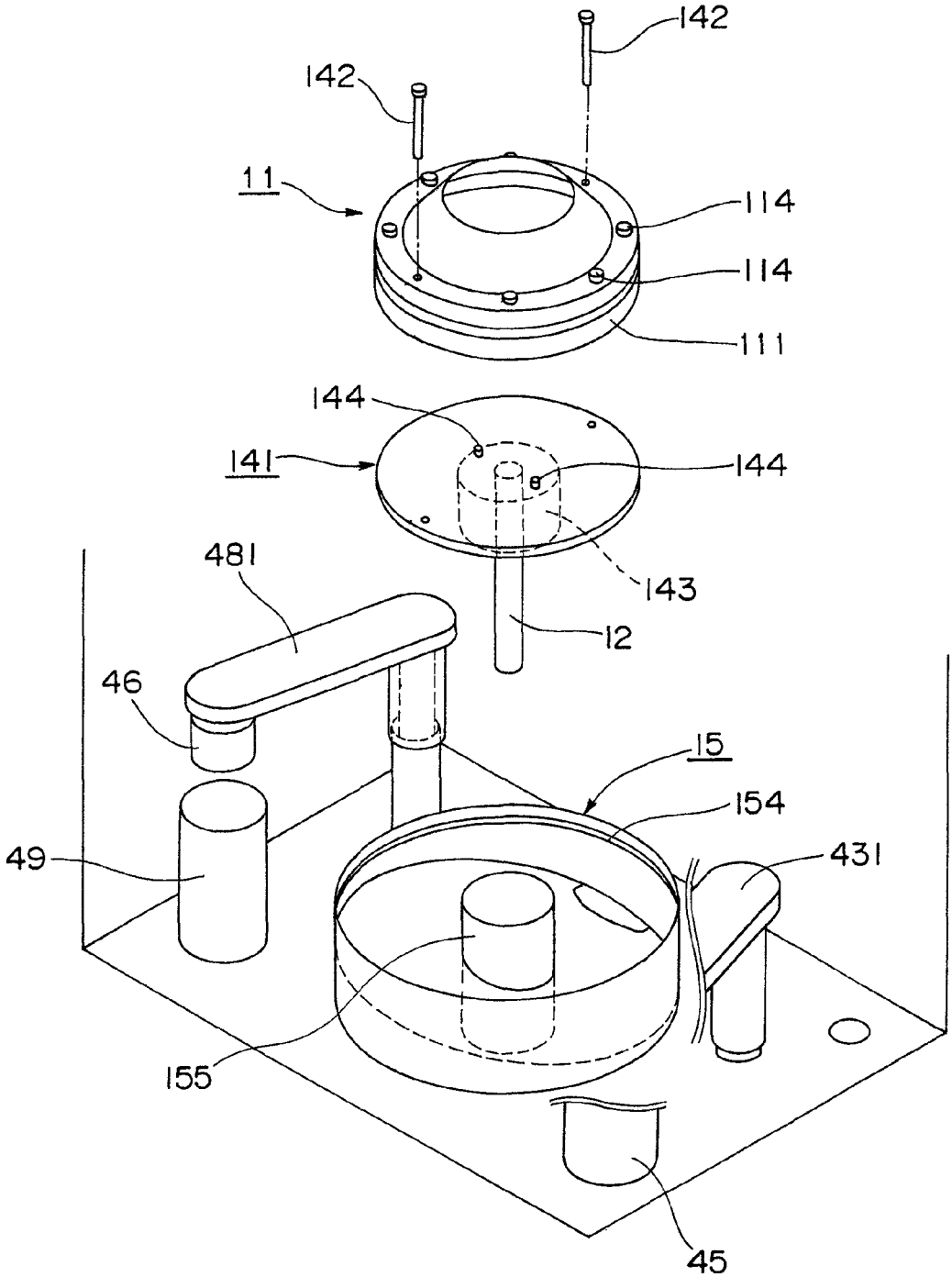
FIG. 7 is an exploded perspective view showing an attachment structure of a treatment cell.

Further, as shown in an exploded perspective view of FIG. 7, two concave portions 116 (FIG. 6) formed in the bottom plate 111 are fitted to two protrusions 144 formed at the receiving plate 141, thereby allowing the treatment cell 11 to be attached to the receiving plate 141 via the two bolts 142.

Figure 8:
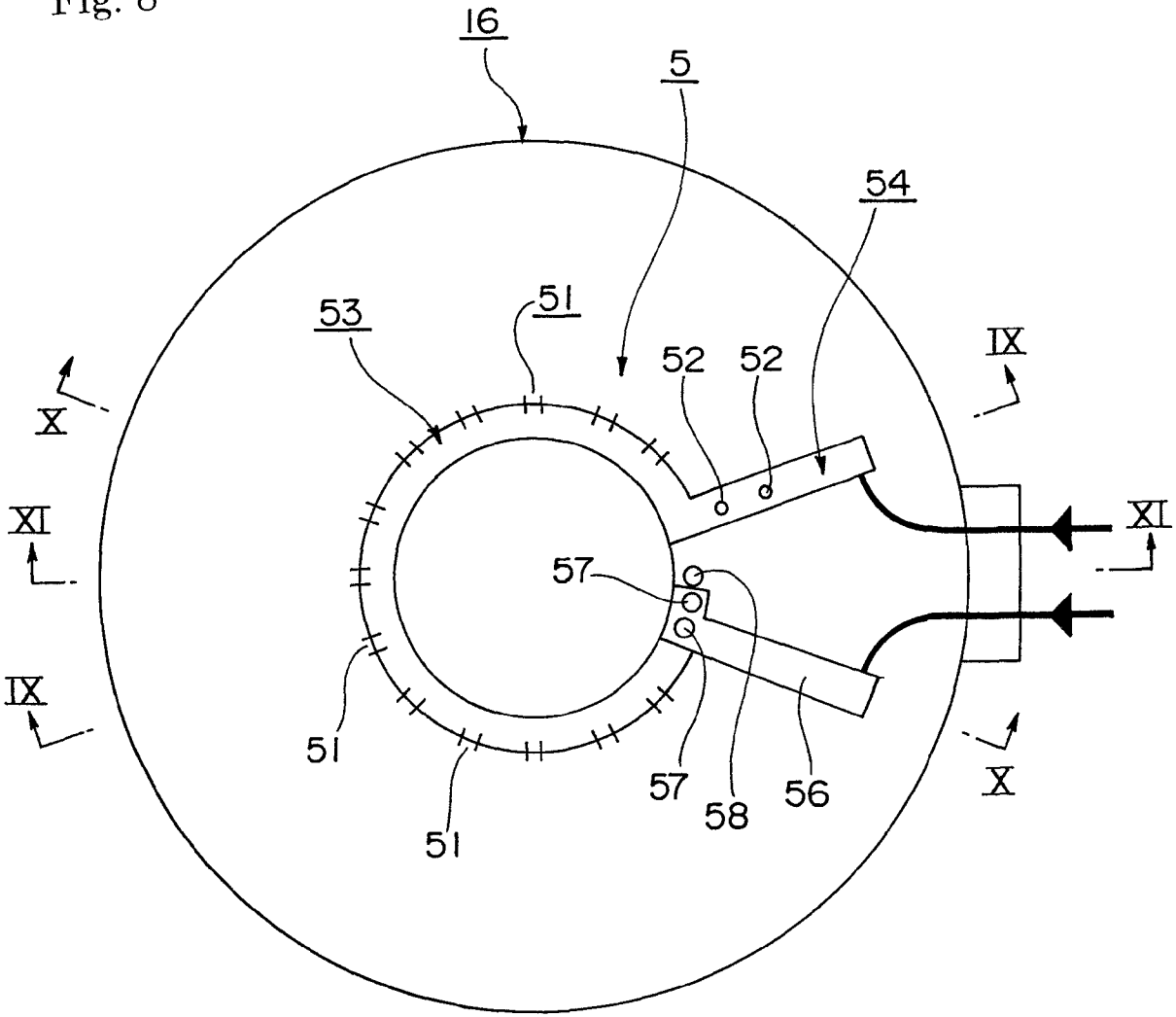
FIG. 8 is a plan view of a cover body in a state where it covers a receiving tank.
Figure 9:
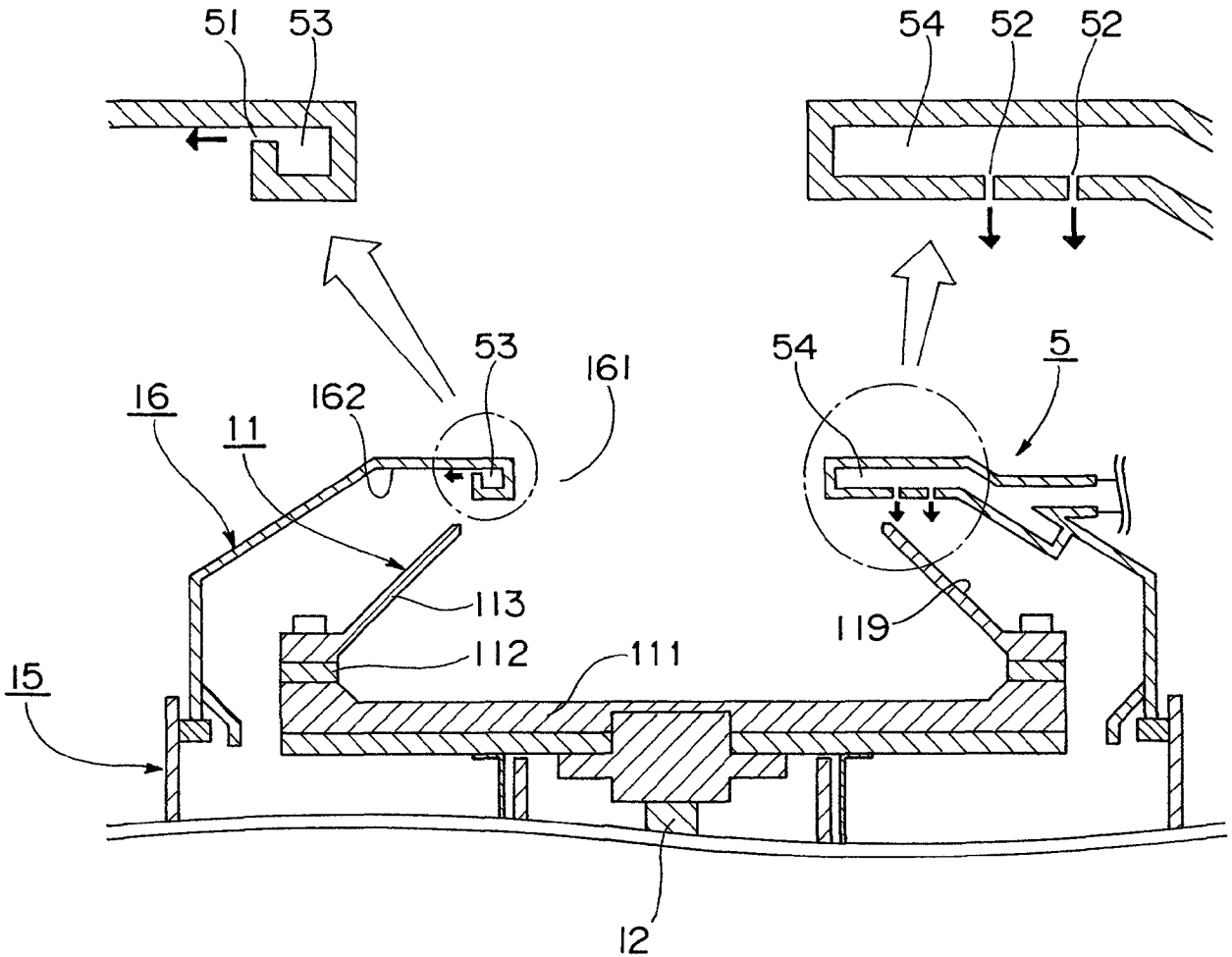
FIG. 9 is a cross-sectional view taken along the arrows IX-IX of FIG. 8.

FIG. 8 is a plan view of the cover body 16 in a state where it covers the receiving tank 15, and FIG. 9 is a cross-sectional view taken along the arrows IX-IX of FIG. 8. The cover body 16 includes a first cleaning means 5. The first cleaning means 5 has a first ejection portion and a second ejection portion for ejecting cleaning water. As shown in FIG. 8 and FIG. 9, the first ejection portion includes slits (ejection ports) 51 formed between a water supply passage 53, which is provided along an inner face 162 of the cover body 16 at an edge of the opening 161, and the inner face 162 of the cover body 16, and ejects cleaning water onto the inner face 162 of the cover body 16. Further, the second ejection portion includes a plurality of ejection ports 52 formed at a water supply passage 54 provided so as to be extended radially along the inner face 162 of the cover body 16, and ejects cleaning water onto an outer face 119 of the treatment cell 11. It should be noted that the water supply passage 53 is extended from the water supply passage 54, and the water supply passage 54 is connected to an external cleaning water supply source (e.g., a water supply) similarly to the cleaning water supply means described later.

Figure 10:
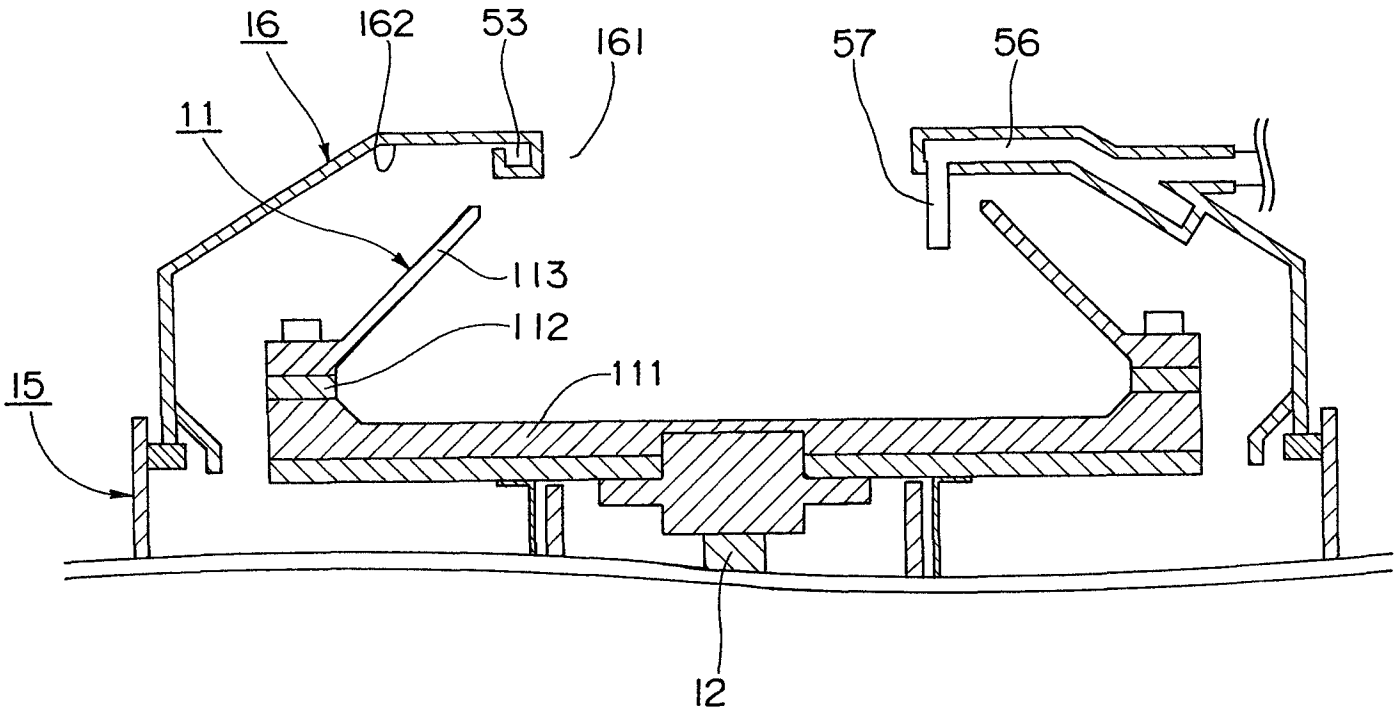
FIG. 10 is a cross-sectional view taken along the arrows X-X of FIG. 8.

Furthermore, as shown in FIG. 10 serving as a cross-sectional view taken along the arrows X-X of FIG. 8, at an end of a water supply passage 56 provided so as to be extended radially along the inner face 162 of the cover body 16, the cover body 16 has a nozzle 57 for supplying cleaning water to the inside of the treatment cell 11. It should be noted that the water supply passage 56 constitutes the cleaning water supply means described later.

Figure 11:
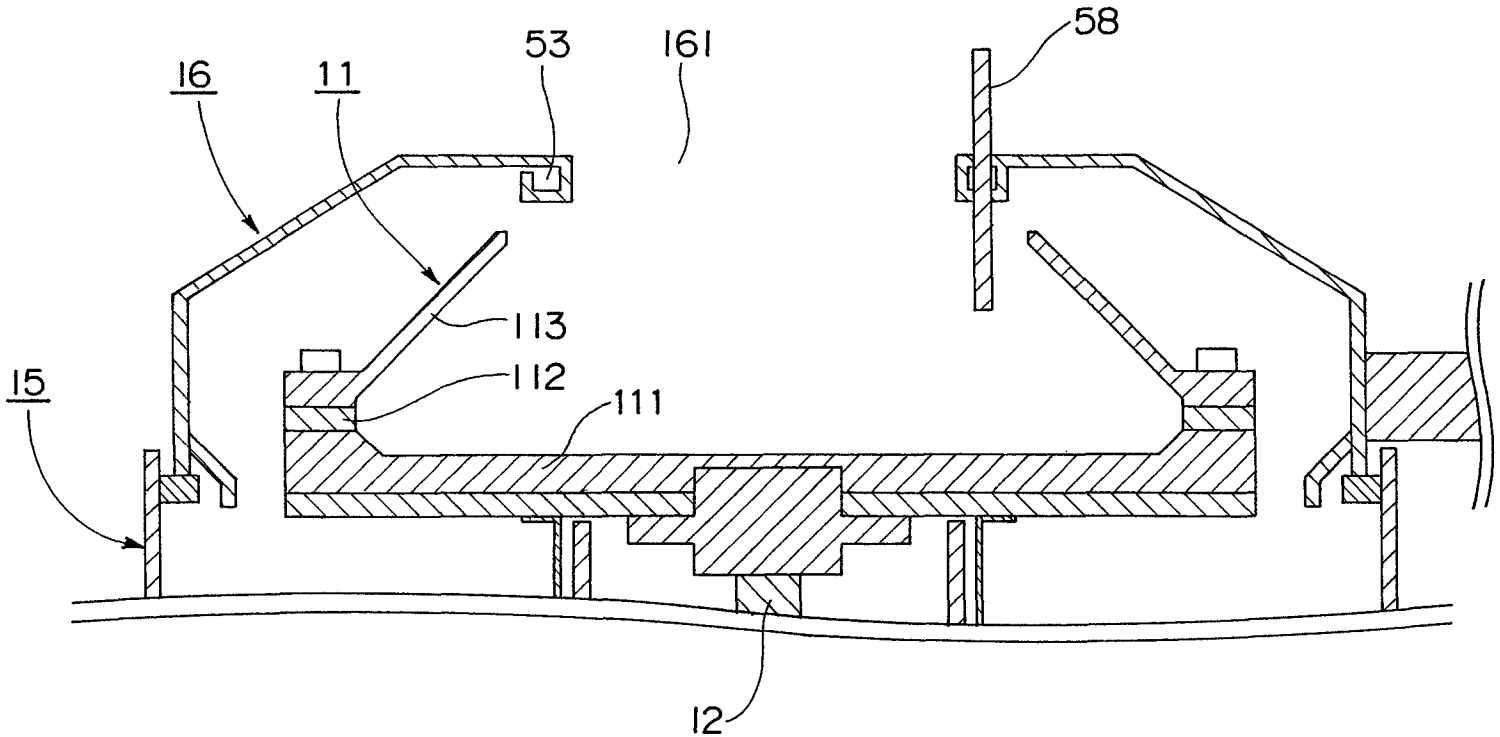
FIG. 11 is a cross-sectional view taken along the arrows XI-XI of FIG. 8.

Moreover, as shown in FIG. 11 serving as a cross-sectional view taken along the arrows XI-XI of FIG. 8, the cover body 16 has a level sensor 58 at an edge of the opening 161. The level sensor 58 detects a liquid level inside the treatment cell 11, thereby detecting excess or deficiency of a liquid amount.

Figure 12:
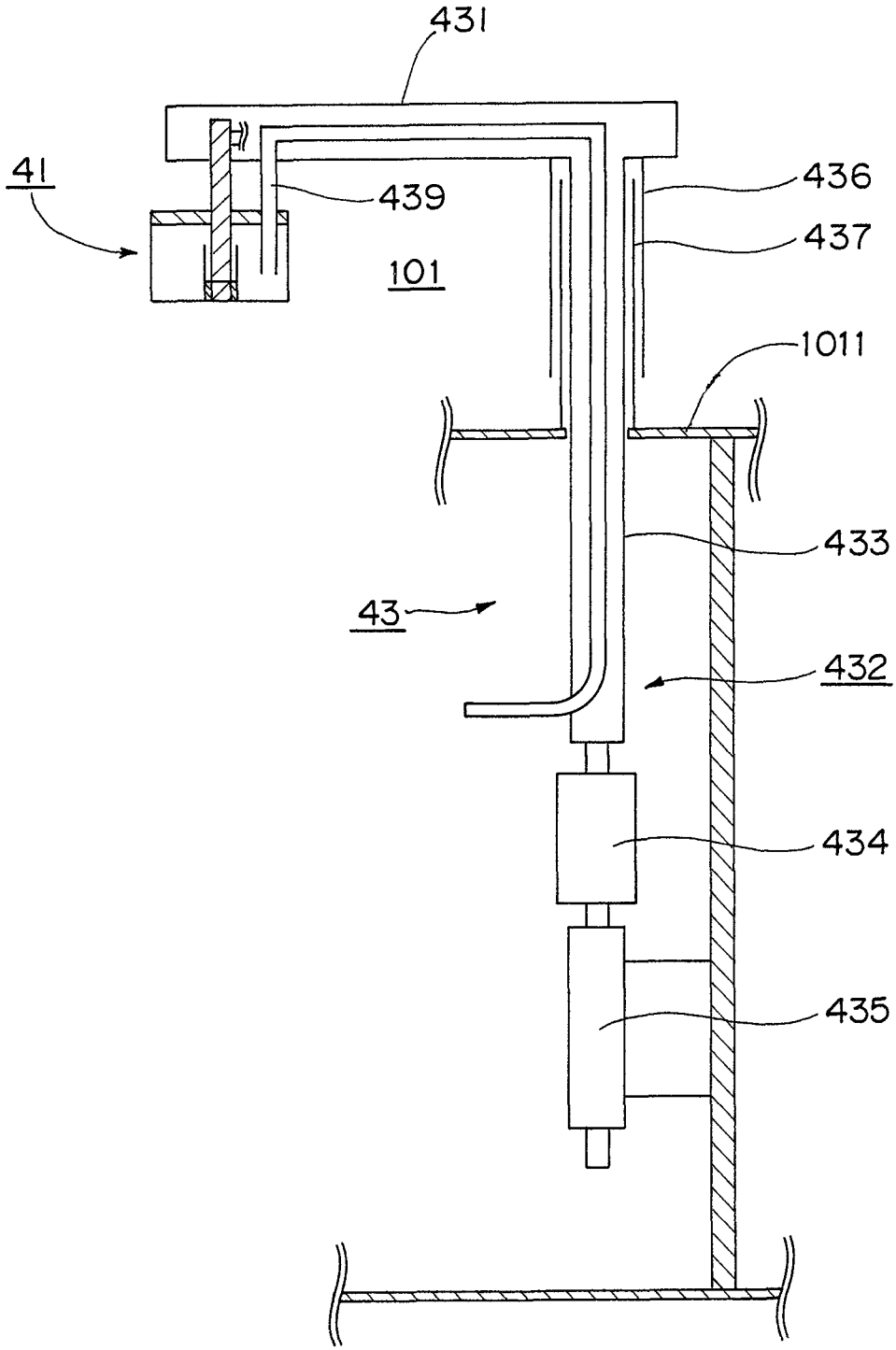
FIG. 12 is a partial cross-sectional view showing a first anode electrode and a first support means.
Figure 13:
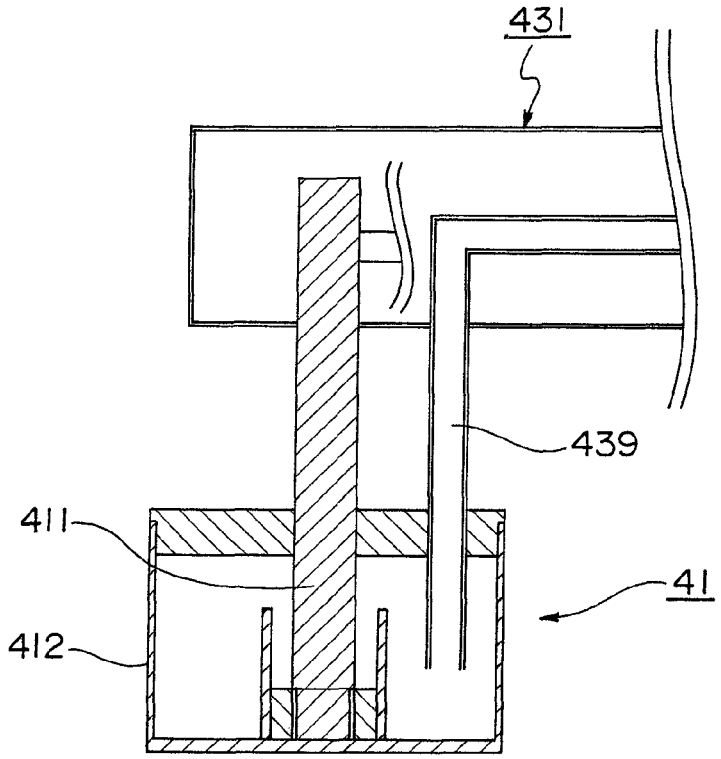
FIG. 13 is an enlarged cross-sectional view of the first anode electrode.
Figure 14:
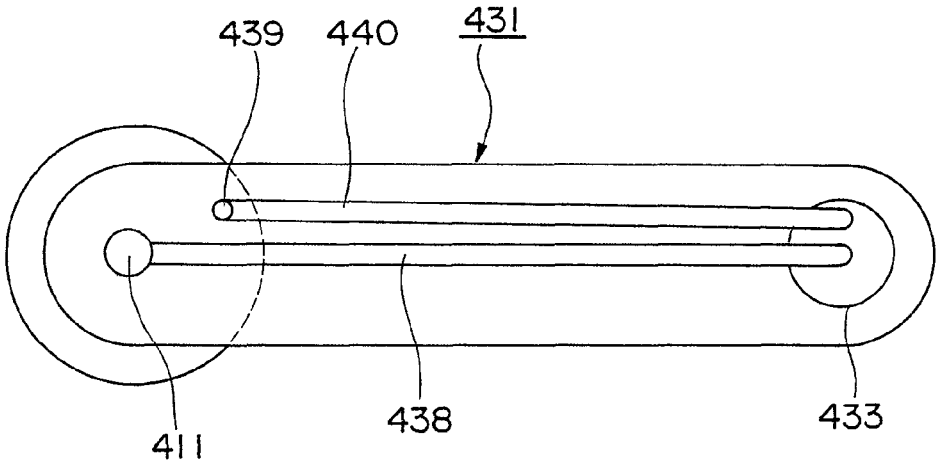
FIG. 14 is a plan perspective view of an arm.

FIG. 12 is a partial cross-sectional view showing the first anode electrode 41 and the first support means 43 for supporting this electrode. The first support means 43 has: a tubular arm 431 extending laterally; and a support body 432 for supporting the arm 431 at the other end thereof so that the arm 431 can be moved up and down, and so that the arm 431 can be rotated within a horizontal plane. The support body 432 has: a tube body 433 extending longitudinally; a rotation drive portion 434 for rotating the tube body 433 around a longitudinal axis; and a cylinder drive portion 435 for moving up and down the tube body 433 together with the rotation drive portion 434. The tube body 433 is communicated at its upper end with the arm 432 and is combined therewith. The tube body 433 is provided so as to be moved up and down within a sleeve 437 provided vertically at a bottom face 1011 of the upper chamber 101. Further, a portion of the tube body 433 moving up and down within the sleeve 437 has an outer tube 436, i.e., has a dual-tube structure. The rotation drive portion 434 is formed so as to rotate the tube body 433 by rack-and-pinion means. The rack is formed so as to be moved by an air pressure. As shown in FIG. 13, the arm 431 is provided at its end with a nozzle 439 for supplying a first surface treatment liquid to the inside of the treatment cell 11. FIG. 14 is a plan perspective view of the arm 431. As shown in FIG. 12 and FIG. 14, an electric wire 438 for passing electric current through the first anode electrode 41, and a supply passage 440 for supplying the first surface treatment liquid to the nozzle 439 are running through the inside of the tube body 433 and arm 431.

The second anode electrode 46 and the second support means 48 for supporting this electrode also has structures similar to those of the first anode electrode 41 and the first support means 43 for supporting this electrode. That is, as shown in FIG. 1, the second support means 48 has an arm 471 and a support body 472. The support body 472 has: a tube body 473 moving up and down within a sleeve 477 (FIG. 23); a rotation drive portion 474; and a cylinder drive portion 475. The tube body 473 has an outer tube 476. The arm 471 is provided at its end with a nozzle for supplying a second surface treatment liquid to the inside of the treatment cell 11. An electric wire for passing electric current through the second anode electrode 46, and a supply passage for supplying the second surface treatment liquid to the nozzle are running through the inside of the tube body 473 and arm 471.

Figure 15:
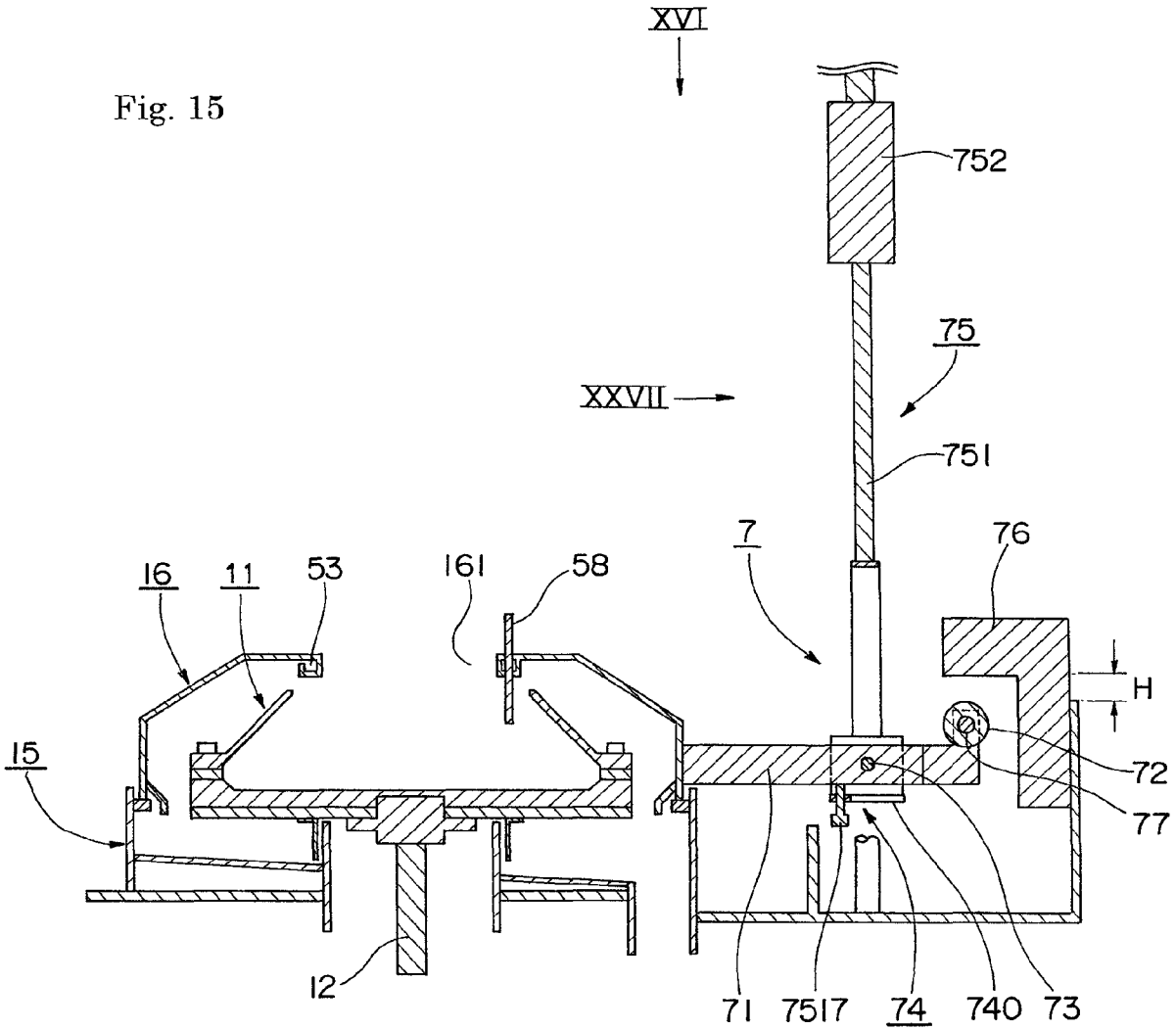
FIG. 15 is an enlarged partial view of FIG. 3, showing an opening/closing means for the cover body.
Figure 16:
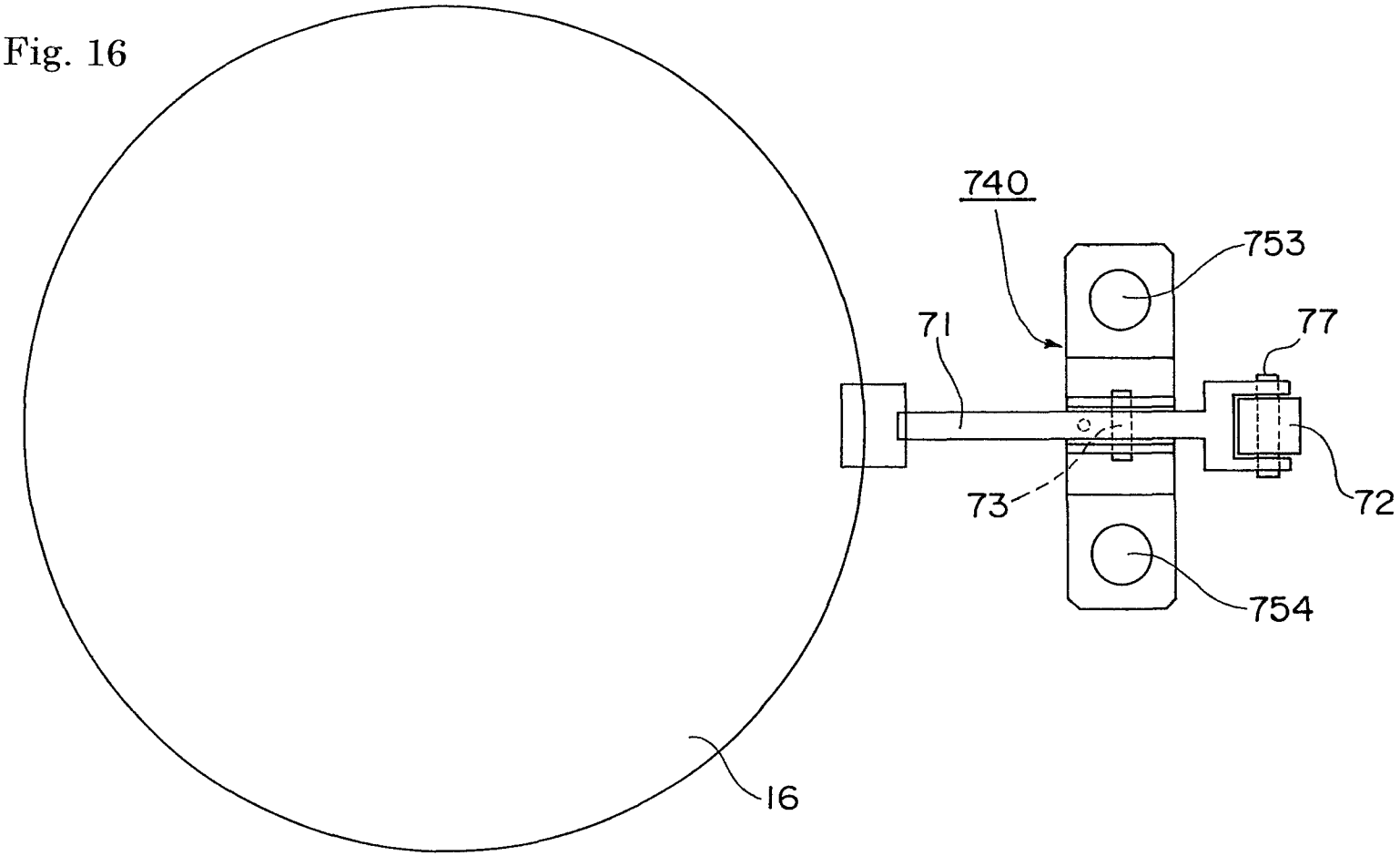
FIG. 16 is a diagram viewed from the arrow XVI of FIG. 15.
Figure 17:
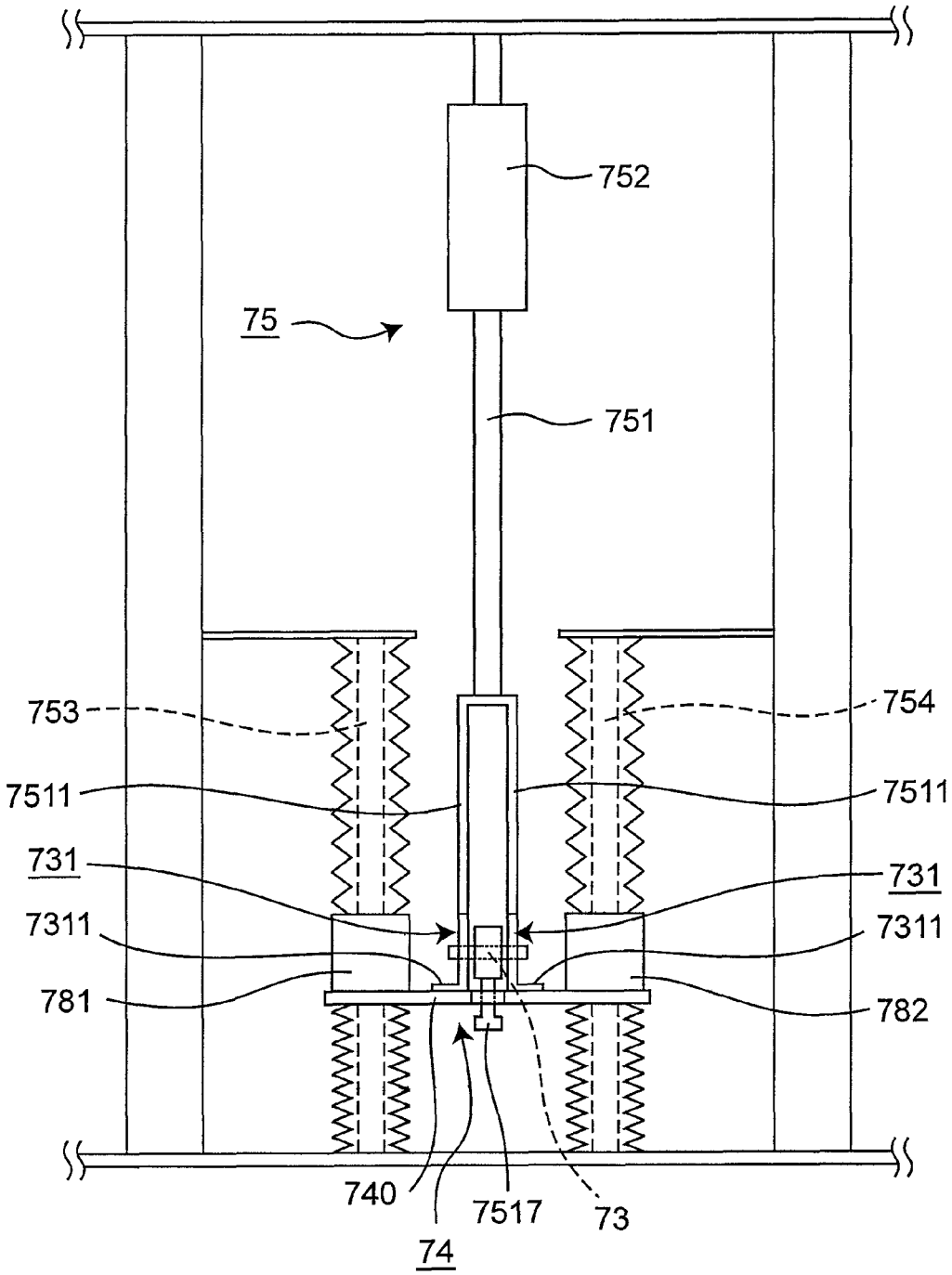
FIG. 17 is a diagram viewed from the arrow XVII of FIG. 15.

FIG. 15 is an enlarged partial view of FIG. 3, showing the opening/closing means 7 for the cover body 16. FIG. 16 is a diagram viewed from the arrow XVI of FIG. 15, and FIG. 17 is a diagram viewed from the arrow XVII of FIG. 15. The opening/closing means 7 has: an arm 71; a roller (rotary body) 72; a horizontal support shaft 73; a support means 74; a raising and lowering means 75; and an abutment body 76.

In FIG. 15, the arm 71 is connected at its one end to the cover body 16, and is extended laterally from the cover body 16. The roller 72 is provided at an upper portion of the other end of the arm 71. The roller 72 is rotatably supported by a horizontal shaft 77 orthogonal to the arm 71.

As shown in FIG. 17 in particular, the raising and lowering means 75 has: a vertical pole 751; a cylinder drive portion 752; and two vertical slide shafts 753 and 754 arranged in parallel. The cylinder drive portion 752 is located at an upper side of the pole 751. The pole 751 is located between the two slide shafts 753 and 754. By operating the cylinder drive portion 752, the raising and lowering means 75 raises/lowers the pole 751 along the two slide shafts 753 and 754 via a support body 740 described later.

Figure 18:
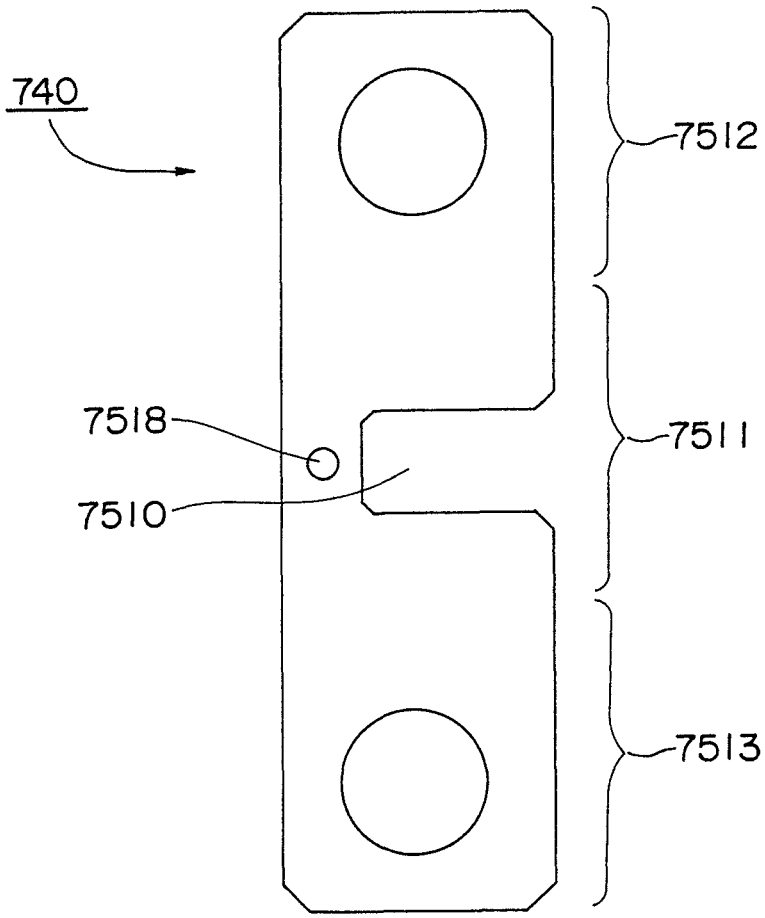
FIG. 18 is a plan view of a support body of the opening/closing means.

The horizontal support shaft 73 is orthogonal to the arm 71, and rotatably supports the arm 71 somewhere along the arm 71 while being rotatably supported at a lower end portion of the pole 751. The support means 74 includes the support body 740 and an adjustment bolt 7517. The support body 740 is located below the horizontal support shaft 73, and is fixed at a lower end of the pole 751. Specifically, the support body 740 has a form shown in FIG. 18, which is a plan view. More specifically, the support body 740 includes: a center portion 7511 at which the lower end of the pole 751 is fixed; and lateral portions 7512 and 7513 through which the two slide shafts 753 and 754 pass, respectively. At the center portion 7511, horizontal portions 7311 (FIG. 17) of L-shaped flanges 731 for supporting the horizontal support shaft 73 is fixed. Further, the center portion 7511 has, at its portion opposite to the cover 16, a cut-out portion 7510. Furthermore, the center portion 7511 has a bolt hole 7518 into which the adjustment bolt 7517 is fitted. The adjustment bolt 7517 can be fitted from a lower face side of the support body 740, thereby allowing an upper-face-side protrusion height to be freely set.

Upper portions and lower portions of the two slide shafts 753 and 754, with the support body 740 serving as the boundary therebetween, are covered by bellows. The abutment body 76 is provided above the other end of the arm 71. The abutment body 76 is formed so that the roller 72 of the arm 71, raised by a predetermined distance H while being in a horizontal state, abuts against the abutment body from below.

Figure 19:
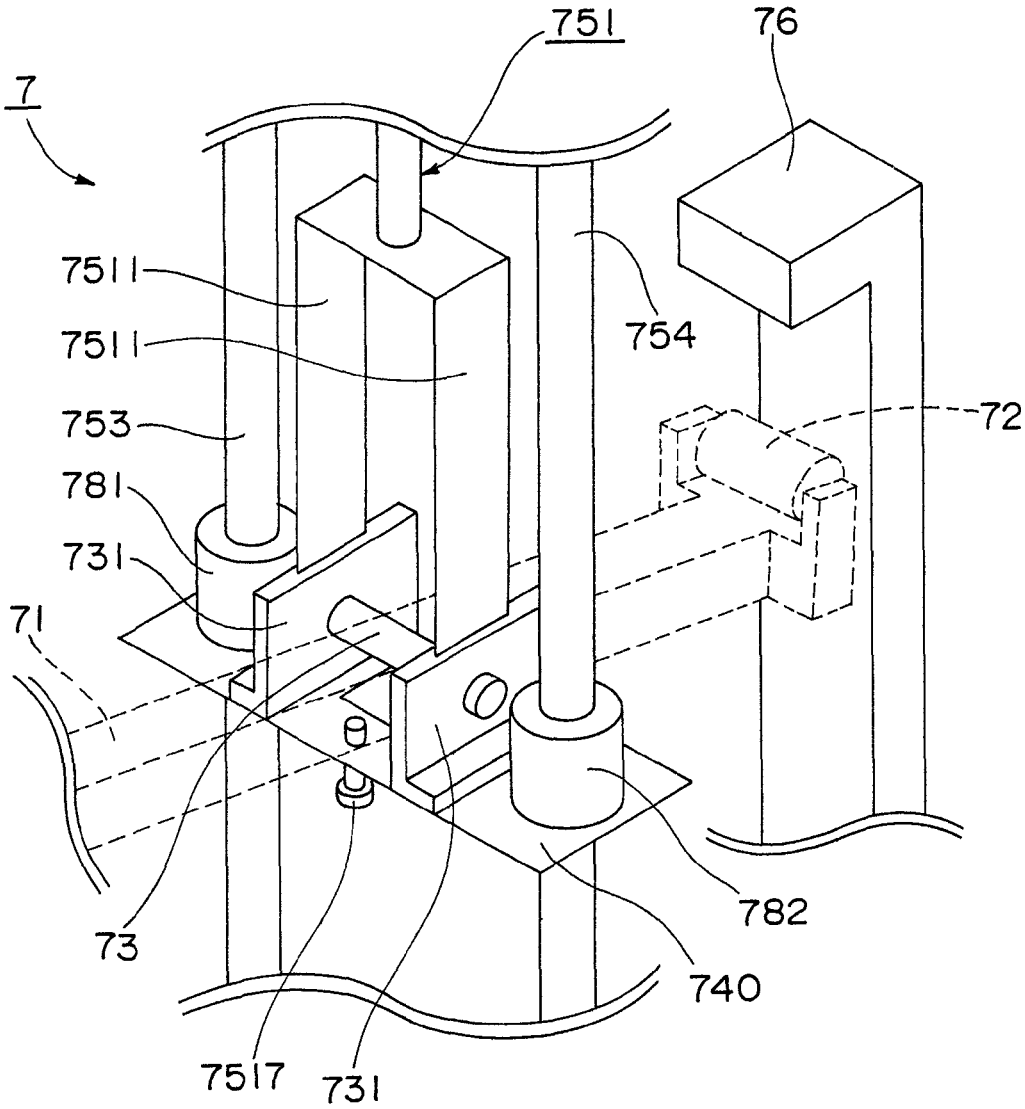
FIG. 19 is an enlarged perspective view of principal portions of the opening/closing means.

FIG. 19 is a partial perspective view of the opening/closing means 7. A lower end portion of the pole 751 branches off to two parallel pole portions 7511. The L-shaped flanges 731 are connected to lower ends of the pole portions 7511. Further, the arm 71 is running between the two pole portions 7511. At portions of the support body 740 through which the slide shafts 753 and 754 pass, there are provided guide cylinders 781 and 782 for preventing the support body 740 from wobbling relative to the slide shafts 753 and 754. The guide cylinders 781 and 782 are fixed to the support body 740.

Figure 20:
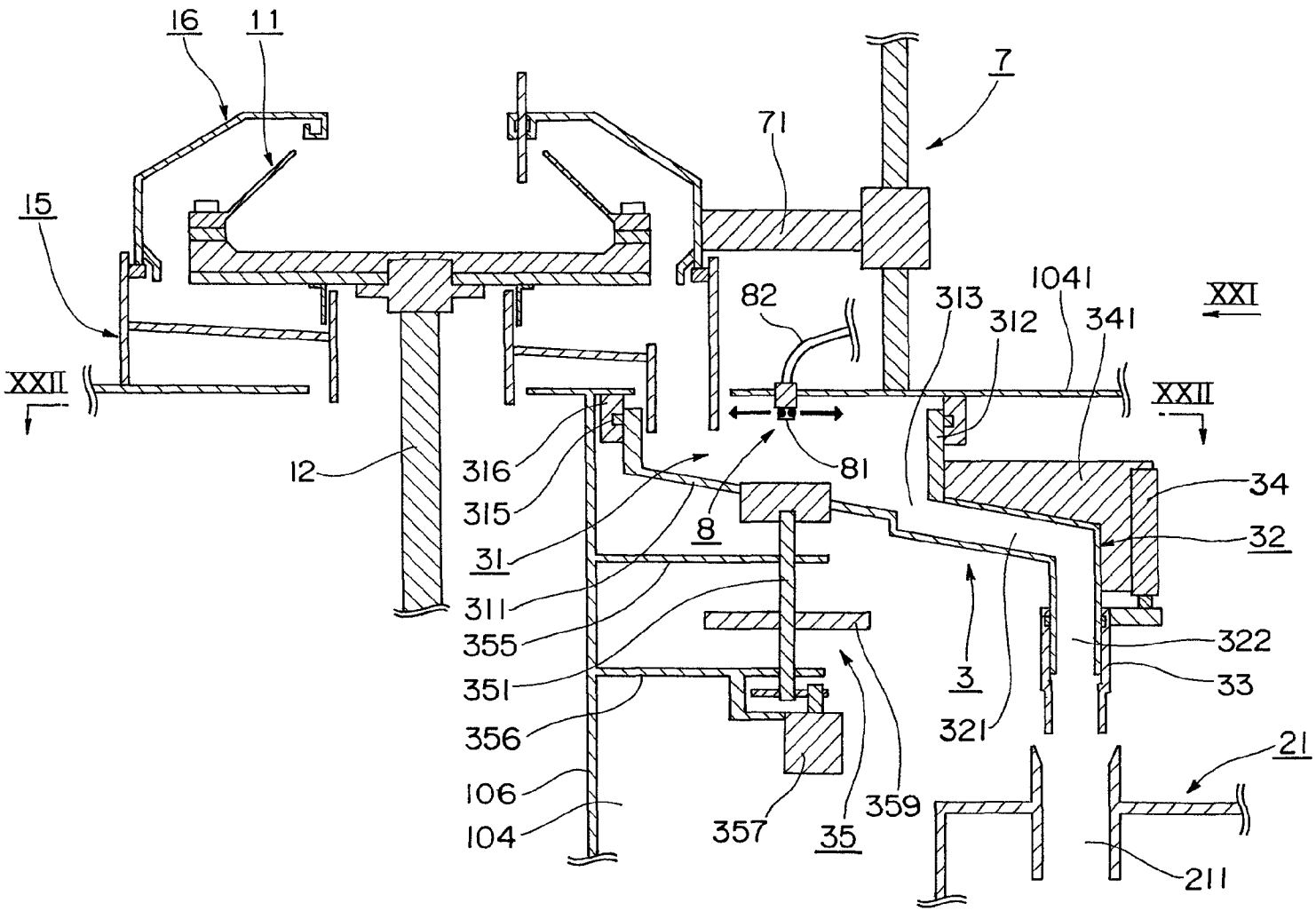
FIG. 20 is an enlarged partial view of FIG. 3, showing a drain means.
Figure 21:
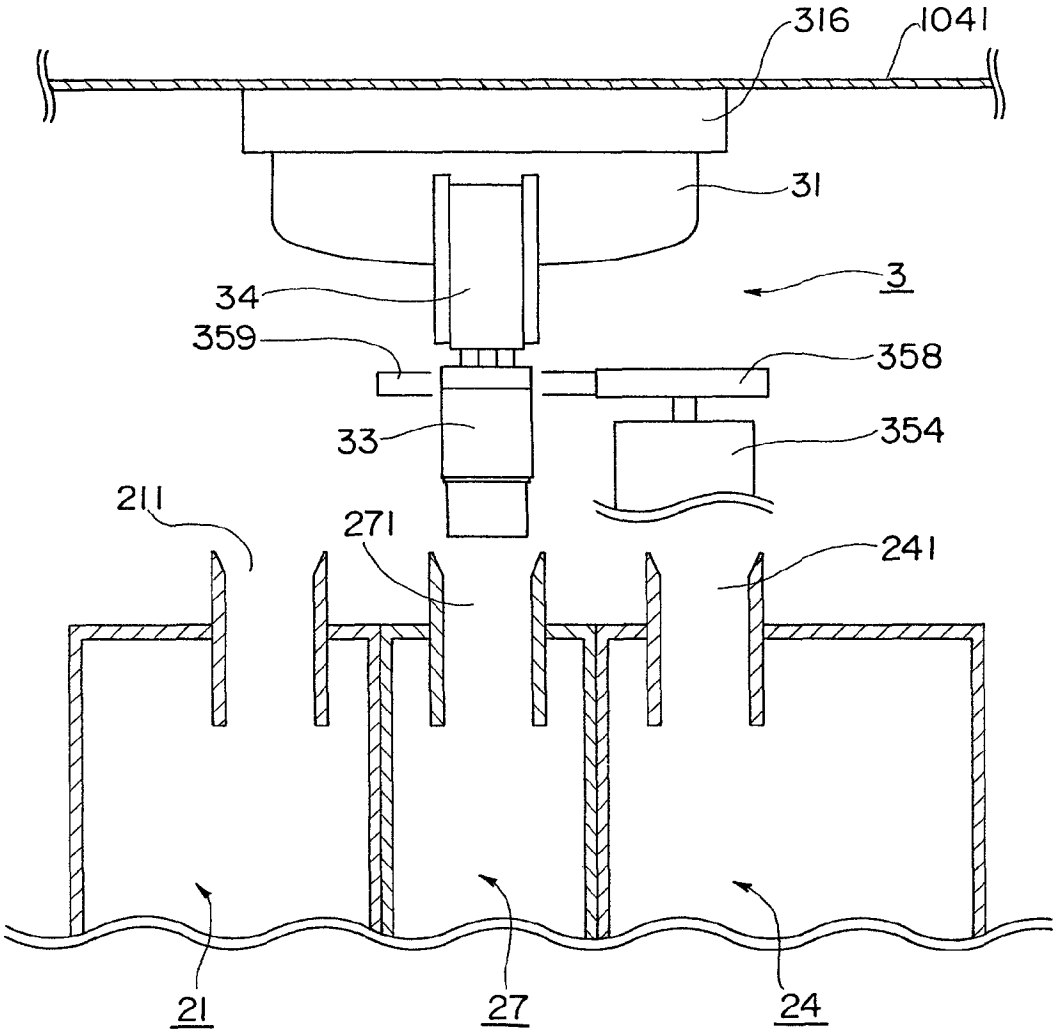
FIG. 21 is a diagram viewed from the arrow XXI of FIG. 20.
Figure 22:
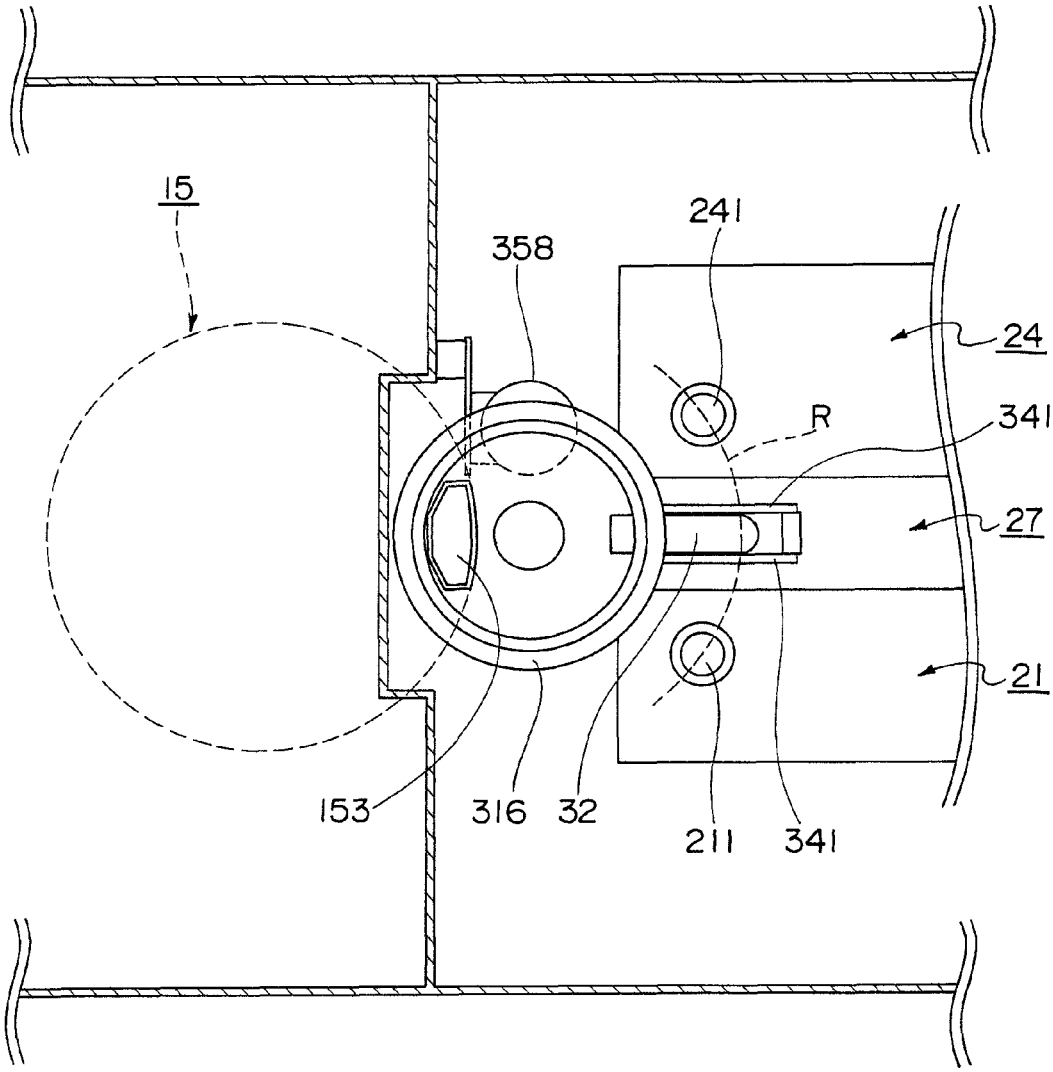
FIG. 22 is a cross-sectional view taken along the arrow XXII-XXII of FIG. 18.

FIG. 20 is an enlarged partial view of FIG. 3, showing the drain means 3. FIG. 21 is a diagram viewed from the arrow XXI of FIG. 20, and FIG. 22 is a cross-sectional view taken along the arrow XXII-XXII of FIG. 20. The drain means 3 has: a receiver 31; a discharge pipe 32; a connecting pipe 33; a cylinder drive portion (raising and lowering portion) 34; and a rotation means (moving means) 35. The receiver 31 and the discharge pipe 32 constitute a discharge member. The receiver 31 is formed by a bottom face 311 and a peripheral wall 312. The bottom face 311 is inclined so as to be lowered toward a discharge port 313. The discharge pipe 32 is communicated with the discharge port 313, and is fixed to the receiver 31. The discharge pipe 32 includes an inclined portion 321 and a vertical portion 322. The connecting pipe 33 is provided so as to be connected to a lower end portion of the vertical portion 322. The connecting pipe 33 is externally fitted to the vertical portion 322 so as to be slidable up and down, and is moved up and down along the vertical portion 322 by the cylinder drive portion 34. The cylinder drive portion 34 is fixed to the receiver 31 and the discharge pipe 32 via a support plate 341. The diameter of a lower end portion of the connecting pipe 33 is set such that the lower end portion is internally fitted to an inlet of each tank described later. The rotation means 35 rotates a vertical rotation shaft 351, which is connected to the rotational center of the receiver 31, via gears 358 and 359 by means of a motor 354 (FIG. 21). The vertical rotation shaft 351 is supported at an inner wall 106 of the apparatus main body 100 via two arms 355 and 356. On the other hand, as shown in FIG. 21 and FIG. 22, a first tank 21, a second tank 24 and a third tank 27 are provided so as to be aligned laterally. The third tank 27 is located at the center. Further, as shown in FIG. 22, inlets 211, 271 and 241 of these three tanks are provided so as to be located on an arc-shaped path R. This path R coincides with a path formed by the connecting pipe 33 when the rotation means 35 rotates the receiver 31 together with the discharge pipe 32 and the connecting pipe 33. The rotation means 35 is capable of rotating the receiver 31 so that the connecting pipe 33 is located over each of the three inlets 211, 271 and 241. The adjustment of rotation of the receiver 31 is performed by detecting the rotation angle of the receiver 31 with the use of an encoder 357 and by adjusting the operation of the motor 354. The receiver 31 can be rotated by allowing a guide 315, provided at a peripheral face of the peripheral wall 312, to slide along a rail 316. The rail 316 is fixed to a lower face of a top plate 1041 of the lower chamber 104.

The receiver 31 is provided, at the top plate 1041, with a second cleaning means 8. The second cleaning means 8 has a nozzle 81 protruding downward from the top plate 1041, and ejects cleaning water toward an inner face of the receiver 31 from the nozzle 81. The nozzle 81 is connected with a water supply passage 82, and the water supply passage 82 is connected to the external cleaning water supply source similarly to the cleaning water supply means described later.

As shown in FIG. 2 and FIG. 4, the first surface treatment liquid supply means 22 has: a first supply pipe 222 leading to the filter 221 from an outlet port 212 of the first tank 21 via a pump 213; a return pipe 223 leading to a return port 214 of the first tank 21 from the filter 221; and a second supply pipe 224 leading to the supply passage 440 of the first support means 43 from the filter 221. The first surface treatment liquid supply means 22 uses the first supply pipe 222, the second supply pipe 224 and the return pipe 223 during an operation period, and uses only the first supply pipe 222 and the return pipe 223 during a non-operation period.

As shown in FIG. 2 and FIG. 4, the second surface treatment liquid supply means 25 has: a first supply pipe 252 leading to the filter 251 from an outlet port 242 of the second tank 24 via a pump 243; a return pipe 253 leading to a return port 244 of the second tank 24 from the filter 251; and a second supply pipe 254 leading to the supply passage of the second support means 48 from the filter 251. The second surface treatment liquid supply means 25 uses the first supply pipe 252, the second supply pipe 254 and the return pipe 253 during an operation period, and uses only the first supply pipe 252 and the return pipe 253 during a non-operation period.

The cleaning water supply means has a supply pipe (not shown) connected to the external cleaning water supply source. This supply pipe is branched off and connected to: the water supply passage 54 of the first cleaning means 5; the water supply passage 56 leading to the nozzle 57 of the cover body 16; and the water supply passage 82 of the second cleaning means 8, respectively. It should be noted that connections between the supply pipe and the water supply passages 54, 56 and 82 are each provided with a solenoid valve.

Figure 23:
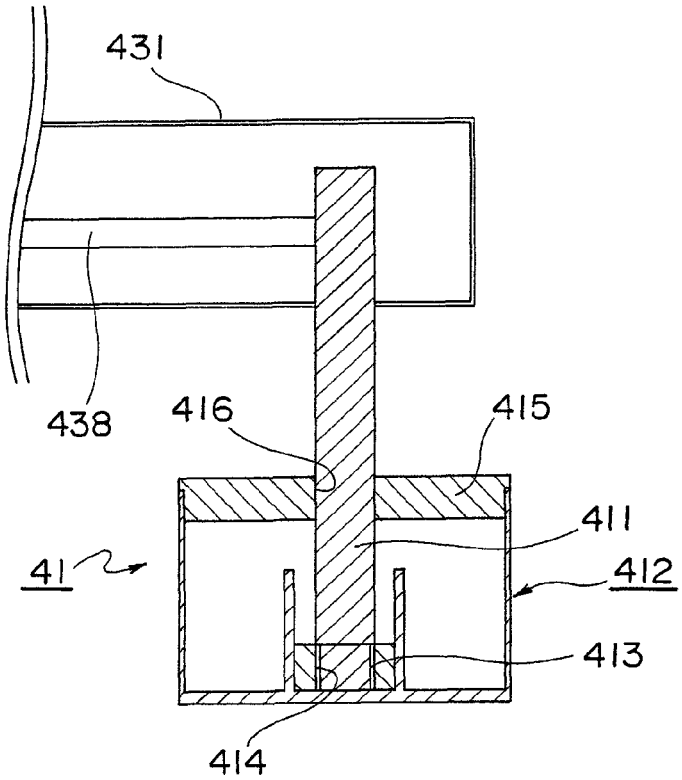
FIG. 23 is an enlarged front cross-sectional view of the first anode electrode.
Figure 24:
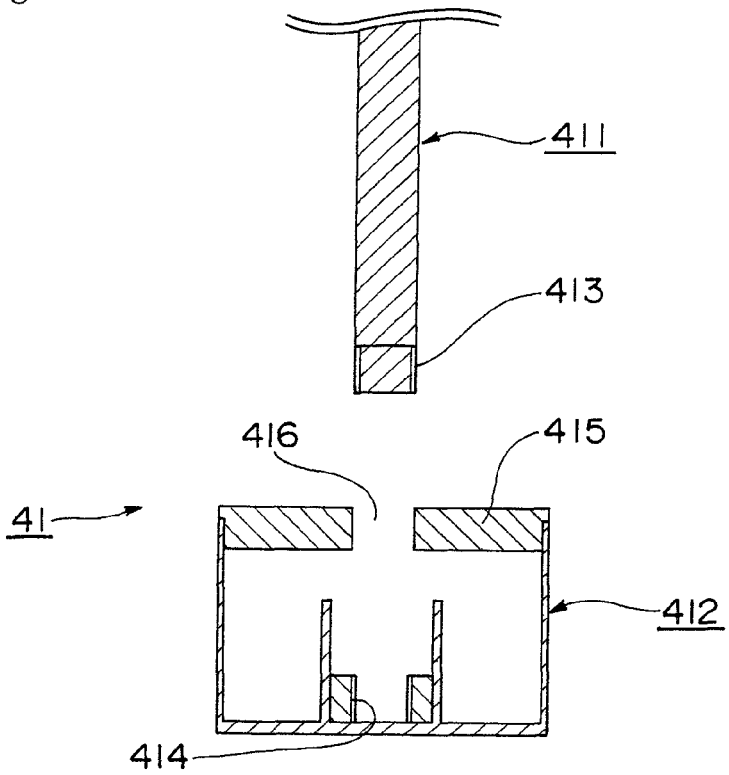
FIG. 24 is an exploded enlarged front cross-sectional view of the first anode electrode.

FIG. 23 is an enlarged front cross-sectional view of the first anode electrode 41, and FIG. 24 is an exploded enlarged front cross-sectional view of the first anode electrode 41. The first anode electrode 41 has a first anode terminal 411 and a first anode case 412. The first anode case 412 is a receptacle including a mesh body made of titanium, for example, and is capable of containing an anode metal for first surface treatment. At a lower end of the first anode terminal 411, a thread portion 413 is formed. On the other hand, at the center of a bottom face of the first anode case 412, a screw portion 414 to which the thread portion 413 is screwed is formed. The thread portion 413 of the first anode terminal 411 is screwed to the screw portion 414, thereby detachably attaching the first anode case 412 to the first anode terminal 411. The first anode case 412 is formed so as to be covered by a lid 415. The lid 415 is provided at its center with a through hole 416 through which the first anode terminal 411 passes.

The second anode electrode 46 also has a structure similar to that of the first anode electrode 41.

Figure 25:
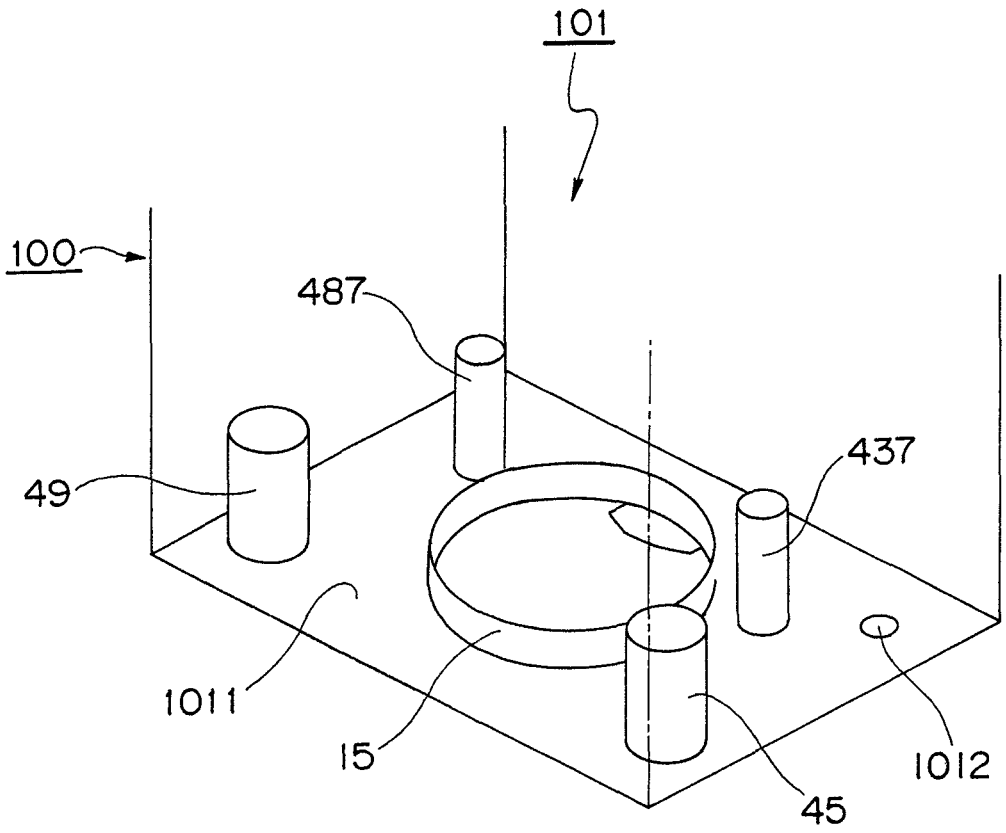
FIG. 25 is a schematic top perspective view showing the inside of an upper chamber at a front part of an apparatus main body.

FIG. 25 is a schematic top perspective view showing the inside of the upper chamber 101 at the front part of the apparatus main body 100. The upper chamber 101 has the bottom face 1011. At a corner of the bottom face 1011, a discharge port 1012 is formed. Further, the bottom face 1011 is inclined so as to be lowered toward the discharge port 1012. Furthermore, the discharge port 1012 is communicated with an external discharge portion.

Next, how the surface treatment apparatus 10 with the above-described structure operates will be described in the order of steps.

Hereinafter, the description will be made about the case where two types of surface treatments, including a first electroplating treatment and a second electroplating treatment, are carried out by way of example.

First, the following preparations are made before the apparatus 10 is operated.

(1) A first plating treatment liquid is put into the first tank 21, and a second plating treatment liquid is put into the second tank 24.

(2) Small objects serving as objects to be treated are charged into the treatment cell 11.

(3) The treatment cell 11 containing the small objects is fixed to the vertical rotation shaft 12 via the attachment/detachment means.

Then, the apparatus 10 is operated. Upon operation of the apparatus 10, the following steps are carried out in sequence.

<1> Cover Body Closing Operation Step

First, the opening/closing means 7 is operated so that the cover body 16 covers the receiving tank 15 from above.

Figure 26:
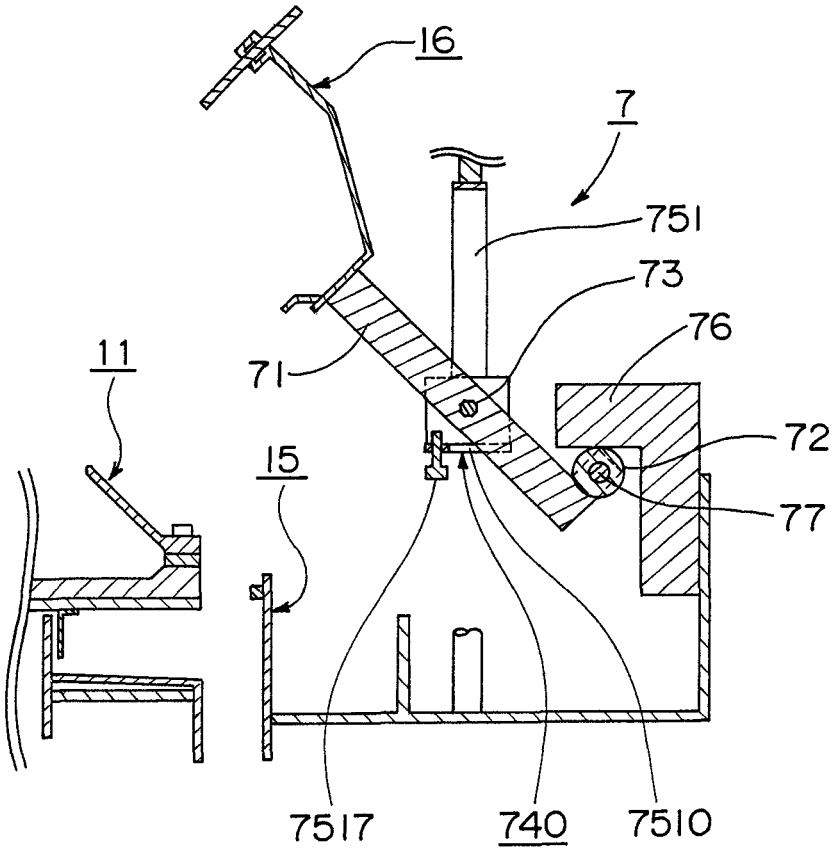
FIG. 26 is a cross-sectional view showing a state in which the cover body is opened by the opening/closing means.

Prior to the operation, the cover body 16 is in a state shown in FIG. 26, i.e., in an open state. Upon operation of the apparatus 10, the opening/closing means 7 is operated so that the cover body 16 covers the receiving tank 15 from above and enters a state shown in FIG. 27, i.e., a closed state.

Figure 27:
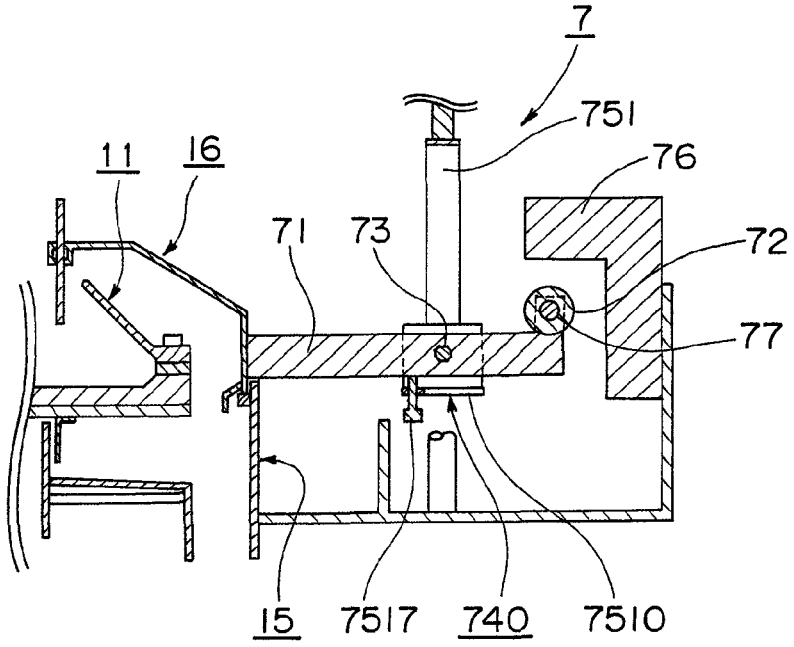
FIG. 27 is a cross-sectional view showing a state in which the cover body is closed by the opening/closing means.
Figure 28:
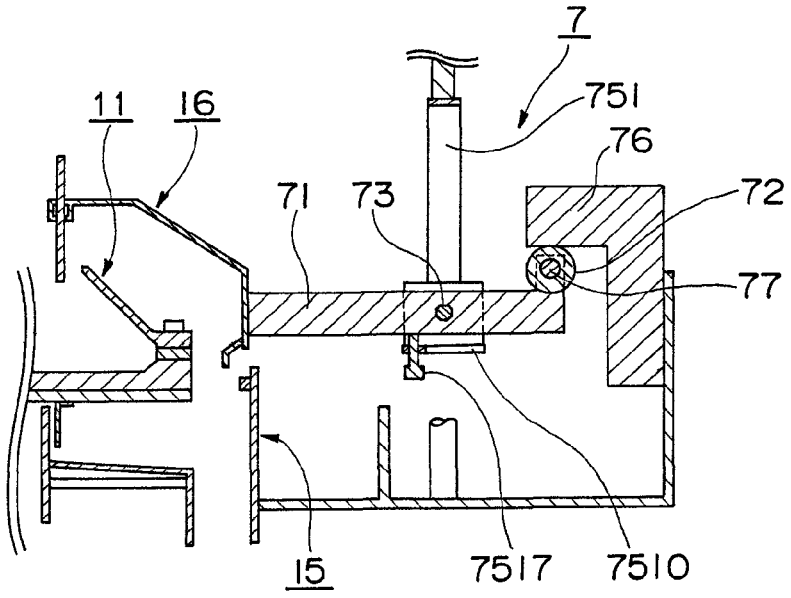
FIG. 28 is a cross-sectional view showing an operation of the opening/closing means in progress.

Specifically, the following operations are performed. In the opening/closing means 7 in the state shown in FIG. 26, the pole 751 has been raised together with the horizontal support shaft 73 and the support body 740, the roller 72 has abutted against the abutment body 76 from below, and the arm 71 has been inclined with a portion thereof adjacent to the roller 72 lowered. The arm 71 passes through the cut-out portion 7510 of the support body 740 to incline. In this state, upon operation of the opening/closing means 7, the pole 751 is lowered together with the horizontal support shaft 73 and the support body 740, and the arm 71 rotates around the horizontal support shaft 73 to gradually enter a horizontal state. Then, as shown in FIG. 28, at the instant when the arm 71 abuts against the adjustment bolt 7517 from above, the rotation of the arm 71 is stopped, and concurrently therewith, the cover body 16 enters a horizontal state. Thereafter, the pole 751 is further lowered together with the horizontal support shaft 73 and the support body 740, and concurrently therewith, the cover body 16 is lowered while being kept in the horizontal state, thereby covering the receiving tank 15 from above as shown in FIG. 27.

<2> First Cleaning Step

Next, the motor 13, the cleaning water supply means, the first cleaning means 5, and the second cleaning means 8 are operated. It should be noted that the connecting pipe 33 of the drain means 3 is connected to the inlet 271 of the third tank 27 at this point. The third tank 27 serves to contain the used cleaning water, and communicates with the external discharge portion.

Upon operation of the cleaning water supply means, the solenoid valve is opened to supply the cleaning water to the water supply passage 56 from the supply pipe connected to the external cleaning water supply source, thereby supplying the cleaning water from the nozzle 57 to the inside of the rotating treatment cell 11. The supplied cleaning water is discharged from the treatment cell 11 through the liquid flow-out means while the cleaning water washes the inside of the treatment cell 11. Thus, the inner face of the treatment cell 11 and the small objects are cleaned.

Upon operation of the first cleaning means 5, the solenoid valve is opened to supply the cleaning water to the water supply passage 54 from the above-mentioned supply pipe, and the cleaning water is ejected from the slits 51 and the ejection ports 52 under the situation in which the treatment cell 11 is rotating. Thus, the inner face 162 of the cover body 16 and the outer face 119 of the treatment cell 11 are cleaned.

Upon operation of the second cleaning means 8, the solenoid valve is opened to supply the cleaning water to the water supply passage 82 from the above-mentioned supply pipe, and the cleaning water is ejected from the nozzle 81. Thus, the inner face of the receiver 31 is cleaned.

Then, when the cleaning has been carried out for a certain period of time, the cleaning water supply means, the first cleaning means 5, and the second cleaning means 8 stop the operations thereof. On the other hand, the treatment cell 11 will be rotated for a while. Thus, the cleaning water remaining inside the treatment cell 11 is discharged from the treatment cell 11 through the liquid flow-out means.

The cleaning water, which has been discharged from the treatment cell 11, and the cleaning water, which has cleaned the inner face 162 of the cover body 16 and the outer face 119 of the treatment cell 11, are received by the receiving tank 15, flow into the third tank 27 from the discharge port 153 via the receiver 31 and the discharge pipe 32, and further flow out to the external discharge portion. Furthermore, the cleaning water, which has cleaned the inner face of the receiver 31, also flows into the third tank 27 via the discharge pipe 32, and further flows out to the external discharge portion.

<3> Drain Means First Operational Step

Next, the drain means 3 is operated. More specifically, the receiver 31 is rotated so that the connecting pipe 33 is located above the inlet 211 of the first tank 21, lowered by the cylinder drive portion 34, and connected to the inlet 211.

<4> First Anode Electrode Insertion Step

Figure 29:
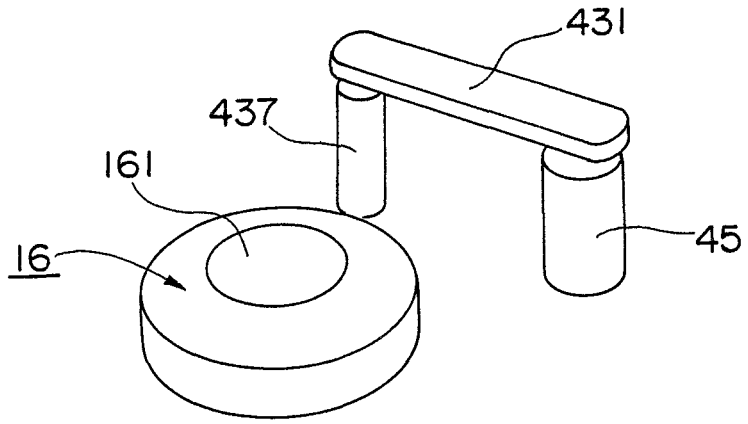
FIG. 29 is a top perspective view showing a state of the first anode electrode prior to an operation of the first support means in a first anode electrode insertion step.

Next, the first support means 43 is operated. It should be noted that prior to the operation of the first support means 43, the first anode electrode 41 is in a state in which it is retracted into the first retraction section 45 as shown in FIG. 29.

Figure 30:
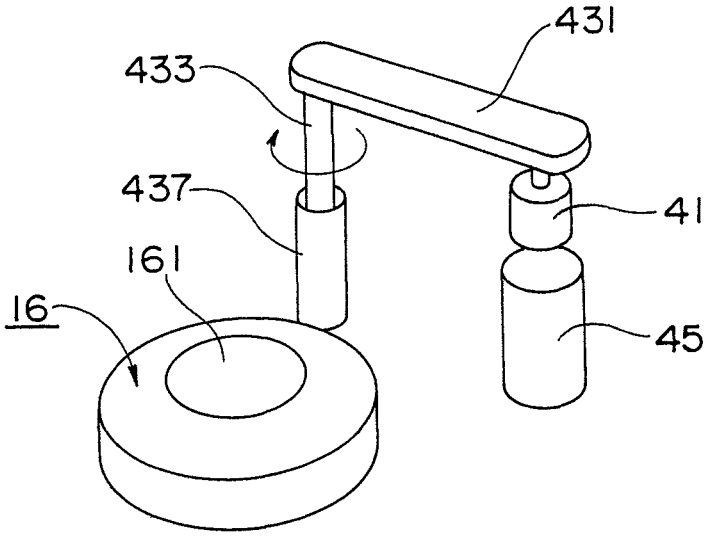
FIG. 30 is a top perspective view showing the state subsequent to FIG. 29 in the first anode electrode insertion step.
Figure 31:
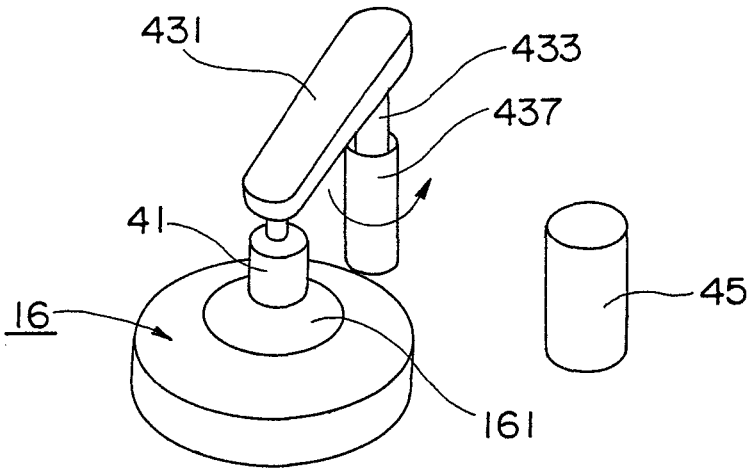
FIG. 31 is a top perspective view showing the state subsequent to FIG. 30 in the first anode electrode insertion step.
Figure 32:
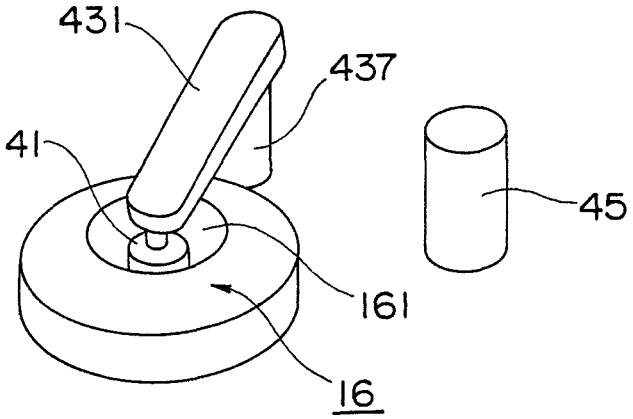
FIG. 32 is a top perspective view showing the state subsequent to FIG. 31 in the first anode electrode insertion step.

Upon operation of the first support means 43, the cylinder drive portion 435 raises the tube body 433. Thus, as shown in FIG. 30, the arm 431 is raised together with the first anode electrode 41, and the first anode electrode 41 gets out upward from the first retraction section 45. Next, the rotation drive portion 434 rotates the tube body 433 by a predetermined distance in the direction indicated by the arrow of FIG. 30. Thus, the arm 431 is rotated together with the first anode electrode 41, and the first anode electrode 41 is located above the opening 161 of the cover body 16 as shown in FIG. 31. Then, the cylinder drive portion 435 lowers the tube body 433. Thus, as shown in FIG. 32, the first anode electrode 41 is inserted into the treatment cell 11.

<5> First Electroplating Treatment Step

Next, the motor 13 and the first surface treatment liquid supply means 22 are operated while electric current is passed through the electrode ring 112 of the treatment cell 11.

Upon operation of the first surface treatment liquid supply means 22, the first plating treatment liquid in the first tank 21 flows into the treatment cell 11 from the nozzle 439 via the first supply pipe 222, the filter 221, the second supply pipe 224 and the supply passage 440. Meanwhile, at this point, the treatment cell 11 is rotating, and the first plating treatment liquid is discharged from the treatment cell 11 little by little through the liquid flow-out means.

On the other hand, in the treatment cell 11, electricity flows between the first anode electrode 41 and the electrode ring 112 via the first plating treatment liquid, and the small objects, brought into contact with the electrode ring 112 by centrifugal force resulting from the rotation of the treatment cell 11, are subjected to a plating treatment with the use of the first plating treatment liquid. Since the treatment cell 11 is rotated while the rotation thereof is repeatedly changed between forward and reverse directions, the small objects are evenly brought into contact with the electrode ring 112; accordingly, the plating treatment is uniformly performed on all the small objects.

Then, the first surface treatment liquid supply means 22 stops the operation thereof after having performed the above-described plating treatment for a certain period of time. On the other hand, the treatment cell 11 will be rotated for a while. Thus, the first plating treatment liquid remaining inside the treatment cell 11 is entirely discharged from the treatment cell 11 through the liquid flow-out means.

The first plating treatment liquid, which has been discharged from the treatment cell 11, is received by the receiving tank 15, falls down on the receiver 31 from the discharge port 153, and flows into the first tank 21 via the discharge pipe 32 and the inlet 211. In other words, the discharged first plating treatment liquid is returned to the first tank 21.

It should be noted that during the operation period and non-operation period of the first surface treatment liquid supply means 22, the first plating treatment liquid in the first tank 21 is returned to the first tank 21 via the first supply pipe 222, the filter 221 and the return pipe 223. Accordingly, upon operation of the apparatus 10, the first plating treatment liquid in the first tank 21 is constantly cleaned by the filter 221.

<6> First Anode Electrode Retraction Step

Next, the first support means 43 is operated in a manner opposite to the first anode electrode insertion step described above. Specifically, upon operation of the first support means 43 in the state shown in FIG. 32, the cylinder drive portion 435 raises the tube body 433. Thus, as shown in FIG. 31, the arm 431 is raised together with the first anode electrode 41, and the first anode electrode 41 is located above the opening 161 of the cover body 16. Next, the rotation drive portion 434 rotates the tube body 433 by a predetermined distance in the direction indicated by the arrow of FIG. 31. Thus, the arm 431 is rotated together with the first anode electrode 41, and the first anode electrode 41 is located above the first retraction section 45 as shown in FIG. 30. Then, the cylinder drive portion 435 lowers the tube body 433. Thus, as shown in FIG. 29, the first anode electrode 41 is retracted into the first retraction section 45.

<7> Drain Means Second Operational Step

Next, the drain means 3 is operated. More specifically, the receiver 31 is rotated so that the connecting pipe 33 is located above the inlet 271 of the third tank 27, lowered by the cylinder drive portion 34, and connected to the inlet 271.

<8> Second Cleaning Step

Next, the motor 13, the cleaning water supply means, the first cleaning means 5, and the second cleaning means 8 are operated, thereby performing operations similar to those of the above-described first cleaning step.

<9> Drain Means Third Operational Step

Next, the drain means 3 is operated. More specifically, the receiver 31 is rotated so that the connecting pipe 33 is located above the inlet 241 of the second tank 24, lowered by the cylinder drive portion 34, and connected to the inlet 241.

<10> Second Anode Electrode Insertion Step

Next, the second support means 48 is operated. It should be noted that prior to the operation of the second support means 48, the second anode electrode 46 is in a state in which it is retracted into the second retraction section 49.

The second support means 48 is operated similarly to the first support means 43. Specifically, upon operation of the second support means 48, a cylinder drive portion 485 raises a tube body 483. Thus, an arm 481 is raised together with the second anode electrode 46, and the second anode electrode 46 gets out upward from the second retraction section 49. Next, a rotation drive portion 484 rotates the tube body 483 by a predetermined distance. Thus, the arm 481 is rotated together with the second anode electrode 46, and the second anode electrode 46 is located above the opening 161 of the cover body 16. Then, the cylinder drive portion 485 lowers the tube body 483. Thus, the second anode electrode 46 is inserted into the treatment cell 11.

<11> Second Electroplating Treatment Step

Next, the motor 13 and the second surface treatment liquid supply means 25 are operated while electric current is passed through the electrode ring 112 of the treatment cell 11.

Upon operation of the second surface treatment liquid supply means 25, the second plating treatment liquid in the second tank 24 flows into the treatment cell 11 from the nozzle 439 via the first supply pipe 252, the filter 251, the second supply pipe 254 and the supply passage 440. Meanwhile, at this point, the treatment cell 11 is rotating, and the second plating treatment liquid is discharged from the treatment cell 11 little by little through the liquid flow-out means.

On the other hand, in the treatment cell 11, electricity flows between the second anode electrode 46 and the electrode ring 112 via the second plating treatment liquid, and the small objects, brought into contact with the electrode ring 112 by centrifugal force resulting from the rotation of the treatment cell 11, are subjected to a plating treatment with the use of the second plating treatment liquid. Since the treatment cell 11 is rotated while the rotation thereof is repeatedly changed between forward and reverse directions, the small objects are evenly brought into contact with the electrode ring 112; accordingly, the plating treatment is uniformly performed on all the small objects.

Then, the second surface treatment liquid supply means 25 stops the operation thereof after having performed the above-described plating treatment for a certain period of time. On the other hand, the treatment cell 11 will be rotated for a while. Thus, the second plating treatment liquid remaining inside the treatment cell 11 is entirely discharged from the treatment cell 11 through the liquid flow-out means.

The second plating treatment liquid, which has been discharged from the treatment cell 11, is received by the receiving tank 15, falls down on the receiver 31 from the discharge port 153, and flows into the second tank 24 via the discharge pipe 32 and the inlet 241. In other words, the discharged second plating treatment liquid is returned to the second tank 24.

It should be noted that during the operation period and non-operation period of the second surface treatment liquid supply means 25, the second plating treatment liquid in the second tank 24 is returned to the second tank 24 via the first supply pipe 252, the filter 251 and the return pipe 253. Accordingly, upon operation of the apparatus 10, the second plating treatment liquid in the second tank 24 is constantly cleaned by the filter 251.

<12> Second Anode Electrode Retraction Step

Next, the second support means 48 is operated in a manner opposite to the second anode electrode insertion step described above. Specifically, upon operation of the second support means 48, the cylinder drive portion 485 raises the tube body 483. Thus, the arm 481 is raised together with the second anode electrode 46, and the second anode electrode 46 is located above the opening 161 of the cover body 16. Next, the rotation drive portion 484 rotates the tube body 483 by a predetermined distance. Thus, the arm 481 is rotated together with the second anode electrode 46, and the second anode electrode 46 is located above the second retraction section 49. Then, the cylinder drive portion 485 lowers the tube body 483. Thus, the second anode electrode 46 is retracted into the second retraction section 49.

<13> Drain Means Fourth Operational Step

Next, the drain means 3 is operated. More specifically, the receiver 31 is rotated so that the connecting pipe 33 is located above the inlet 271 of the third tank 27, lowered by the cylinder drive portion 34, and connected to the inlet 271.

<14> Third Cleaning Step

Next, the motor 13, the cleaning water supply means, the first cleaning means 5, and the second cleaning means 8 are operated, thereby performing operations similar to those of the above-described first cleaning step.

<15> Cover Body Opening Operation Step

Next, upon operation of the opening/closing means 7, the cover body 16 gets away from the receiving tank 15. More specifically, upon operation of the opening/closing means 7 in the state shown in FIG. 27, the pole 751 is raised in conjunction with the arm 71 together with the horizontal support shaft 73 and the support body 740, and the roller 72 is also raised. At this point, the cover body 16 is also gotten away from the receiving tank 15 and raised while being kept in the horizontal state. Upon raising of the pole 751 by a distance H, as shown in FIG. 28, the roller 72 abuts against the abutment body 76 from below. Then, upon further raising of the pole 751, the roller 72 rotates while abutting against the abutment body 76, and the arm 71 will be inclined upward using the roller 72 as a supporting point. Thus, the cover body 16 enters the state shown in FIG. 26, i.e., the open state. It should be noted that the arm 71 passes through the cut-out portion 7510 of the support body 740 to incline.

Then, the operation of the apparatus 10 is stopped.

Thereafter, the treatment cell 11 containing the small objects is detached from the vertical rotation shaft 12 via the attachment/detachment means. Then, the small objects are taken out from the treatment cell 11 and dried.

Thus, a double-layer plating film can be formed on each small object. A lower-layer plating film is formed with the use of the first plating treatment liquid, and an upper-layer plating film is formed with the use of the second plating treatment liquid. For example, if the first plating treatment liquid is a nickel plating liquid, the lower-layer plating film is a nickel film, and if the second plating treatment liquid is a tin plating liquid, the upper-layer plating film is a tin film.

The apparatus 10 with the above-described structure can achieve the following operational effects.

(1) In the first electroplating treatment step, the first electroplating treatment can be performed on the small objects, and in the second electroplating treatment step, the second electroplating treatment can be performed on the small objects on which the first electroplating treatment has been performed. Accordingly, a plating film including two layers can be formed on each small object.

(2) In the second cleaning step, the inner face of the treatment cell 11 and the small objects can be cleaned by operating the cleaning water supply means, the inner face 162 of the cover body 16 and the outer face 119 of the treatment cell 11 can be cleaned by operating the first cleaning means 5, and the inner face of the receiver 31 can be cleaned by operating the second cleaning means 8. Hence, after the first plating treatment liquid has been collected in the first tank 21, the first plating treatment liquid can be discharged by being cleanly washed off from the inside of the treatment cell 11, the inner face 162 of the cover body 16, the outer face 119 of the treatment cell 11, and the inner face of the receiver 31. Accordingly, in the second plating treatment step, the second plating treatment liquid can be collected in the second tank 24 strictly separately so as not to mix the second plating treatment liquid with the first plating treatment liquid.

It should be noted that in the second cleaning step, the inner face 162 of the cover body 16 and the outer face 119 of the treatment cell 11 are also cleaned by the first cleaning means 5, and therefore, the scattered first plating treatment liquid can be cleanly washed off. Further, since the treatment cell 11 is cleaned while being rotated, the cleaning water blown off due to this rotation is hit on the inner face 162 of the cover body 16 and the inner face of the receiving tank 15, thus making it possible to cleanly wash off the scattered first plating treatment liquid. Accordingly, the separate collection of the first plating treatment liquid and the second plating treatment liquid can be effectively carried out. Moreover, since the inner face of the receiver 31 is also cleaned by the second cleaning means 8, the first plating treatment liquid adhered to the inner face of the receiver 31 can be cleanly washed off; accordingly, the separate collection of the first plating treatment liquid and the second plating treatment liquid can be more effectively carried out.

(3) In the first electroplating treatment step, the treatment is performed using the first plating treatment liquid in the first tank 21 by operating the first surface treatment liquid supply means 22, and the connecting pipe 33 is connected to the inlet 211 of the first tank 21 by the drain means first operational step, thus making it possible to return the used first plating treatment liquid to the first tank 21. As a result of this, the first plating treatment liquid can be reused. Further, in the second electroplating treatment step, the treatment is performed using the second plating treatment liquid in the second tank 24 by operating the second surface treatment liquid supply means 25, and the connecting pipe 33 is connected to the inlet 241 of the second tank 24 by the drain means third operational step, thus making it possible to return the used second plating treatment liquid to the second tank 24. As a result of this, the second plating treatment liquid can be reused.

(4) Since the apparatus includes the cover body 16, the first plating treatment liquid can be prevented from scattering in the first electroplating treatment step, the second plating treatment liquid can be prevented from scattering in the second electroplating treatment step, and the cleaning water can be prevented from scattering in the first to third cleaning steps.

(5) The cover body 16 in the state where it covers the receiving tank 15 abuts, at the lower end 164 of the peripheral wall 163, against the resin body 154. Accordingly, the surface treatment liquids and/or the cleaning water can be prevented from being leaked to the outside of the receiving tank 15.

(6) The cover body 16 has the flange 165 at the inner face of the lower end 164 of the peripheral wall 163. Accordingly, the surface treatment liquids and/or the cleaning water can be prevented from being splashed on a region at which the peripheral wall 163 of the cover body 16 and the peripheral wall 152 of the receiving tank 15 are overlapped. Hence, the surface treatment liquids and/or the cleaning water can be prevented from being leaked to the outside of the receiving tank 15.

(7) Since the resin body 154 and the flange 165 are both provided, the flange 165 prevents the cleaning water, falling down along the inner face 162 of the cover body 16, from being adhered to a region at which the resin body 154 and the lower end 164 of the cover body 16 abut against each other. Accordingly, the cleaning water and/or the surface treatment liquids can be prevented, with more certainty, from flowing out to the outside of the cover body 16 and the receiving tank 15.

(8) Since the vertical rotation shaft 12 is separated from the receiving tank 15 by the inner peripheral wall 155 of the receiving tank 15, the surface treatment liquids and/or the cleaning water can be prevented from being leaked toward the vertical rotation shaft 12. Besides, since the receiving plate 141 connected to the upper end of the vertical rotation shaft 12 has, at its lower face, the peripheral wall 143 surrounding the upper end portion of the inner peripheral wall 155, the surface treatment liquids and/or the cleaning water can be prevented from being leaked toward the vertical rotation shaft 12 through a gap 156 (FIG. 6) between the receiving plate 141 and the inner peripheral wall 155; accordingly, the leakage toward the vertical rotation shaft 12 can be prevented with certainty.

(9) Since electric current can be passed between the first anode electrode 41 and the electrode ring 112 of the treatment cell 11, the first electroplating treatment can be carried out. Further, since electric current can be passed between the second anode electrode 46 and the electrode ring 112 of the treatment cell 11, the second electroplating treatment can be carried out. Accordingly, two types of electroplating treatments can be carried out.

(10) In the cover body closing operation step, the cover body 16 can be automatically closed by operating the opening/closing means 7. Further, in the cover body opening operation step, the cover body 16 can be automatically opened by operating the opening/closing means 7. Besides, in the cover body opening operation step, the cover body 16 can be opened to an upwardly inclined high position, and therefore, the cover body 16 can be located at a position that does not interfere with operation(s) for attaching/detaching the treatment cell 11 to/from the vertical rotation shaft 12.

(11) In the cover body closing operation step, the cover body 16 is lowered from slightly above the receiving tank 15 while being kept in the horizontal state, thereby covering the receiving tank 15. Thus, the peripheral wall 163 of the cover body 16 can be relatively deeply inserted into the receiving tank 15. Accordingly, the receiving tank 15 can be covered by the cover body 16 with more certainty, and the treatment liquids and/or cleaning water can be prevented from scattering to the outside.

(12) In the cover body closing operation step and the cover body opening operation step, the cover body 16 enters the horizontal state slightly above the receiving tank 15, and therefore, the level sensor 58 can be prevented from colliding with an edge of the opening 115 of the treatment cell 11 when the cover body 16 is inclined while being raised/lowered.

(13) In the first electroplating treatment step, during the operation period and non-operation period of the first surface treatment liquid supply means 22, the first plating treatment liquid in the first tank 21 can be returned to the inside of the first tank 21 through the filter 221. Accordingly, the first plating treatment liquid in the first tank 21 can be cleaned. Furthermore, in the second electroplating treatment step, during the operation period and non-operation period of the second surface treatment liquid supply means 25, the second plating treatment liquid in the second tank 24 can be returned to the inside of the second tank 24 through the filter 251. Accordingly, the second plating treatment liquid in the second tank 24 can be cleaned. Consequently, the clean surface treatment liquids can be reused.

(14) In the first anode electrode insertion step, the first anode electrode 41 can be automatically inserted into the treatment cell 11 by operating the first support means 43. Furthermore, in the first anode electrode retraction step, the first anode electrode 41 can be automatically retracted into the first retraction section 45 by operating the first support means 43. Therefore, when the first anode electrode 41 is not used, the first anode electrode 41 can be prevented from interfering with attachment/detachment operation(s) and the like for the treatment cell 11 because the first anode electrode 41 can be retracted into the first retraction section 45, and furthermore, peripheral regions of the treatment cell 11 can be prevented from being contaminated by the first plating treatment liquid adhered to the first anode electrode 41.

(15) In the second anode electrode insertion step, the second anode electrode 46 can be automatically inserted into the treatment cell 11 by operating the second support means 48. Further, in the second anode electrode retraction step, the second anode electrode 46 can be automatically retracted into the second retraction section 49 by operating the second support means 48. Therefore, when the second anode electrode 46 is not used, the second anode electrode 46 can be prevented from interfering with attachment/detachment operation(s) and the like for the treatment cell 11 because the second anode electrode 46 can be retracted into the second retraction section 49, and furthermore, peripheral regions of the treatment cell 11 can be prevented from being contaminated by the second plating treatment liquid adhered to the second anode electrode 46.

(16) Since the first anode electrode 41 is provided by detachably attaching the first anode case 412 to the first anode terminal 411, the maintenance of the first anode electrode 41 can be easily carried out by removing the first anode case 412 therefrom. The same goes for the second anode electrode 46.

(17) In the upper chamber 101 of the apparatus main body 100, the plating treatment liquids and/or cleaning water, dripped down on the bottom face 1011, is allowed to flow toward the discharge port 1012. Accordingly, the cleaning of the bottom face 1011 can be carried out with ease.

It should be noted that in the first electroplating treatment step and the second electroplating treatment step, a so-called "defoaming operation" is preferably performed. In general, if a surface treatment liquid contains a surface-active agent, bubbles are generated during a surface treatment, which might cause trouble in the surface treatment. Therefore, when generation of bubbles is recognized, in the name of the "defoaming operation", the passage of electric current through the treatment cell 11 is stopped and the rotation of the treatment cell 11 is slowed down while the supply of the surface treatment liquid is continued, thereby causing the overflow of the surface treatment liquid from the treatment cell 11 together with the bubbles. Thus, the surface treatment can be favorably carried out without being hampered by the bubbles.

It should be noted that in the surface treatment apparatus of the present embodiment, the following modified structure(s) may be adopted.

<Modified Structure of First Cleaning Means 5>

Figure 33:
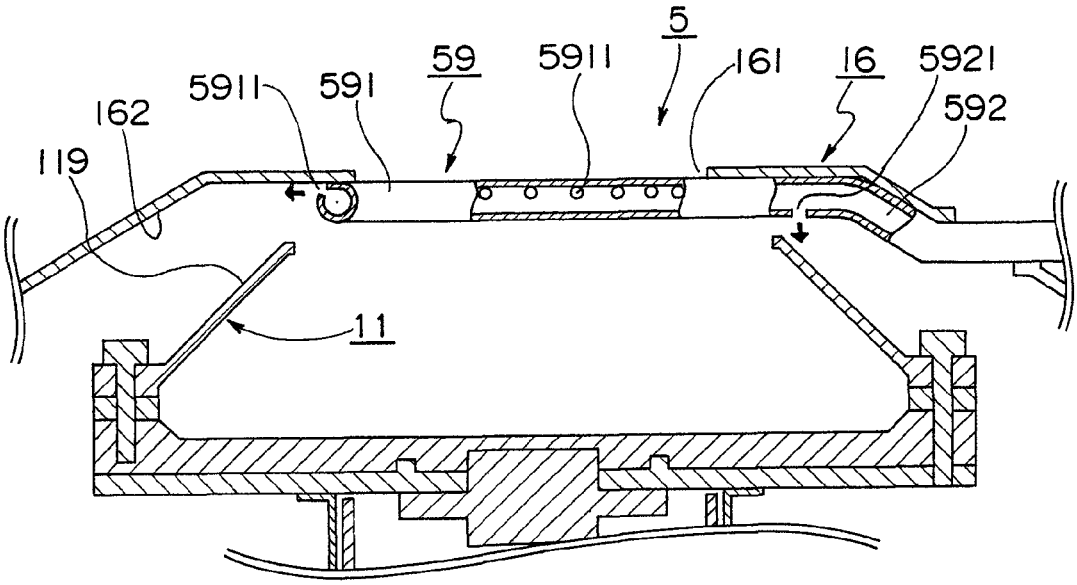
FIG. 33 is a cross-sectional view showing a first modified example of a first cleaning means.
Figure 34:
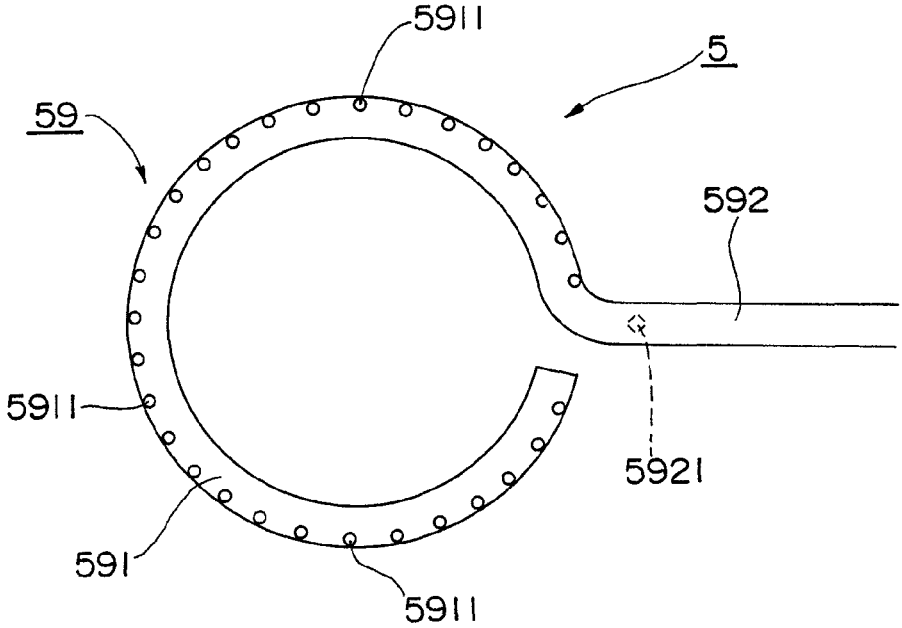
FIG. 34 is a plan view of a pipe shown in FIG. 33.

(A) A first modified example will be described. As shown in FIG. 33 and FIG. 34, the first cleaning means 5 is formed by using a single pipe 59. FIG. 34 is a plan view of the pipe 59 shown in FIG. 33. It should be noted that in both of the diagrams, the cleaning water supply means is eliminated. Specifically, the pipe 59 includes: a circular portion 591 equivalent to the water supply passage 53 shown in FIG. 8; and a straight portion 592 equivalent to the water supply passage 54 shown in FIG. 8. Further, the circular portion 591 is provided, in the vicinity of an upper region of the longitudinal cross section, with a large number of ejection ports 5911 (equivalent to the slits 51), and the straight portion 592 is provided, at a lowermost region of the longitudinal cross section, with one or more ejection ports 5921 (equivalent to the ejection ports 52).

In this structure, the cleaning water, which has been supplied to the pipe 59 through the supply pipe connected to the external cleaning water supply source, is ejected onto the inner face 162 of the cover body 16 from the ejection ports 51, and is ejected onto the outer face 119 of the treatment cell 11 from the ejection port(s) 52.

Also in this structure, operational effects similar to those of the first cleaning means 5 shown in FIG. 8 to FIG. 10 can be achieved. In addition, the structure of the first cleaning means 5 can be simplified.

Figure 35:
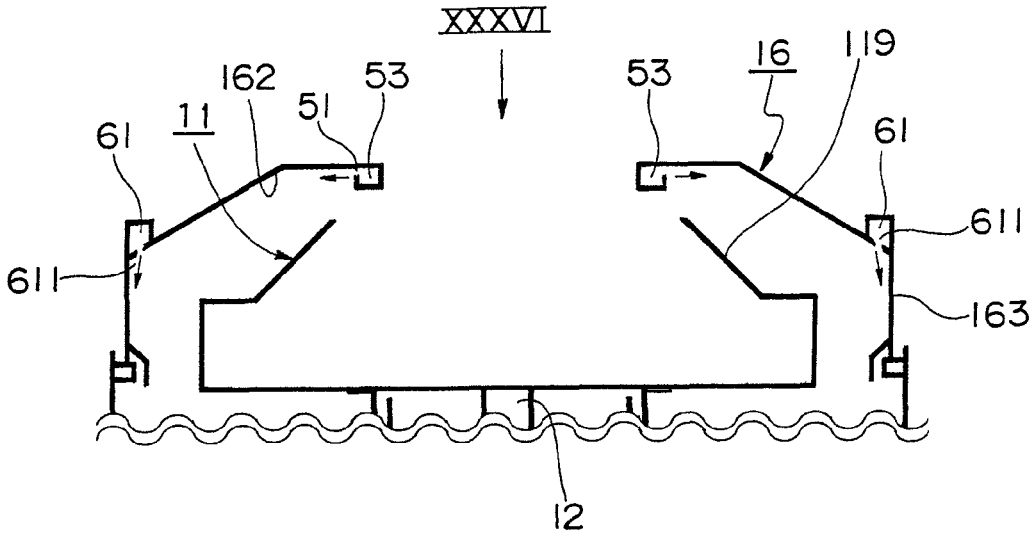
FIG. 35 is a cross-sectional view showing a second modified example of the first cleaning means.
Figure 36:
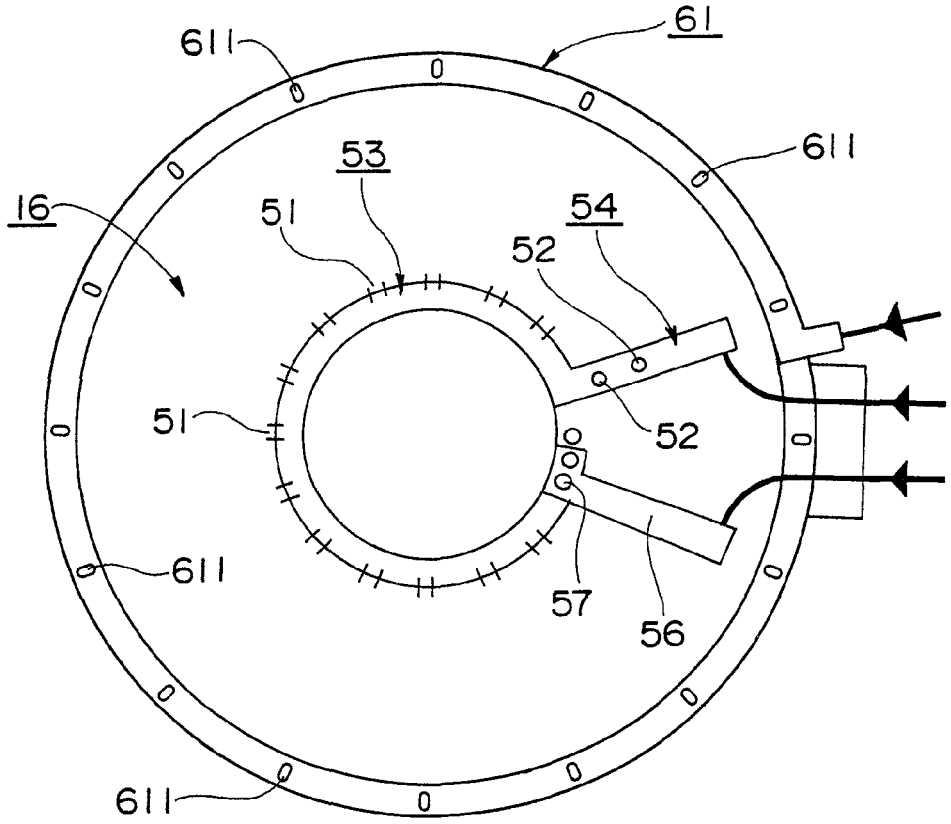
FIG. 36 is a diagram viewed from the arrow XXXVI of FIG. 35.

(B) A second modified example will be described. As shown in FIG. 35 and FIG. 36, the first cleaning means 5 further has a third ejection portion. FIG. 36 is a diagram viewed from the arrow XXXVI of FIG. 35. The third ejection portion includes ejection ports 611 formed in a water supply passage 61 provided along an outer peripheral edge of the cover body 16.

In this structure, the cleaning water, which has been supplied to the water supply passage 61 through the supply pipe connected to the external cleaning water supply source, is ejected onto the inner face of the peripheral wall 163 of the cover body 16 from the ejection ports 611.

Also in this structure, operational effects similar to those of the first cleaning means 5 shown in FIG. 8 to FIG. 10 can be achieved. In addition, the inner face of the peripheral wall 163 of the cover body 16 can be cleaned with certainty.

Figure 37:
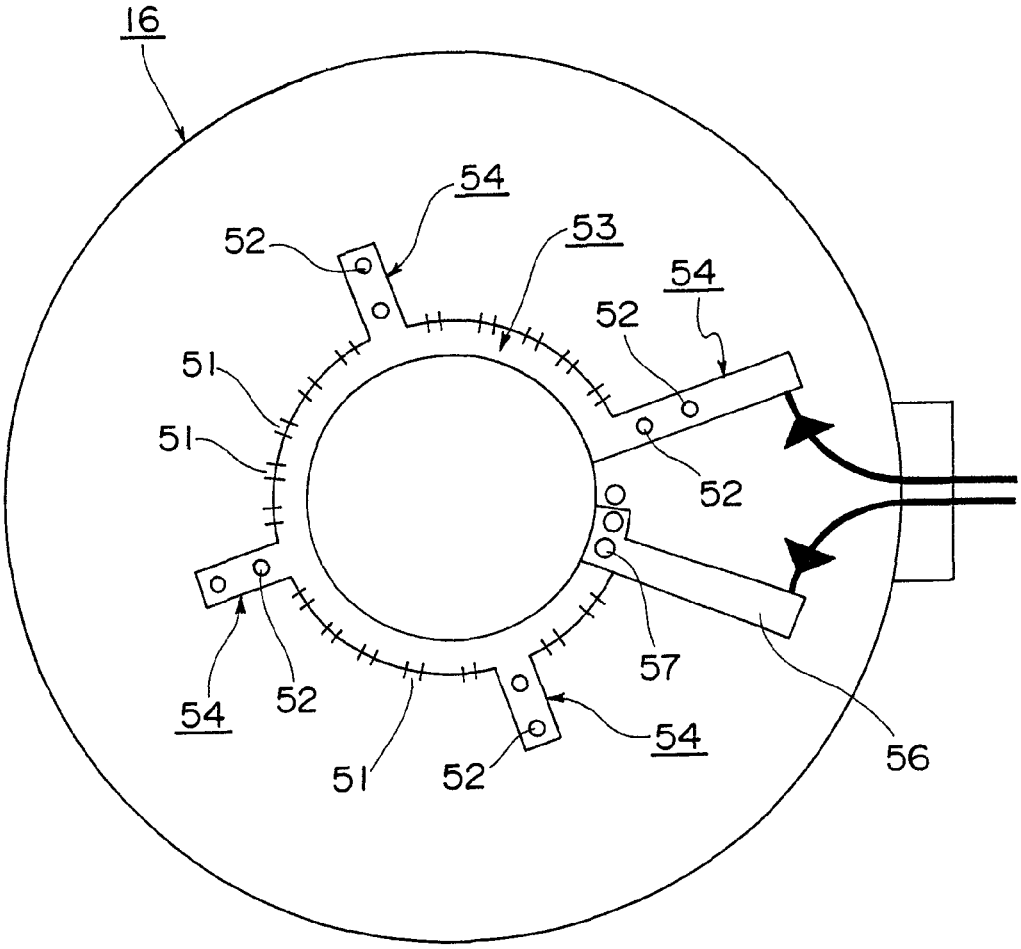
FIG. 37 is a cross-sectional view showing a third modified example of the first cleaning means.

(C) A third modified example will be described. As shown in FIG. 37, the first cleaning means 5 has a plurality of the water supply passages 54. Each water supply passage 54 extends radially from the water supply passage 53. A plurality of the ejection ports 52 are formed in each water supply passage 54.

In this structure, the cleaning water, which has been supplied through the supply pipe connected to the external cleaning water supply source, flows into each water supply passage 54, and is ejected onto the outer face 119 of the treatment cell 11 from the ejection ports 52 of each water supply passage 54.

Also in this structure, operational effects similar to those of the first cleaning means 5 shown in FIG. 8 to FIG. 10 can be achieved. In addition, the outer face 119 of the treatment cell 11 can be effectively cleaned.

Figure 38:
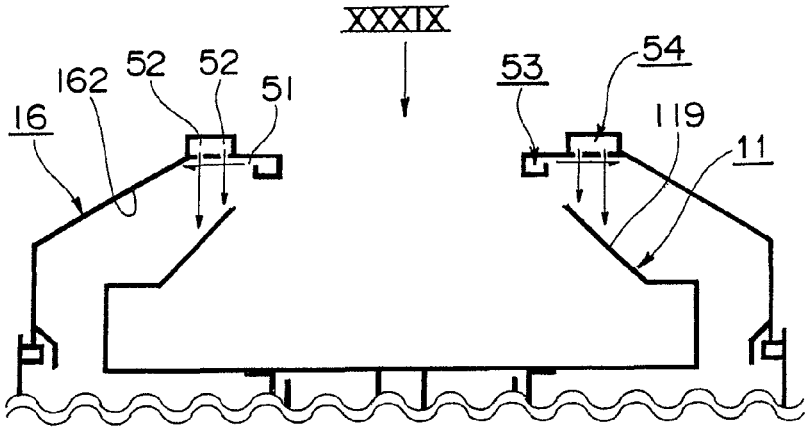
FIG. 38 is a cross-sectional view showing a fourth modified example of the first cleaning means.
Figure 39:
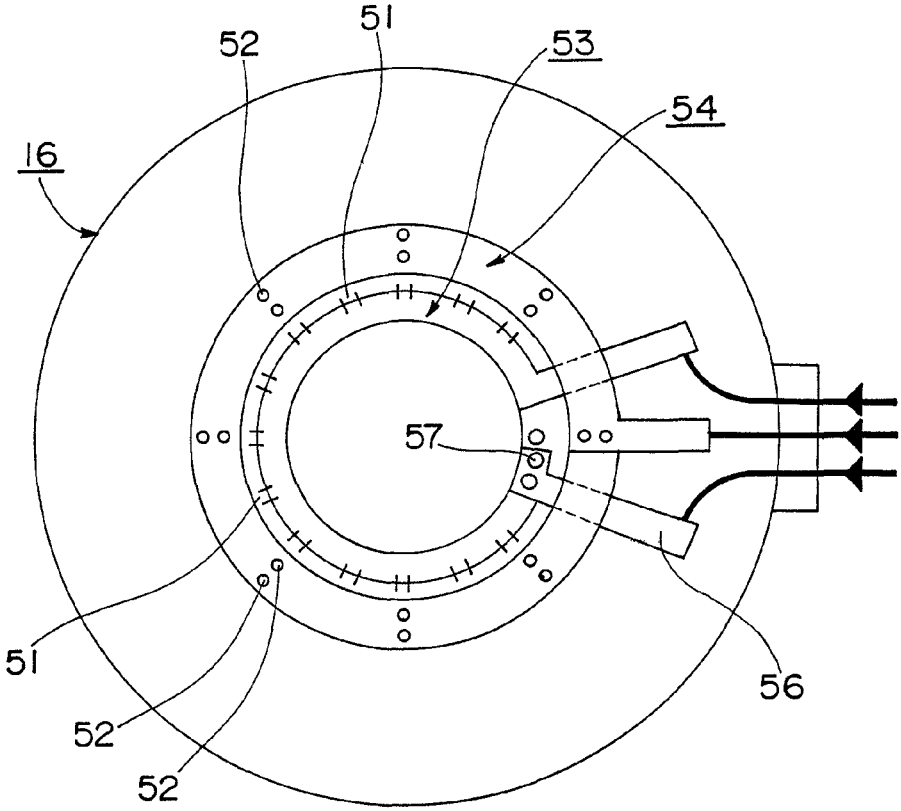
FIG. 39 is a diagram viewed from the arrow XXXIX of FIG. 38.

(D) A fourth modified example will be described. As shown in FIG. 38 and FIG. 39, the first cleaning means 5 has the water supply passage 54 provided so as to surround the water supply passage 53 from the radial outside of the cover body 16. FIG. 39 is a diagram viewed from the arrow XXXIX of FIG. 38.

In this structure, the cleaning water, which has been supplied through the supply pipe connected to the external cleaning water supply source, is ejected onto the outer face 119 of the treatment cell 11 from the ejection ports 52 of the circumferentially extending water supply passage 54.

Also in this structure, operational effects similar to those of the first cleaning means 5 shown in FIG. 8 to FIG. 10 can be achieved. In addition, the outer face 119 of the treatment cell 11 can be cleaned all along its circumference with certainty.

Figure 40:
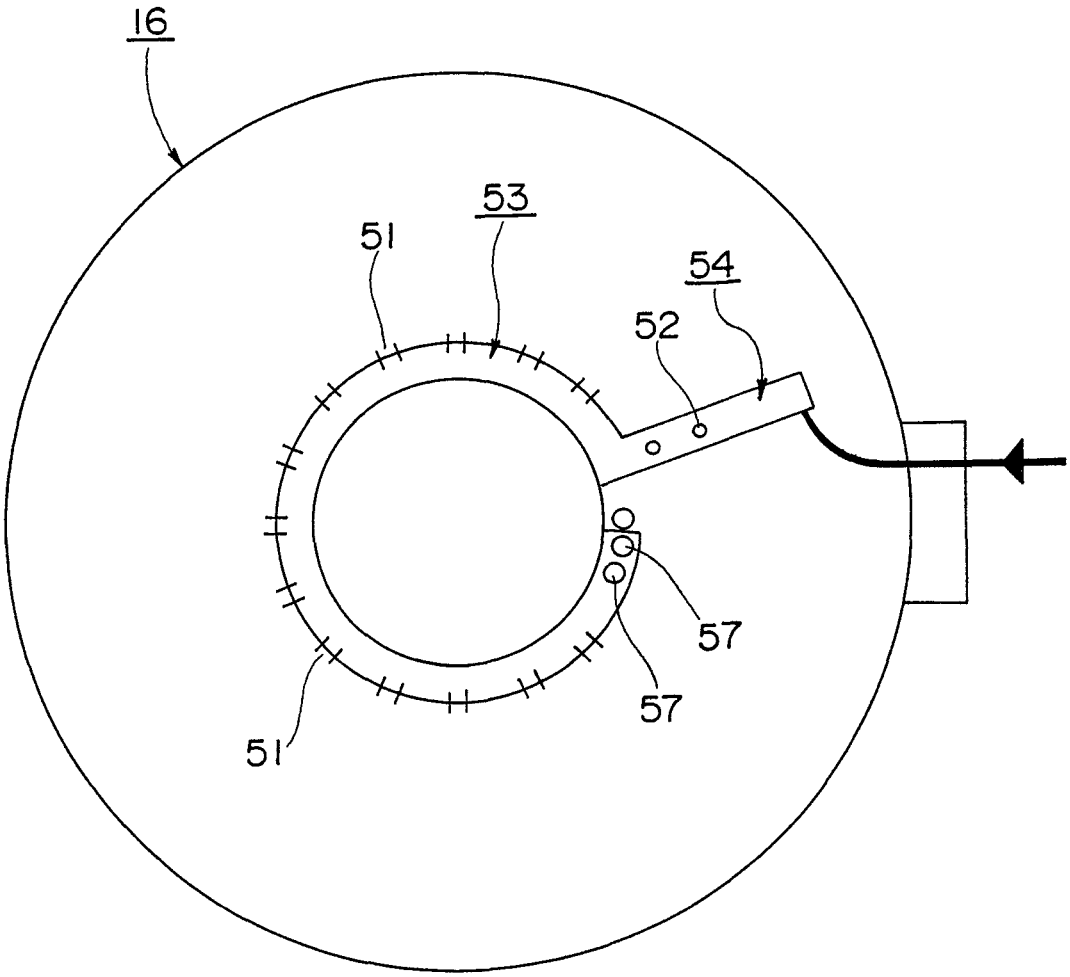
FIG. 40 is a plan view showing a fifth modified example of the first cleaning means.

(E) A fifth modified example will be described. In this example, the cleaning water supply means and the first cleaning means are integrally formed. As shown in FIG. 40, the water supply passages 53 and 54 of the first cleaning means 5 are connected to the nozzles 57 of the cleaning water supply means.

In this structure, the cleaning water, which has been supplied through the supply pipe connected to the external cleaning water supply source, is ejected onto the inner face 162 of the cover body 16 from the slits 51, ejected onto the outer face 119 of the treatment cell 11 from the ejection ports 52, and injected into the treatment cell 11 from the nozzles 57.

Also in this structure, operational effects similar to those of the first cleaning means 5 shown in FIG. 8 to FIG. 10 can be achieved. In addition, since the cleaning water supply means can be eliminated, the structure of the apparatus can be simplified.

It should be noted that in the foregoing examples, only water is supplied as the cleaning water, but high-pressure air and water can be mixed with each other and ejected. Thus, since the water and air gush out due to the pressure of the air, higher cleaning effects are obtained.

<Modified Example of Opening/Closing Means 7>

Figure 41:
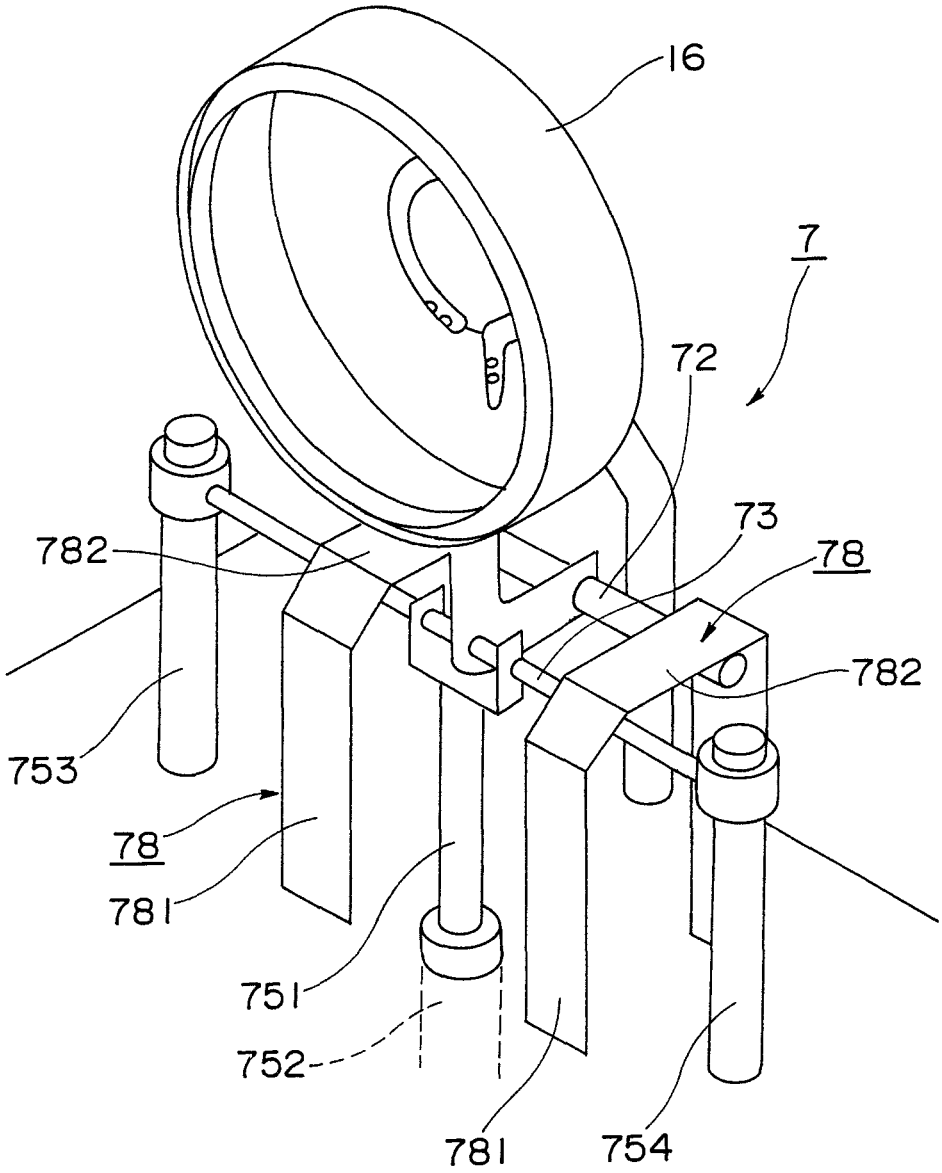
FIG. 41 is a perspective view showing a first modified example of the opening/closing means.

(A) A first modified example will be described. FIG. 41 is a perspective view of the opening/closing means 7, and FIG. 42 to FIG. 45 are lateral cross-sectional views sequentially showing operations of the opening/closing means. This opening/closing means 7 also has: the arm 71; the roller (rotary body) 72; the horizontal support shaft 73; the support means; the raising and lowering means 75; and the abutment body.

Figure 42:
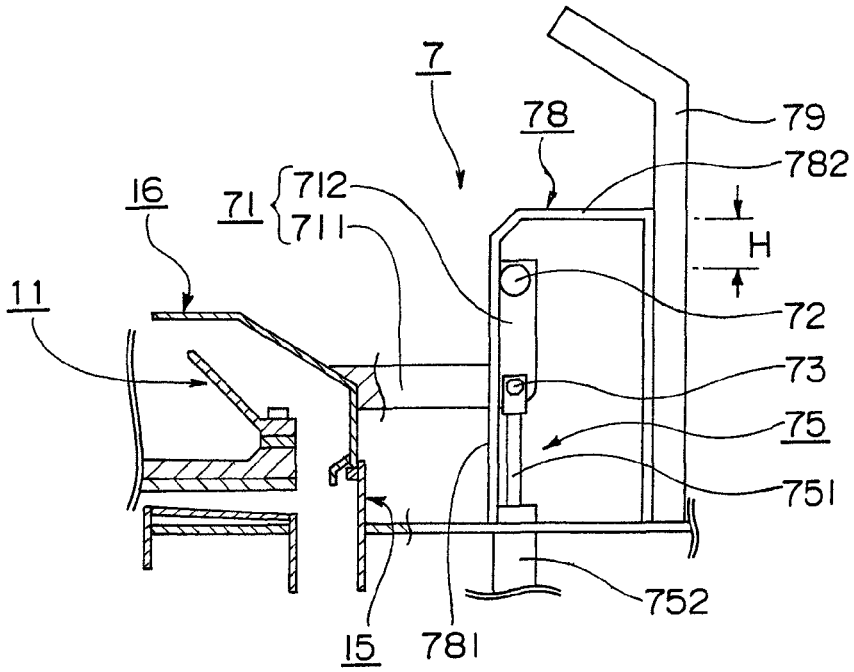
FIG. 42 is a cross-sectional view showing a state in which the cover body is closed by the opening/closing means of FIG. 41.

In FIG. 42, the arm 71 includes: a front arm portion 711 extending laterally from the cover body 16; and a rear arm portion 712 extending upward so as to be orthogonal to the front arm portion 711. The roller 72 is provided at an upper end of the rear arm portion 712. The roller 72 is supported so as to be orthogonal to the rear arm portion 712 and so as to be rotatable around a horizontal axis.

The raising and lowering means 75 has: the vertical pole 751; the cylinder drive portion 752; and the two vertical slide shafts 753 and 754 arranged in parallel. The cylinder drive portion 752 is located at a lower side of the pole 751. The pole 751 is located between the two slide shafts 753 and 754. By operating the cylinder drive portion 752, the raising and lowering means 75 raises/lowers the pole 751 along the two slide shafts 753 and 754 via the horizontal support shaft 73.

The horizontal support shaft 73 is orthogonal to the arm 71, rotatably supports the arm 71 at an intersection portion of the front arm portion 711 and the rear arm portion 712, and is rotatably supported at upper end portion of the pole 751. Further, the horizontal support shaft 73 is extended to the slide shafts 753 and 754 on both sides, and is slidably connected to the slide shafts 753 and 754.

The pole 751 is provided, on both sides thereof, with frame bodies 78 each having a vertical wall 781 and a horizontal wall 782. In other words, the two frame bodies 78 are provided. On the other hand, the roller 72 is extended from the upper end of the rear arm portion 712 to the frame bodies 78 on both sides. The vertical walls 781 are provided so as to establish a positional relationship in which the front arm portion 711 becomes horizontal when the roller 72 abuts against the vertical walls from behind. The horizontal walls 782 are extended rearward from the vertical walls 781. Each horizontal wall 782 is provided at a height at which the roller 72 abuts against the horizontal wall from below when the front arm portion 711 is raised by a predetermined distance H (FIG. 42) while being kept in the horizontal state. The vertical walls 781 constitute the support means for this opening/closing means 7, and the horizontal walls 782 constitute the abutment body for this opening/closing means 7.

The opening/closing means 7 with the above-described structure carries out an opening operation as follows.

Figure 43:
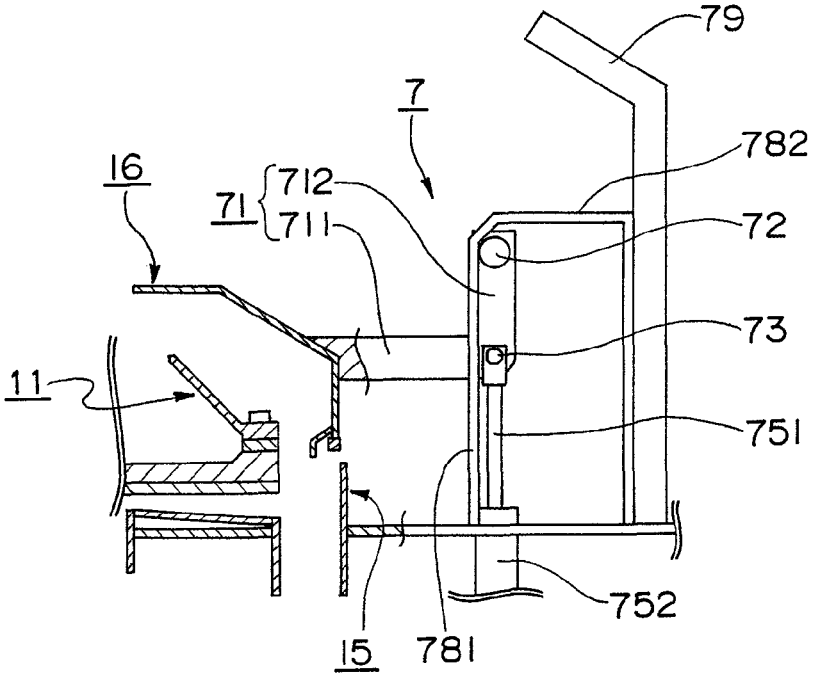
FIG. 43 is a cross-sectional view showing an opening operation of the cover body, which is performed by the opening/closing means of FIG. 41.
Figure 44:
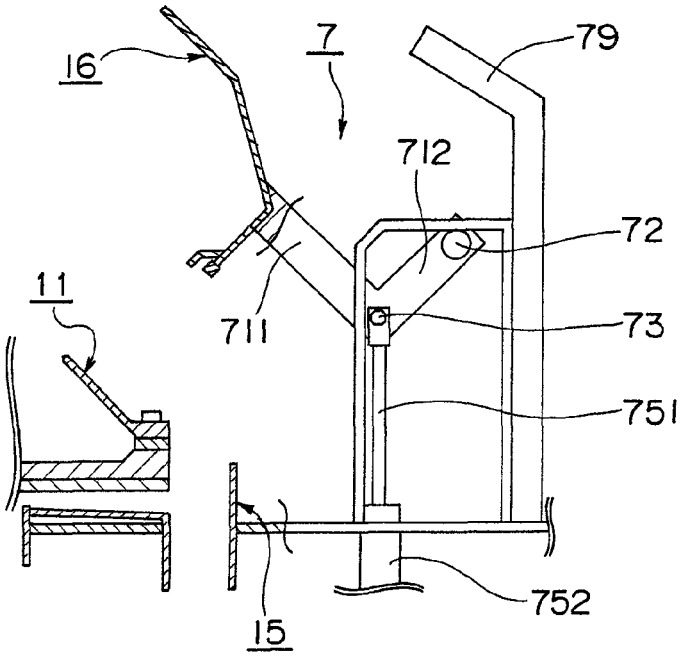
FIG. 44 is a cross-sectional view showing an opening operation subsequent to FIG. 43.
Figure 45:
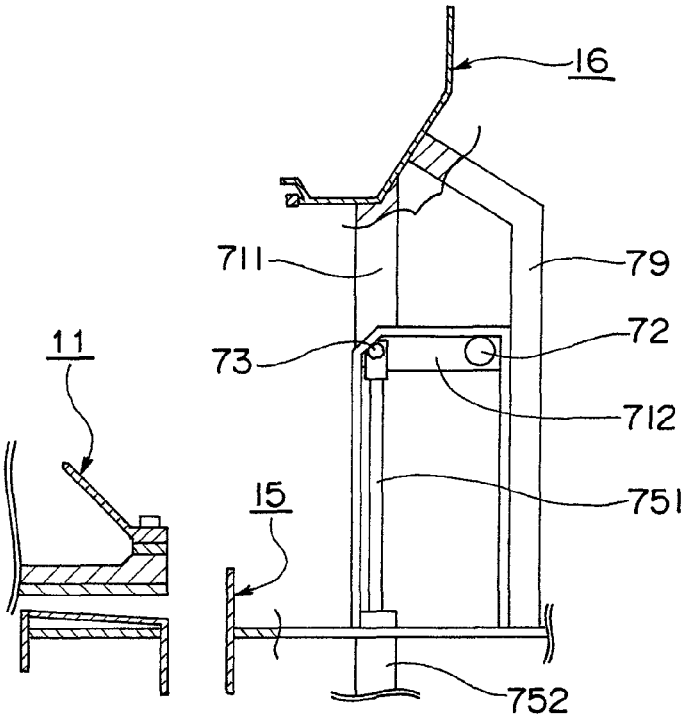
FIG. 45 is a cross-sectional view showing a state in which the cover body is opened by the opening/closing means of FIG. 41.

Upon operation of the opening/closing means 7 in the state where the cover body 16 is closed, i.e., in the state shown in FIG. 42, the pole 751 is raised in conjunction with the arm 71 together with the horizontal support shaft 73, and the roller 72 is also raised as shown in FIG. 43. At this point, the cover body 16 is also gotten away from the receiving tank 15 and raised while being kept in the horizontal state. Upon raising of the pole 751 by the distance H, the roller 72 abuts against the horizontal walls 782 from below. Then, as shown in FIG. 44, upon further raising of the pole 751, the roller 72 is moved backward along the horizontal walls 782 while being rotated, and the front arm portion 711 will be inclined upward using the horizontal support shaft 73 as a supporting point. Thus, the cover body 16 enters the state shown in FIG. 45, i.e., an open state, and abuts against a support member 79 provided at a backward position, thereby preventing the cover body 16 from toppling backward.

Also in the opening/closing means 7 with the foregoing structure, operational effects similar to those of the opening/closing means 7 shown in FIG. 15 can be achieved.

Figure 46:
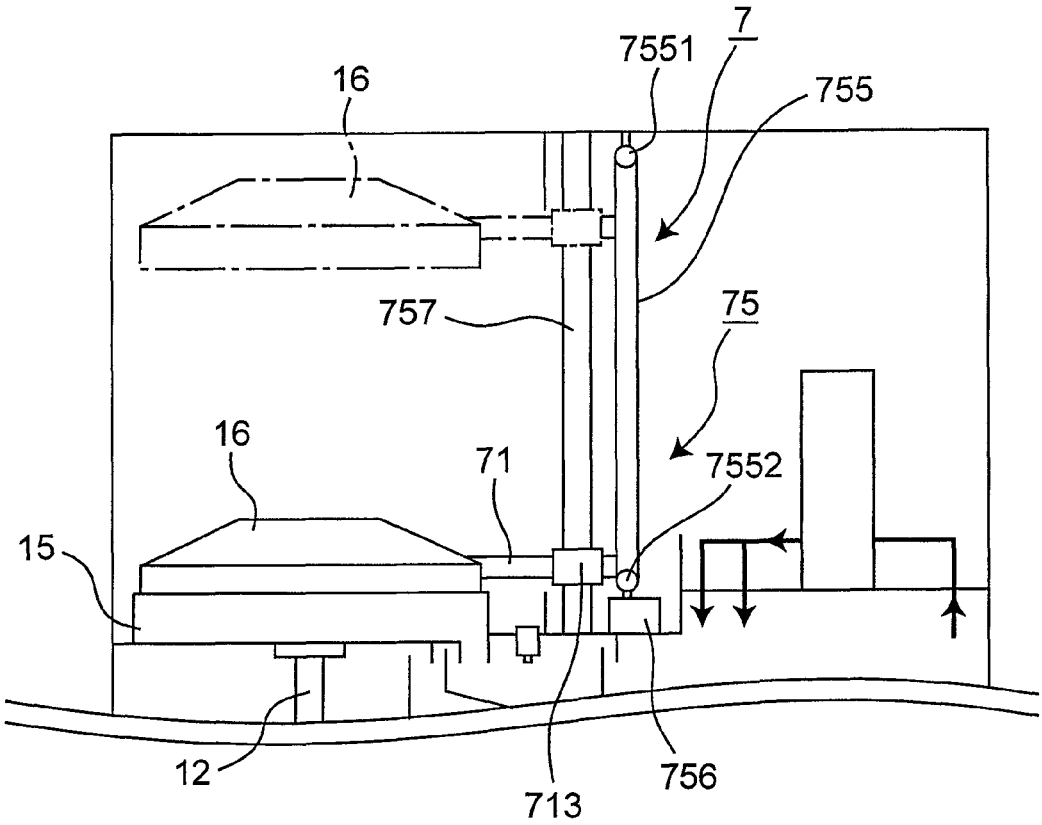
FIG. 46 is a side view showing a second modified example of the opening/closing means.

(B) A second modified example will be described. FIG. 46 is a side view of the opening/closing means 7. This opening/closing means 7 has the arm 71 and the raising and lowering means 75.

The raising and lowering means 75 has: a chain 755 running up and down; a chain drive means 756; and a slide shaft 757 extending up and down. The chain 755 runs between an upper sprocket 7551 and a lower sprocket 7552.

The arm 71 is extended laterally from the cover body 16, and is provided so as to be slidable, at its other end portion, along the slide shaft 757 via a bearing 713. Further, the bearing 713 is connected to the chain 755.

In this opening/closing means 7, upon operation of the chain drive means 756, the chain 755 is moved up/down, and concurrently therewith, the arm 71 is moved up/down along the slide shaft 757; as a result, the cover body 16 is moved up/down while being kept in the horizontal state. Thus, the opening/closing of the cover body 16 is carried out.

Also in the opening/closing means 7 with the foregoing structure, operational effects similar to those of the opening/closing means 7 shown in FIG. 15 can be achieved. In addition, the structure of the opening/closing means 7 can be extremely simplified.

Figure 47:
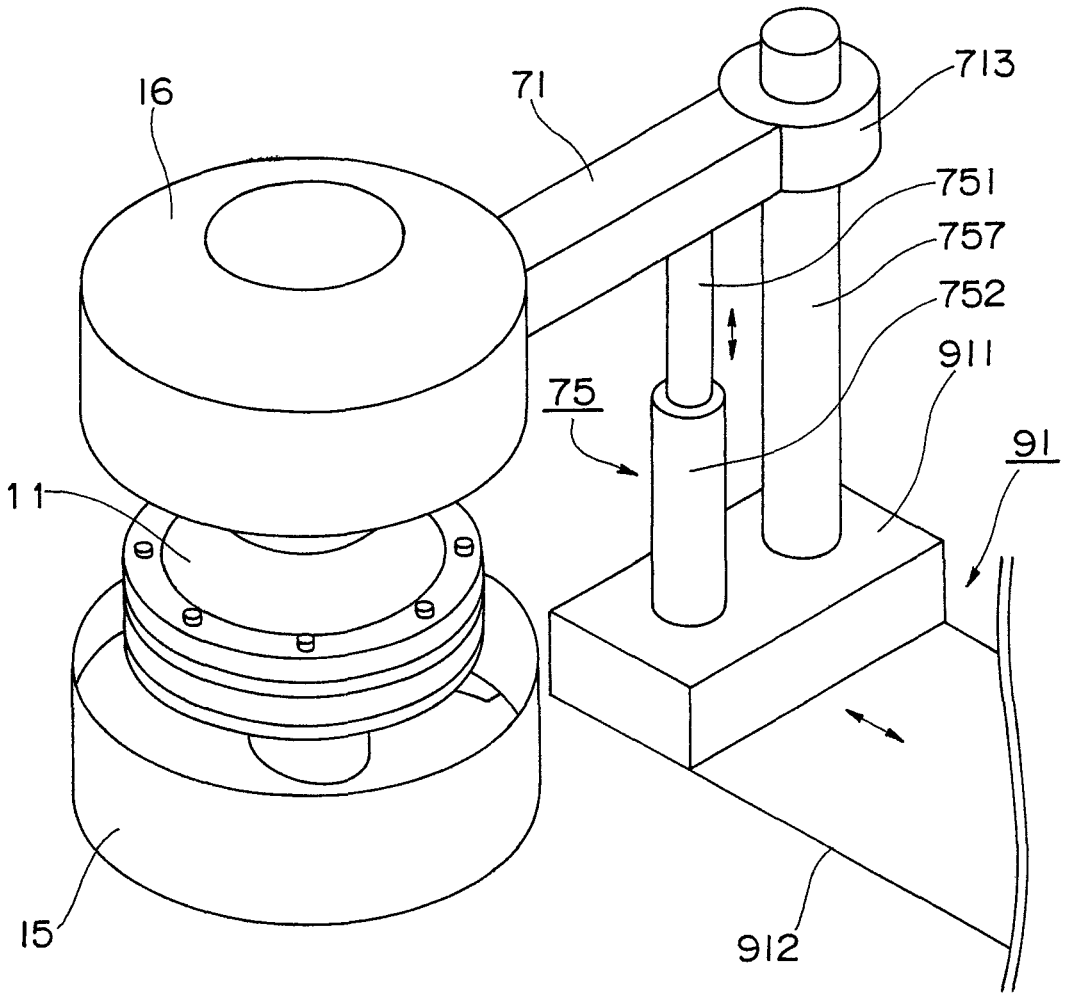
FIG. 47 is a perspective view showing a third modified example of the opening/closing means.

(C) A third modified example will be described. FIG. 47 is a perspective view of the opening/closing means 7. This opening/closing means 7 has the arm 71, the raising and lowering means 75 and a lateral movement means 91.

The lateral movement means 91 has a lateral movement body 911 and a rail 912. The rail 912 extends in the direction orthogonal to the arm 71. The lateral movement body 911 is provided so as to be moved along the rail 912 by a drive source (not shown).

Above the lateral movement body 911, the raising and lowering means 75 has: the pole 751 extending up and down; the cylinder drive means 752 for moving up and down the pole 751; and the slide shaft 757 extending up and down. An upper end of the pole 751 is connected to the arm 71 at some midpoint thereof.

The arm 71 is extended laterally from the cover body 16, and is provided so as to be slidable, at its other end portion, along the slide shaft 757 via the bearing 713.

An opening operation of this opening/closing means 7 will be carried out as follows. Specifically, upon operation of the cylinder drive means 752, the arm 71 is raised by a predetermined distance (e.g., the above-mentioned distance H) along the slide shaft 757, and as a result, the cover body 16 is raised by the above-mentioned predetermined distance while being kept in the horizontal state. Thereafter, the lateral movement means 91 is operated, and the lateral movement body 91 is moved along the rail 912. Thus, the arm 71 is moved together with the cover body 16, and the cover body 16 is moved laterally from above the treatment cell 11. In other words, the cover body 16 enters an open state. It should be noted that a closing operation is carried out in a manner opposite to this opening operation.

Also in the opening/closing means 7 with the foregoing structure, operational effects similar to those of the opening/closing means 7 shown in FIG. 15 can be achieved. In addition, since the cover body 16 can be completely moved away from the treatment cell 11, the reliable open state can be realized.

Figure 48:
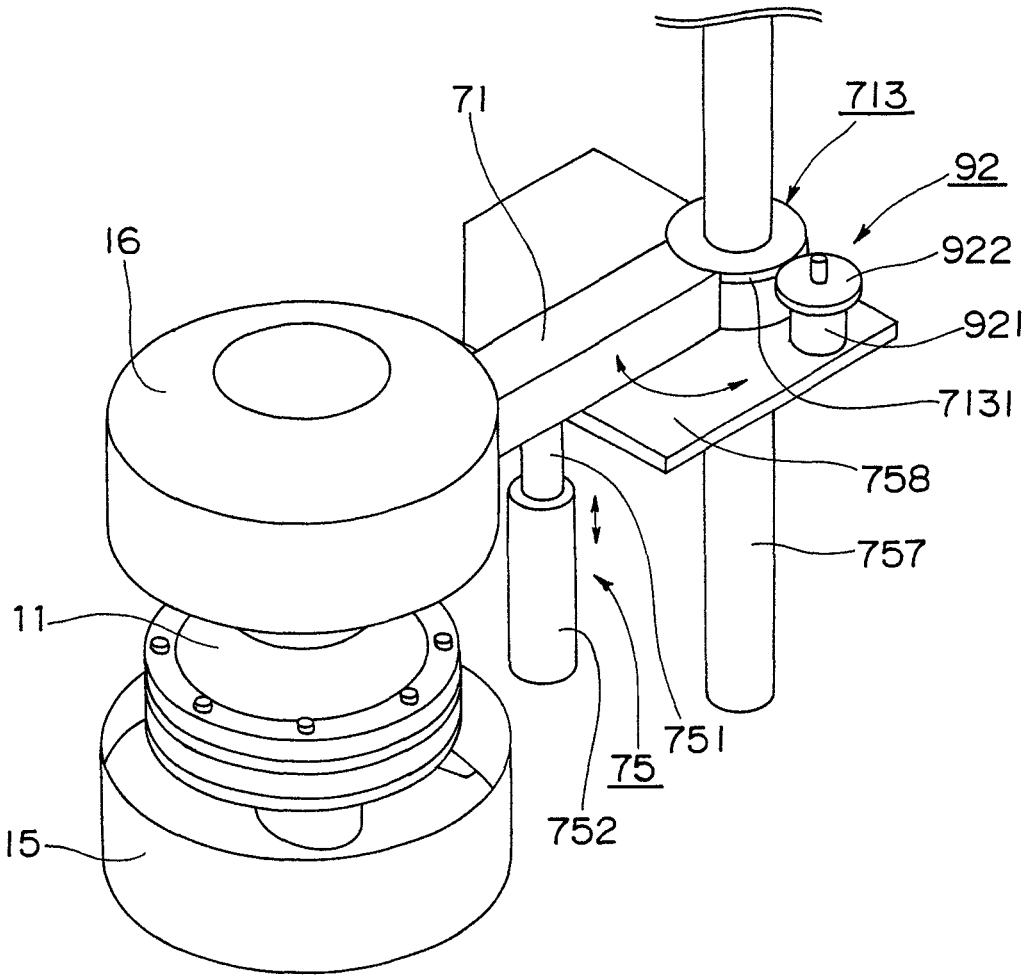
FIG. 48 is a perspective view showing a fourth modified example of the opening/closing means.

(D) A fourth modified example will be described. FIG. 48 is a perspective view of the opening/closing means 7. This opening/closing means 7 has the arm 71, the raising and lowering means 75, and a rotation means 92.

The raising and lowering means 75 has: the pole 751 extending up and down; the cylinder drive means 752 for moving up and down the pole 751; the slide shaft 757 extending up and down; and a raising and lowering plate 758. The pole 751 is fixed, at its upper end, to a lower face of the raising and lowering plate 758. The raising and lowering plate 758 is provided so as to be moved up and down along the slide shaft 757.

The arm 71 is extended laterally from the cover body 16, and is provided so as to be slidable, at its other end portion, along the slide shaft 757 via the bearing 713. At a peripheral face of the bearing 713, a gear 7131 is formed. The arm 71 and the bearing 713 are placed on the raising and lowering plate 758, and are slidable relative to the raising and lowering plate 758.

The rotation means 92 has: a motor 921 fixed on the raising and lowering plate 758; and a gear 922 rotationally driven by the motor 921. The gear 922 is connected to the gear 7131 of the bearing 713.

An opening operation of this opening/closing means 7 will be carried out as follows. Specifically, upon operation of the cylinder drive means 752, the raising and lowering plate 758 is raised by a predetermined distance (e.g., the above-mentioned distance H) along the slide shaft 757; as a result, the arm 71 placed onto the raising and lowering plate 758 is raised by the above-mentioned predetermined distance, and the cover body 16 is raised by the above-mentioned predetermined distance while being kept in the horizontal state. Thereafter, the rotation means 92 is operated to rotate the bearing 713, and to rotate the arm 71; thus, the cover body 16 moves laterally from above the treatment cell 11 while forming an arc-shaped path. In other words, the cover body 16 enters an open state. It should be noted that a closing operation is carried out in a manner opposite to this opening operation.

Also in the opening/closing means 7 with the foregoing structure, operational effects similar to those of the opening/closing means 7 shown in FIG. 15 can be achieved. In addition, since the cover body 16 can be completely moved away from the treatment cell 11, the reliable open state can be realized.

<Modified Structure of Drain Means 3>

Figure 49:
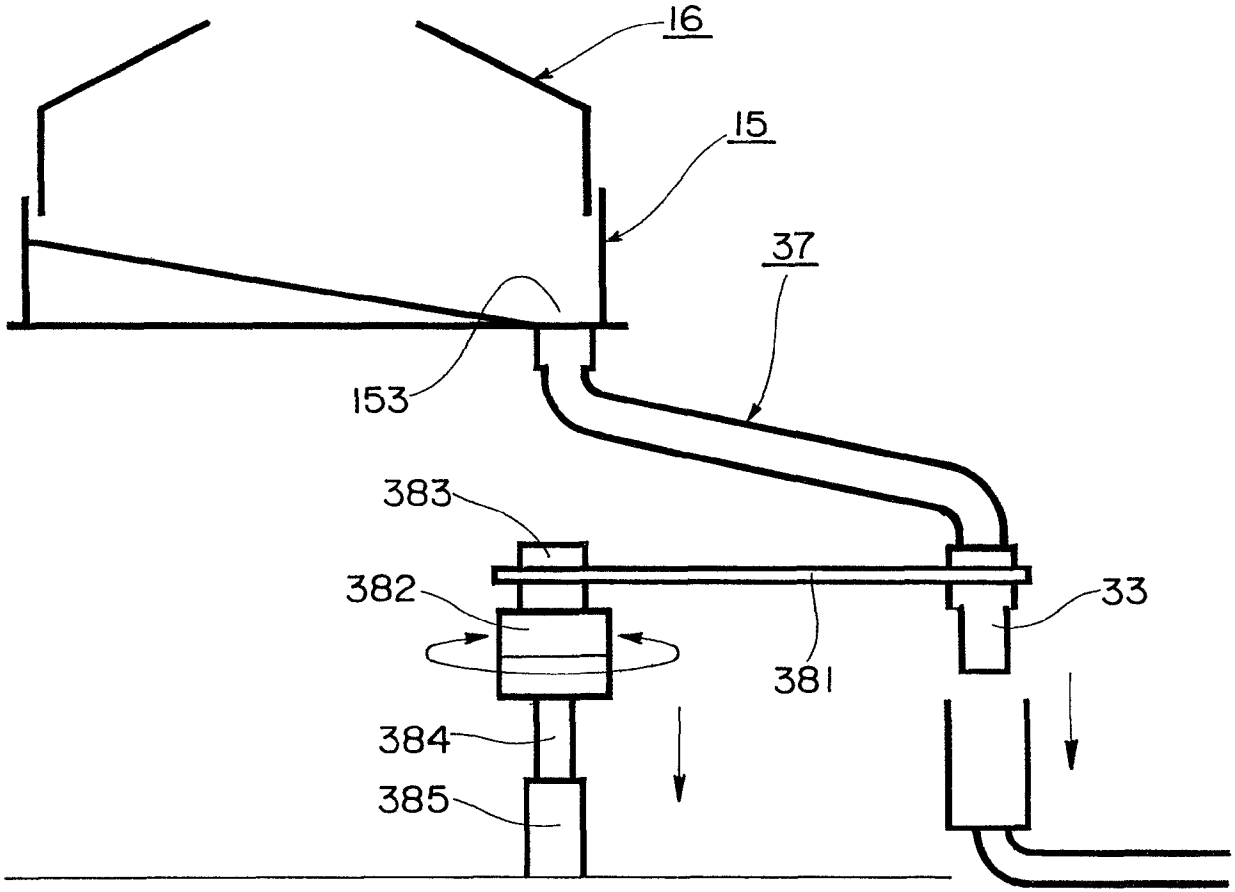
FIG. 49 is a cross-sectional view showing a first modified example of the drain means.

(A) A first modified example will be described. As shown in FIG. 49, a flexible hose 37 is used instead of the discharge member including the receiver 31 and the discharge pipe 32 shown in FIG. 20. Specifically, an upper end of the flexible hose 37 is connected to the discharge port 153 of the receiving tank 15, and the connecting pipe 33 is connected to a lower end of the flexible hose 37. The connecting pipe 33 is supported by a center shaft 383 of a rotary table 382 via a fork 381, and is rotated similarly to the case shown in FIG. 20 along with the rotation of the rotary table 382. The rotary table 382 is supported by a rod 384, and is raised and lowered by a cylinder drive portion 385.

In this structure, the connecting pipe 33 is rotated so as to be located above an inlet of an optional tank, and is lowered by the operation of the cylinder drive portion 385 so as to be connected to this inlet.

Also in this structure, operational effects similar to those of the drain means 3 shown in FIG. 20 can be achieved. In addition, the structure of the drain means 3 can be simplified, and furthermore, the power required for rotation and/or raising and lowering can be reduced as compared with the case shown in FIG. 20.

Figure 50:
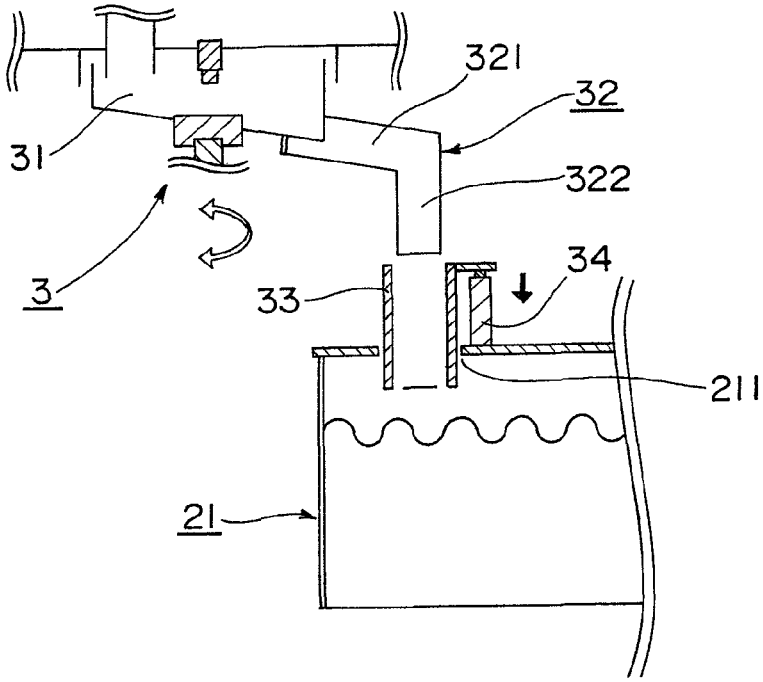
FIG. 50 is a cross-sectional view showing a second modified example of the drain means.

(B) A second modified example will be described. As shown in FIG. 50, the connecting pipe 33 is not provided at the discharge pipe 32 but is provided at the inlet of the tank. In FIG. 50, the connecting pipe 33 is provided so as to be slidable up and down relative to the inlet 211 of the first tank 21, and is moved up and down relative to the inlet 211 by the cylinder drive portion 34. Similarly, the connecting pipe 33 is also provided at each of the inlet 241 of the second tank 24 and the inlet 271 of the third tank 27.

Figure 51:
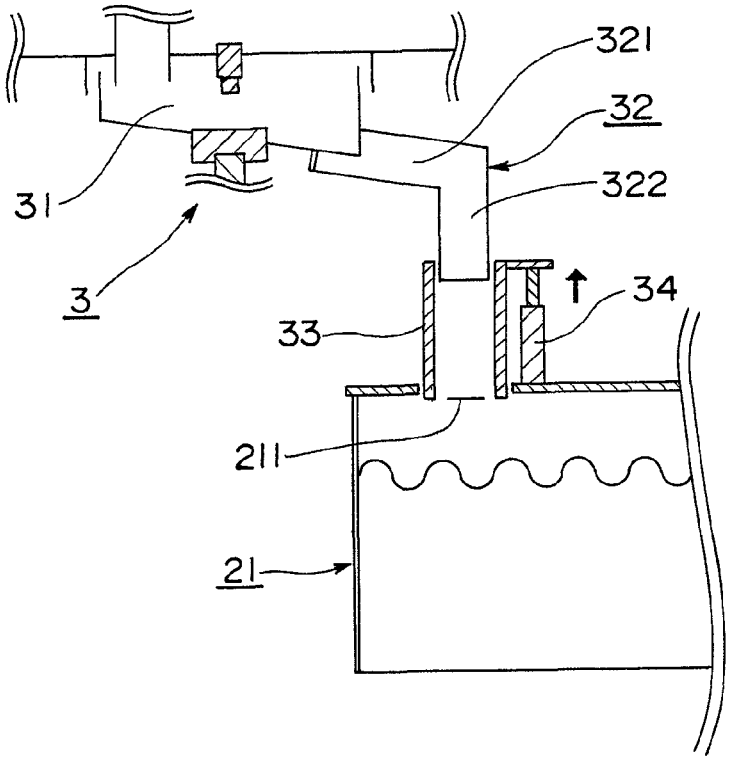
FIG. 51 is a cross-sectional view showing an operating state of the drain means of FIG. 50.

In this structure, the receiver 31 is rotated; then, as shown in FIG. 51, the vertical portion 322 of the discharge pipe 32 is located above the inlet 211 of the first tank 21, for example, the connecting pipe 33 is raised by the cylinder drive portion 34, and the inlet 211 is connected to the discharge pipe 32 via the connecting pipe 33.

Also in this structure, operational effects similar to those of the drain means 3 shown in FIG. 20 can be achieved.

<Modified Structure of Anode Electrode Support Means>

Figure 52:
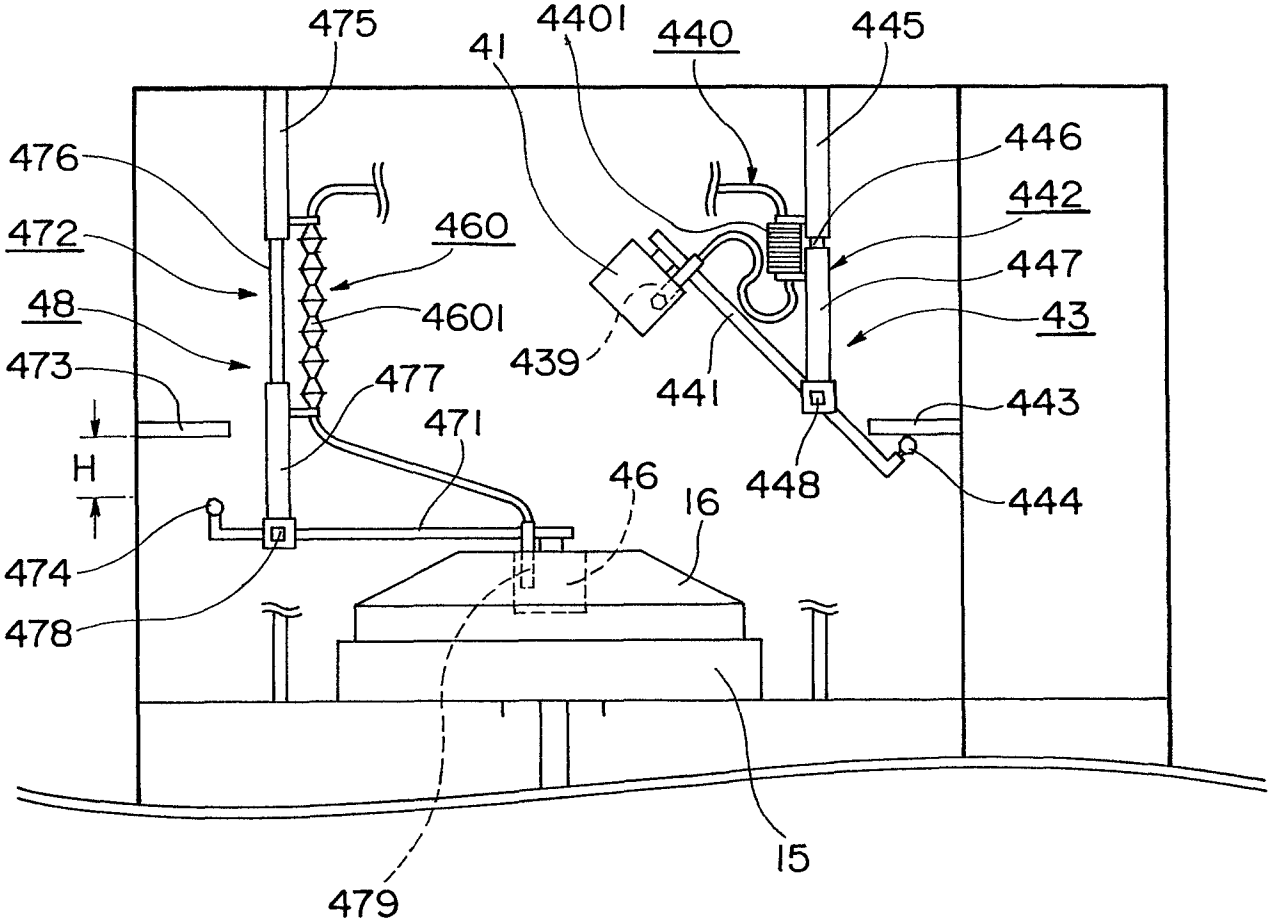
FIG. 52 is a side view showing a first modified example of an anode electrode support means.

(A) A first modified example will be described. FIG. 52 is a side view showing: the first anode electrode 41 and the support means 43 thereof; and the second anode electrode 46 and the support means 48 thereof. The first support means 43 for the first anode electrode 41 has an arm 441 extending laterally; a support body 442 extending up and down; and an abutment body 443.

The arm 441 supports, at its one end, the first anode electrode 41 and has, at an upper part of its other end, a roller 444.

The support body 442 has: a cylinder drive means 445; a pole 446 extending downward from the cylinder drive means 445; and a block 447 fixed to a lower end portion of the pole 446. The arm 441 is supported by a lower end of the block 447 at a position close to the roller 443 so as to be rotatable around a horizontal support shaft 448. It is to be noted that the rotation of the arm 441 is controlled such that the first anode electrode 41 does not go down from the horizontal position of the arm 441.

The abutment body 443 is provided at a position at which the roller 444 abuts against the abutment body from below when the arm 441 is raised by a predetermined distance H together with the first anode electrode 41 while being kept in the horizontal state.

Moreover, the first support means 43 is provided with a nozzle 439 of the first surface treatment liquid supply means 22. The nozzle 439 is supported by the arm 441 in the vicinity of the first anode electrode 41. The supply passage 440 leading to the nozzle 439 is fixed to the block 447 and to the cylinder drive means 445. A portion 4401 of the supply passage 440 between the block 447 and the cylinder drive means 445 has a bellows structure, and is therefore extendable and shrinkable.

The second support means 48 of the second anode electrode 46 also has a structure similar to that of the first support means 43. That is, the second support means 48 has the second support means has an arm 481, a support body 482, and an abutment body 483. The arm 481 has a roller 484. The support body 482 has a cylinder drive means 485, a pole 486, and a block 487. The arm 481 is rotatable around a horizontal support shaft 488. A nozzle 489 of the second surface treatment liquid supply means 24 is supported by the arm 481. A supply passage 460 leading to the nozzle 489 has, at a portion 4601 located between the block 487 and the cylinder drive means 485, a bellows structure, and is therefore extendable and shrinkable.

The anode electrode support means with the foregoing structure allows the anode electrode to be detached/attached by only moving up/down the pole, thus making it possible to enhance the operating efficiency.

Figure 53:
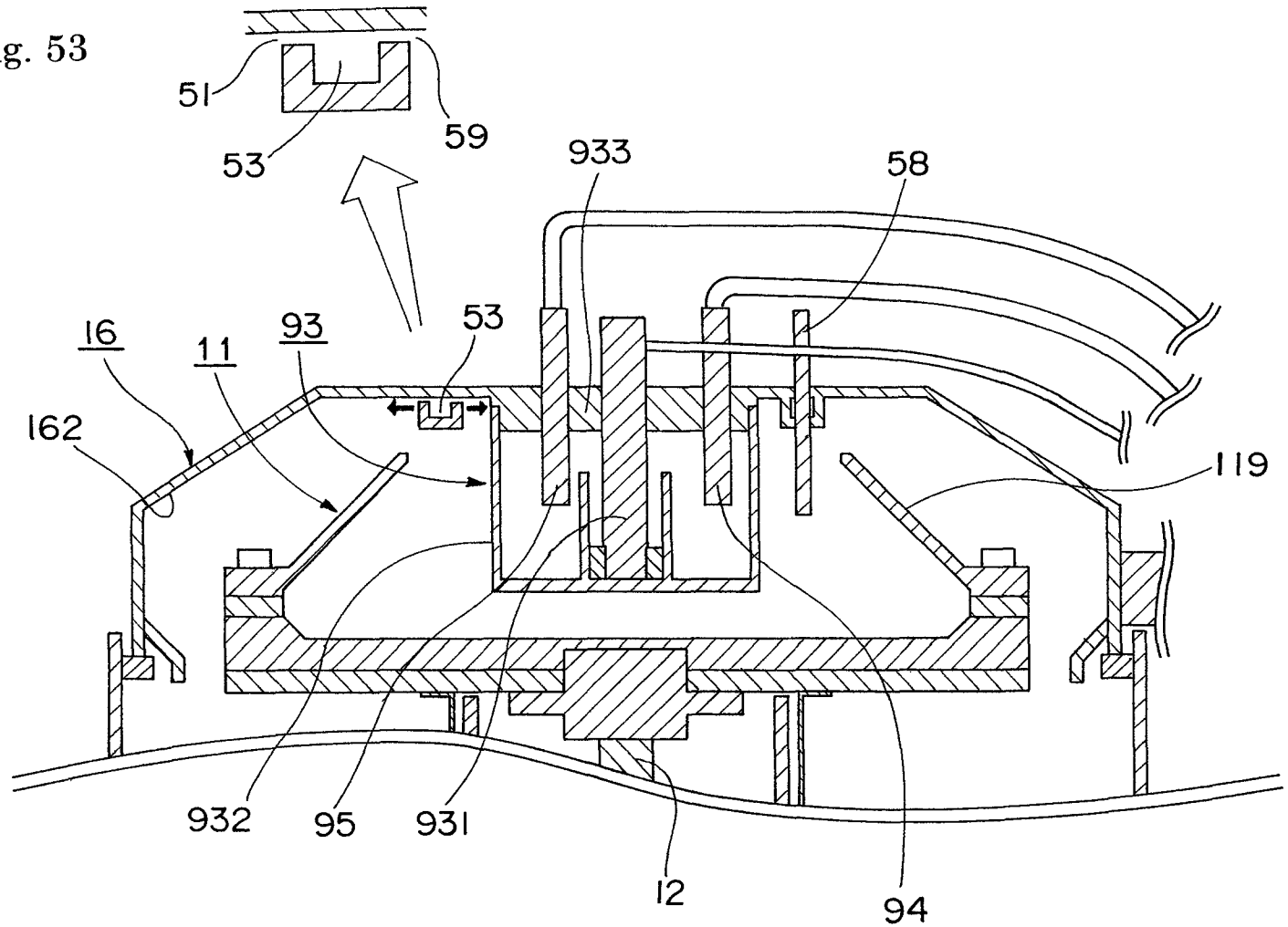
FIG. 53 is a cross-sectional view showing a second modified example of the anode electrode support means.

(B) A second modified example will be described. FIG. 53 is a longitudinal cross-sectional view of the support means in a case where only one anode electrode is used. In this example, the case where only one anode electrode is used refers to the case where only one type of surface treatment is carried out, or the case where an insoluble anode is used.

In this support means, an anode electrode 93, including an anode terminal 931 and an anode case 932, is provided in the center of the cover body 16. A lid portion 933 for covering the anode case 932 also covers the opening 161 of the cover body 16.

Further, the anode case 932 is provided at its inside with: a nozzle 94 for supplying a surface treatment liquid; and a nozzle 95 for supplying cleaning water. The inside of the anode case 932 is cleaned by the cleaning water supplied from the nozzle 95. The anode terminal 931 and the nozzles 94 and 95 pass through the lid portion 933, and are fixed to the lid portion 933.

Moreover, the water supply passage 53 of the first cleaning means 5 is provided with a slit 59 that is opened radially inward.

In the foregoing structure, the opening/closing of the cover body 16 can be performed in conjunction with the detachment/attachment of the anode electrode 93, thus making it possible to enhance the operating efficiency. In addition, since the necessity for the support means for supporting only the anode electrode can be eliminated, the structure of the apparatus can be simplified. Besides, since the opening 161 of the cover body 16 is covered by the lid portion 933, the surface treatment liquid can be prevented from going through the opening 161 and scattering therefrom.

Figure 54:
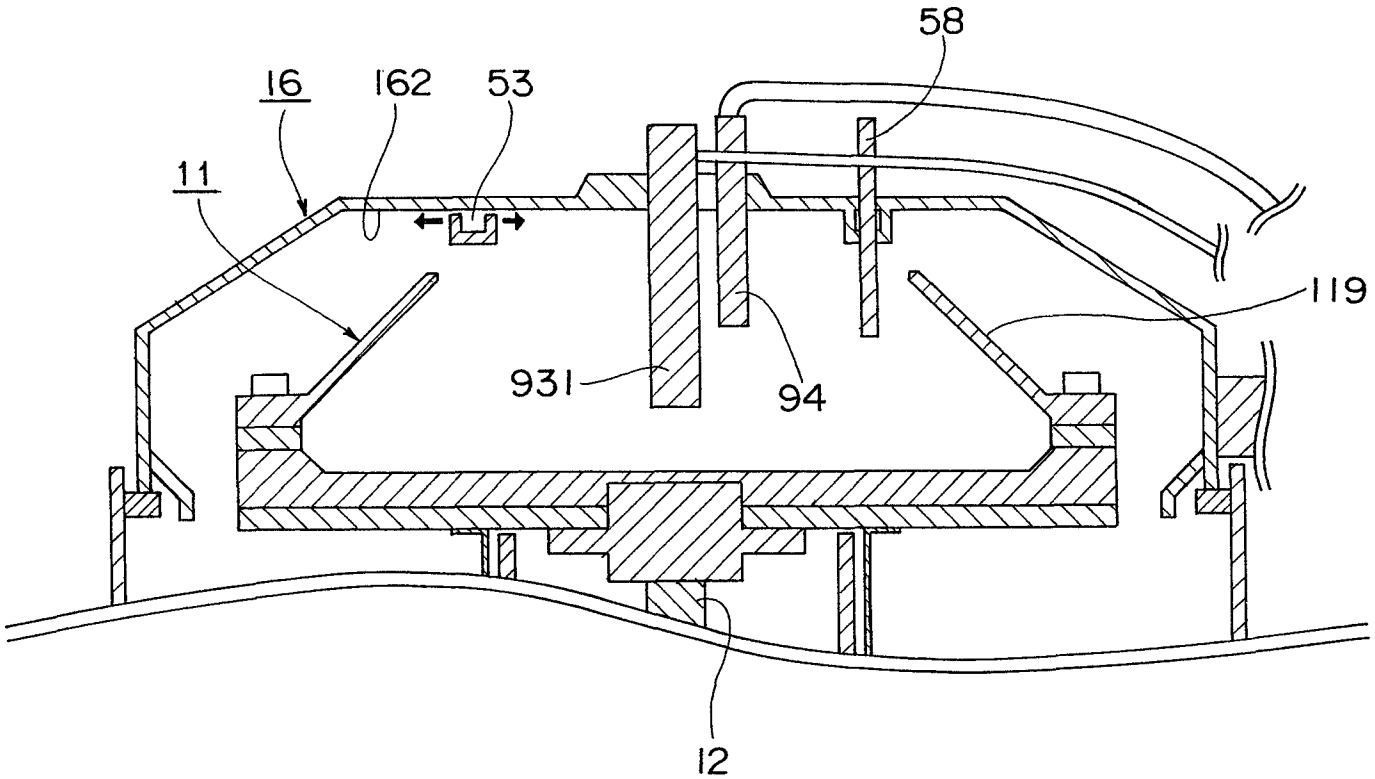
FIG. 54 is a side view showing a third modified example of the anode electrode support means.

(C) A third modified example will be described. FIG. 54 is a longitudinal cross-sectional view of the support means in a case where only one anode electrode is used. In this example, the case where only one anode electrode is used refers to the case where an insoluble anode is used. If an insoluble anode is used, there is no need to supply any metal ion, and therefore, it is unnecessary to provide any anode case for holding a metal serving as a metal ion supply source.

Hence, in this support means, the anode case and the nozzle 95 are eliminated as compared with the case shown in FIG. 53.

Also in the foregoing structure, effects similar to those of the case shown in FIG. 53 can be achieved.

It should be noted that the surface treatment apparatus of the present invention can be used not only to carry out two types of electroplating treatments including the first electroplating treatment and second electroplating treatment as described above, but also to carry out surface treatments described below.

In addition to an electroplating treatment, the surface treatments include a pre-treatment, a subsequent treatment, an electroless plating treatment, an electrodeposition treatment, a composite plating treatment, etc. Hereinafter, each of these treatments will be briefly described.

<I> Pre-Treatment

Degreasing Process

A surface treatment liquid is an alkaline degreaser. No electric current has to be passed. This process cleans oil off a small object surface.

Electrolytic Degreasing Process

A surface treatment liquid is an alkaline solution. Electric current has to be passed. In this process, a "cathode electrolysis method" uses each small object as a cathode to clean off the soil of a small object surface by a hydrogen gas generated from the cathode, an "anode electrolysis method" uses each small object as an anode to clean off the soil of the small object surface by an oxygen gas generated from the anode, and a "PR electrolysis method" periodically reverses the direction of electric current, thereby cleaning off the soil of the small object surface by utilizing the advantages of the "cathode electrolysis method" and the "anode electrolysis method".

Barrel Polishing Process

A surface treatment liquid is water, but does not have to be used. No electric current has to be passed. In this process, media for preventing flaws, a polishing agent and small objects are put into the treatment cell and are mixed therein, thereby polishing a small object surface. When water is used, wet polishing is performed, and when no water is used, dry polishing is performed.

Alkaline Immersion Cleaning Process

A surface treatment liquid is an alkaline solution. No electric current has to be passed. This process cleans off the soil of a small object surface.

Pickling Process

A surface treatment liquid is an acid liquid. No electric current has to be passed. This process removes rust, foreign matter and the like at a small object surface, or corrodes the small object surface, thereby improving the adherence between the small object surface and plating film.

Acid Electrolysis Process

A surface treatment liquid is an acid liquid. Electric current has to be passed. This process removes severe rust at a small object surface. This treatment includes a method of using each small object as a cathode, and a method of using each small object as an anode.

Chemical Polishing Process

A surface treatment liquid is a chemical polishing liquid. No electric current has to be passed. This process dissolves a convex region of a small object surface in excess of a concave region thereof by an action of the surface treatment liquid, thereby smoothing the small object surface.

Electropolishing Process

A surface treatment liquid is an electropolishing liquid. Electric current has to be passed. In this process, each small object is used as an anode, and a convex region of a small object surface is dissolved in excess, thereby smoothing the small object surface.

Neutralization Process

A surface treatment liquid is a neutralization liquid. No electric current has to be passed. This process neutralizes a small object surface.

<II> Subsequent Treatment

Draining-Induced Tarnish Prevention Process

A surface treatment liquid is an aqueous solution containing a few percent of water-soluble silicon, surface-active agent or the like. No electric current has to be passed. In this process, the drying of small objects is promoted, thereby preventing occurrence of stain and tarnish at a small object surface.

Water-Soluble Resin Process

A surface treatment liquid is an aqueous solution in which water-soluble resin is dissolved. No electric current has to be passed. In this process, small objects are immersed in the surface treatment liquid and are then dried, thereby forming an organic rust-inhibiting film at a small object surface.

Chromating Process

A surface treatment liquid is a liquid containing chromic acid and mineral acid. No electric current has to be passed. In this process, small objects are immersed in the surface treatment liquid, thereby forming a chromating film at a small object surface. This process is mainly carried out after a galvanizing process has been performed, and the chromating film is formed on the surface of a galvanized film, thereby improving the corrosion resistance of the galvanized film, and enhancing the appearance thereof.

<III> Electroless Plating Treatment

Immersion Plating Process

A surface treatment liquid is a solution containing ions of copper, nickel, tin, gold or the like. No electric current has to be passed. In this process, small objects made of base metal are immersed in the solution containing noble metal ions; thus, electrons discharged due to dissolution of a small object surface are transferred to the noble metal ions, thereby forming a noble metal film at the small object surface.

Chemical Plating Process

A surface treatment liquid is a solution containing: ions of copper, nickel, tin, gold or the like; and a reducing agent or the like. No electric current has to be passed. In this process, electrons discharged due to oxidation of the reducing agent are transferred to the metal ions, thereby forming a metal film at a small object surface.

<IV> Electrodeposition Treatment

Anion Electrodeposition Coating Process

A surface treatment liquid is an electrodeposition coating containing ionic resin particles dispersed in water. Electric current has to be passed. In this process, small objects are immersed in the electrodeposition coating, voltage is applied to both of the small objects and the electrodeposition coating using each small object as an anode, and the resin particles are attracted to the small objects, thereby forming a resin film at a small object surface.

Cation Electrodeposition Coating Process

This process is similar to the anion electrodeposition coating process except that each small object is used as a cathode.

<V> Composite Plating Treatment

Composite Plating Process

A surface treatment liquid is a composite plating liquid containing metal ions and non-metallic substance. Electric current has to be passed. In this process, small objects are immersed in the surface treatment liquid and electric current is passed therethrough, thereby forming, at a small object surface, a film in which metal and non-metallic substance are mixed with each other.

Chemical Composite Plating Process

This process is similar to the composite plating process except that no electric current is passed.

Moreover, the rotary surface treatment apparatus of the present invention is normally operated to perform the foregoing steps when two types of surface treatments, requiring passage of electric current, are carried out, but the steps <4>, <6>, <10> and <12> of the foregoing steps are unnecessary when two types of surface treatments, requiring no passage of electric current, are carried out. Further, when only one type of surface treatment, requiring passage of electric current, is carried out, the steps <9> to <14> of the foregoing steps are unnecessary. Furthermore, when only one type of surface treatment, requiring no passage of electric current, is carried out, the steps <9> to <14>, and <4> and <6> of the foregoing steps are unnecessary.

Second Embodiment

Figure 55:
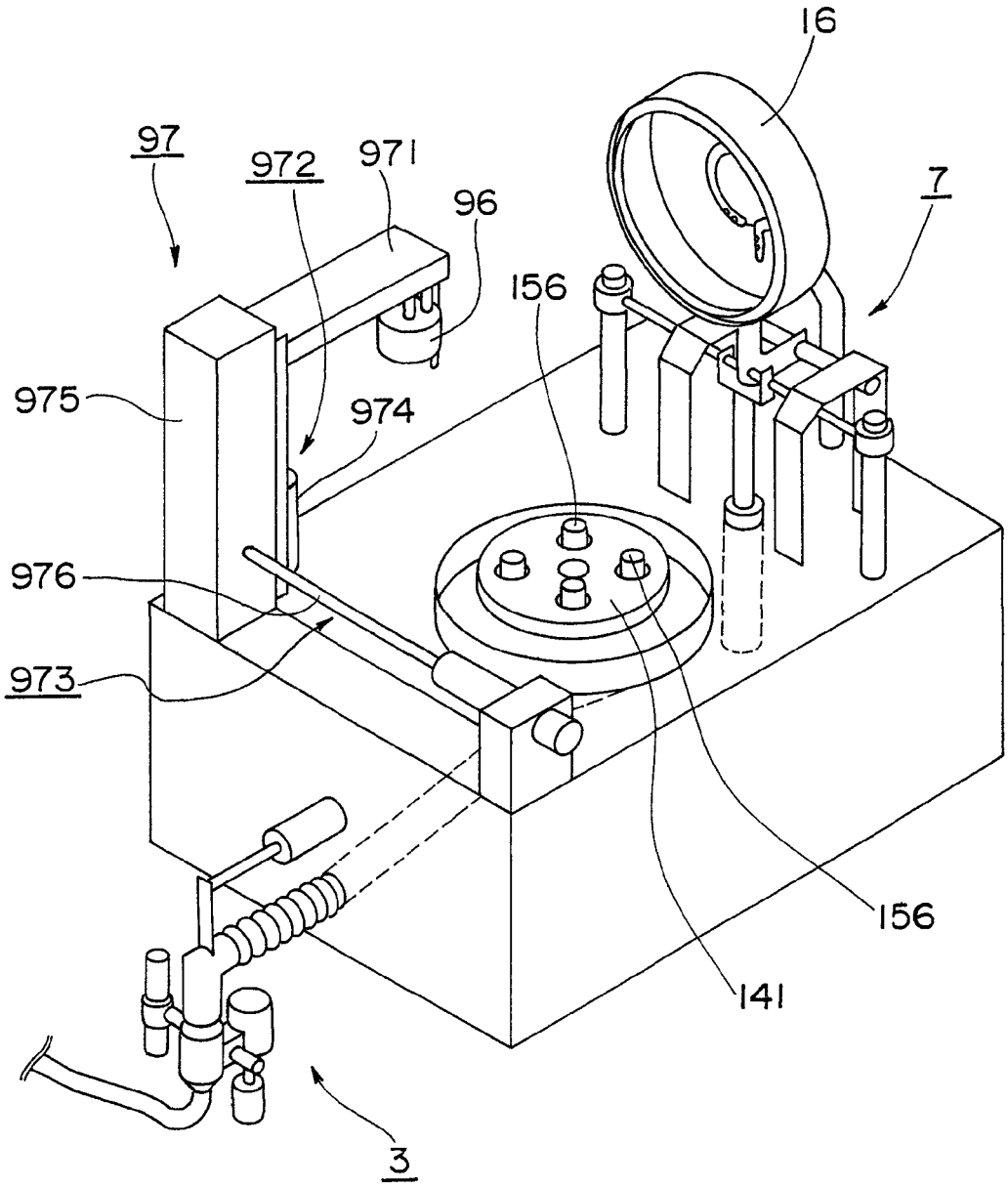
FIG. 55 is a perspective view of a surface treatment apparatus according to a second embodiment.

FIG. 55 is a perspective view of a surface treatment apparatus according to a second embodiment. The present embodiment relates to a so-called "single-liquid type" surface treatment apparatus for carrying out one type of surface treatment in the single apparatus. The constituent elements, provided on a two-by-two basis in the surface treatment apparatus of the first embodiment in order to use two types of surface treatment liquids, are provided on a one-by-one basis in the surface treatment apparatus of the present embodiment. The other structures of the present embodiment are similar to those of the first embodiment. In FIG. 55, the same reference characters as those in FIG. 1 to FIG. 54 denote the same or equivalent constituent elements.

An opening/closing means 7 of this apparatus is the opening/closing means shown in FIG. 41, and a drain means 3 of this apparatus is the drain means shown in FIG. 49.

A support means 97 for an anode electrode 96 of this apparatus has: an arm 971; a raising and lowering means 972; and a lateral movement means 973. The anode electrode 96 is supported at one end of the arm 971. The raising and lowering means 972 has: a pole (not shown); a cylinder drive means 974; and a slide shaft 975. The arm 971 is connected to an upper end of the pole, and is raised and lowered along the slide shaft 975 by the cylinder drive portion 974. The lateral movement means 973 is formed so as to move the slide shaft 975 laterally along a guide shaft 976.

In this support means 97, the lateral movement means 973 is operated in the state shown in FIG. 55, so that the slide shaft 975 moves laterally while holding the arm 971, and the anode electrode 96 is located above a treatment cell (not shown). Then, the raising and lowering means 972 is operated, and the arm 971 is lowered. Thus, the anode electrode 96 is inserted into the treatment cell. On the other hand, the anode electrode 96 is taken out from the treatment cell by performing these operations reversely.

With the use of the constituent elements similar to those of the surface treatment apparatus of the first embodiment, the surface treatment apparatus of the present embodiment is also operated similarly to the surface treatment apparatus of the first embodiment. Accordingly, also in the surface treatment apparatus of the present embodiment, operational effects similar to those of the surface treatment apparatus of the first embodiment can be achieved.

INDUSTRIAL APPLICABILITY

The surface treatment apparatuses of the present invention are capable of preventing the inside and/or outside of the apparatuses from being soiled, and are thus industrially very valuable.

The invention claimed is:

1. A surface treatment apparatus for carrying out a surface treatment on small objects while rotating a treatment cell containing the small objects, the surface treatment apparatus comprising:

a treatment cell having a liquid flow-out portion that allows a liquid to flow out from inside to outside, and capable of containing the small objects;

a receiving tank surrounding the treatment cell from below;

a cover body provided so as to cover the receiving tank from above, the cover body having an opening at its center;

a surface treatment liquid supply line that supplies a surface treatment liquid to the inside of the treatment cell; and a cleaning water supply line that supplies cleaning water to the inside of the treatment cell, wherein when the surface treatment liquid supply line is operated while the treatment cell is rotated, the surface treatment liquid is supplied to the inside of the treatment cell, and the surface treatment liquid is allowed to flow out from the treatment cell through the liquid flow-out portion, thereby carrying out a surface treatment on the small objects, wherein when the cleaning water supply line is operated while the treatment cell is rotated, the cleaning water is supplied to the inside of the treatment cell, and the cleaning water is allowed to flow out from the treatment cell through the liquid flow-out portion, thereby cleaning the small objects, wherein the apparatus further comprises a first cleaning device that ejects the cleaning water onto at least one of an inner face of the cover body and an outer face of the treatment cell, wherein when the first cleaning device is operated while the treatment cell is rotated, the at least one of the inner face of the cover body and the outer face of the treatment cell is cleaned, wherein the first cleaning device comprises at least one of a first ejection portion and a second ejection portion that ejects cleaning water, wherein the first ejection portion comprises an ejection port formed in a water supply passage provided along an edge of the opening of the cover body, and ejects the cleaning water onto the inner face of the cover body, wherein the second ejection portion comprises an ejection port formed in a water supply passage provided along the inner face of the cover body, and ejects the cleaning water onto the outer face of the treatment cell, and wherein an inner face of a lower end of a peripheral wall of the cover body is provided with a flange inclined inwardly downward, wherein the apparatus further comprises an opening/closing device that opens/closes the cover body relative to the receiving tank, wherein the opening/closing device raises/lowers the cover body to a predetermined height from a position at which the cover body covers the receiving tank, with the cover body kept in a horizontal state, and further moves the cover body from the predetermined height so that the cover body gets away from the receiving tank, wherein the opening/closing device comprises:

an arm extending from the cover body;

a rotary body provided at the other end side of the arm, and supported so as to be rotatable around a horizontal axis orthogonal to the arm;

a horizontal support shaft that rotatably supports the arm;

a support device that supports the arm so as to prevent a portion of the arm adjacent to the cover body from going down with the horizontal support shaft serving as a supporting point;

a raising and lowering device that raises and lowers the horizontal support shaft together with the arm; and an abutment body against which the rotary body of the arm, raised to a predetermined height, abuts from below, and wherein upon raising of the horizontal support shaft, the cover body is raised while being kept in a horizontal state until the rotary body abuts against the abutment body, and after the rotary body has abutted against the abutment body, the cover body is raised while being inclined along with the rotation of the arm around the horizontal support shaft, and wherein the abutment body is provided above the rotary body at the other end side of the arm.

2. A surface treatment apparatus for carrying out a surface treatment on small objects while rotating a treatment cell containing the small objects, the surface treatment apparatus comprising:

a treatment cell having liquid flow-out portion that allows a liquid to flow out from inside to outside, and capable of containing the small objects;

a receiving tank surrounding the treatment cell from below;

a cover body provided so as to cover the receiving tank from above, the cover body having an opening at its center;

a surface treatment liquid supply line that supplies a surface treatment liquid to the inside of the treatment cell; and a cleaning water supply line that supplies cleaning water to the inside of the treatment cell, wherein when the surface treatment liquid supply line is operated while the treatment cell is rotated, the surface treatment liquid is supplied to the inside of the treatment cell, and the surface treatment liquid is allowed to flow out from the treatment cell through the liquid flow-out portion, thereby carrying out a surface treatment on the small objects, wherein when the cleaning water supply line is operated while the treatment cell is rotated, the cleaning water is supplied to the inside of the treatment cell, and the cleaning water is allowed to flow out from the treatment cell through the liquid flow-out portion, thereby cleaning the small objects, wherein the apparatus further comprises an opening/closing device that opens/closes the cover body relative to the receiving tank, wherein the opening/closing device raises/lowers the cover body to a predetermined height from a position at which the cover body covers the receiving tank, with the cover body kept in a horizontal state, and further moves the cover body from the predetermined height so that the cover body gets away from the receiving tank, wherein the opening/closing device comprises:

an arm extending from the cover body;

a rotary body provided at the other end side of the arm, and supported so as to be rotatable around a horizontal axis orthogonal to the arm;

a horizontal support shaft that rotatably supports the arm;

a support device that supports the arm so as to prevent a portion of the arm adjacent to the cover body from going down with the horizontal support shaft serving as a supporting point;

a raising and lowering device that raises and lowers the horizontal support shaft together with the arm; and an abutment body against which the rotary body of the arm, raised to a predetermined height, abuts from below, wherein upon raising of the horizontal support shaft, the cover body is raised while being kept in a horizontal state until the rotary body abuts against the abutment body, and after the rotary body has abutted against the abutment body, the cover body is raised while being inclined along with the rotation of the arm around the horizontal support shaft, and wherein the abutment body is provided above the rotary body at the other end side of the arm.

3. A surface treatment apparatus for carrying out a surface treatment on small objects while rotating a treatment cell containing the small objects, the surface treatment apparatus comprising:

a treatment cell having liquid flow-out portion that allows a liquid to flow out from inside to outside, and capable of containing the small objects;

a receiving tank surrounding the treatment cell from below;

a cover body provided so as to cover the receiving tank from above, the cover body having an opening at its center;

a tank for containing a surface treatment liquid;

a surface treatment liquid supply line that supplies the surface treatment liquid, contained in the tank, to the inside of the treatment cell;

a cleaning water supply line that supplies cleaning water to the inside of the treatment cell; and a drain device that returns the surface treatment liquid, received by the receiving tank, to the tank containing the surface treatment liquid, and for flowing the cleaning water, received by the receiving tank, to a discharge portion, wherein when the surface treatment liquid supply line is operated while the treatment cell is rotated, the surface treatment liquid is supplied to the inside of the treatment cell, and the surface treatment liquid is allowed to flow out from the treatment cell through the liquid flow-out portion, thereby carrying out a surface treatment on the small objects, wherein when the cleaning water supply line is operated while the treatment cell is rotated, the cleaning water is supplied to the inside of the treatment cell, and the cleaning water is allowed to flow out from the treatment cell through the liquid flow-out portion, thereby cleaning the small objects, wherein the drain device comprises:

a discharge member communicated with a discharge port of the receiving tank, the discharge member including a receiver and a discharge pipe;

a connecting pipe provided so as to be connected to an end portion of the discharge member or to each of inlets of the tank and the discharge portion, in a manner movable up and down;

a raising and lowering portion that moves the connecting pipe up and down; and a moving portion that moves the end portion of the discharge member, wherein the end portion of the discharge member is moved so as to be located above a selected one of the inlets of the tank and the discharge portion, and the connecting pipe is raised or lowered, thereby connecting the discharge member with the inlet via the connecting pipe, wherein the receiver includes a bottom face and a peripheral wall, the bottom face is inclined so as to be lowered toward a discharge port, and the discharge pipe is communicated with the discharge port and is fixed to the receiver, wherein the apparatus further comprises an opening/closing device that opens/closes the cover body relative to the receiving tank, wherein the opening/closing device raises/lowers the cover body to a predetermined height from a position at which the cover body covers the receiving tank, with the cover body kept in a horizontal state, and further moves the cover body from the predetermined height so that the cover body gets away from the receiving tank, wherein the opening/closing device comprises:

an arm extending from the cover body;

a rotary body provided at the other end side of the arm, and supported so as to be rotatable around a horizontal axis orthogonal to the arm;

a horizontal support shaft that rotatably supports the arm;

a support device that supports the arm so as to prevent a portion of the arm adjacent to the cover body from going down with the horizontal support shaft serving as a supporting point;

a raising and lowering device that raises and lowers the horizontal support shaft together with the arm; and an abutment body against which the rotary body of the arm, raised to a predetermined height, abuts from below, and wherein upon raising of the horizontal support shaft, the cover body is raised while being kept in a horizontal state until the rotary body abuts against the abutment body, and after the rotary body has abutted against the abutment body, the cover body is raised while being inclined along with the rotation of the arm around the horizontal support shaft, and wherein the abutment body is provided above the rotary body at the other end side of the arm.

4. A surface treatment apparatus for carrying out two types of surface treatments on small objects while rotating a treatment cell containing the small objects, the surface treatment apparatus comprising:

a treatment cell having liquid flow-out portion that allows a liquid to flow out from inside to outside, and capable of containing the small objects;

a receiving tank surrounding the treatment cell from below;

a cover body provided so as to cover the receiving tank from above, the cover body having an opening at its center;

two tanks for individually containing two types of surface treatment liquids;

two surface treatment liquid supply lines that individually supply the surface treatment liquids, contained in the two tanks, to the inside of the treatment cell;

a cleaning water supply line that supplies cleaning water to the inside of the treatment cell; and a drain device for returning the surface treatment liquid, received by the receiving tank, to the tank containing the surface treatment liquid, and for flowing the cleaning water, received by the receiving tank, to a discharge portion, wherein when the surface treatment liquid supply lines are operated while the treatment cell is rotated, the surface treatment liquid is supplied to the inside of the treatment cell, and the surface treatment liquid is allowed to flow out from the treatment cell through the liquid flow-out portion, thereby carrying out a surface treatment on the small objects, wherein when the cleaning water supply line is operated while the treatment cell is rotated, the cleaning water is supplied to the inside of the treatment cell, and the cleaning water is allowed to flow out from the treatment cell through the liquid flow-out portion, thereby cleaning the small objects, wherein the apparatus further comprises a first cleaning device that ejects the cleaning water onto at least one of an inner face of the cover body and an outer face of the treatment cell, wherein when the first cleaning device is operated while the treatment cell is rotated, the at least one of the inner face of the cover body and the outer face of the treatment cell is cleaned, wherein the apparatus further comprises an opening/closing device that opens/closes the cover body relative to the receiving tank, wherein the opening/closing device raises/lowers the cover body to a predetermined height from a position at which the cover body covers the receiving tank, with the cover body kept in a horizontal state, and further moves the cover body from the predetermined height so that the cover body gets away from the receiving tank, wherein the drain device comprises:

a discharge member communicated with a discharge port of the receiving tank;

a connecting pipe provided so as to be connected to an end portion of the discharge member or to each of inlets of the two tanks and the discharge portion, in a manner movable up and down;

a raising and lowering portion that moves the connecting pipe up and down; and a moving portion that moves the end portion of the discharge member, wherein the end portion of the discharge member is moved so as to be located above a selected one of the inlets of the two tanks and the discharge portion, and the connecting pipe is raised or lowered, thereby connecting the discharge member with the inlet via the connecting pipe, wherein the opening/closing device comprises:

an arm extending from the cover body;

a rotary body provided at the other end side of the arm, and supported so as to be rotatable around a horizontal axis orthogonal to the arm;

a horizontal support shaft that rotatably supports the arm;

a support device that supports the arm so as to prevent a portion of the arm adjacent to the cover body from going down with the horizontal support shaft serving as a supporting point;

a raising and lowering device that raises and lowers the horizontal support shaft together with the arm; and an abutment body against which the rotary body of the arm, raised to a predetermined height, abuts from below, and wherein upon raising of the horizontal support shaft, the cover body is raised while being kept in a horizontal state until the rotary body abuts against the abutment body, and after the rotary body has abutted against the abutment body, the cover body is raised while being inclined along with the rotation of the arm around the horizontal support shaft, and wherein the abutment body is provided above the rotary body at the other end side of the arm.

5. The surface treatment apparatus according to claim 1, wherein the apparatus comprises a second cleaning device for ejecting cleaning water onto an inner face of the discharge member.

6. The surface treatment apparatus according to claim 4, wherein the first cleaning device comprises at least one of a first ejection portion and a second ejection portion that ejects cleaning water, wherein the first ejection portion comprises an ejection port formed in a water supply passage provided along an edge of the opening of the cover body, and ejects the cleaning water onto the inner face of the cover body, and wherein the second ejection portion comprises an ejection port formed in a water supply passage provided along the inner face of the cover body, and ejects the cleaning water onto the outer face of the treatment cell.

7. The surface treatment apparatus according to claim 4, wherein the apparatus comprises a second cleaning device that ejects cleaning water onto an inner face of the discharge member.

* * * * *